United States Patent [19]

Winkler

[11] 4,037,688

[45] July 26, 1977

[54] ELEVATOR SYSTEM

[75] Inventor: Charles L. Winkler, Worthington, Pa.

[73] Assignee: Westinghouse Electric Corporation, Pittsburgh, Pa.

[21] Appl. No.: 574,829

[22] Filed: May 5, 1975

Related U.S. Application Data

[63] Continuation-in-part of Ser. No. 503,201, Sept. 4, 1974, abandoned.

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,561,571 | 2/1971 | Gingrich | 187/29 |
| 3,589,473 | 6/1971 | Kirsch et al. | 187/29 |
| 3,739,880 | 6/1973 | Robaszkiewicz | 187/29 |

*Primary Examiner*—Robert K. Schaefer

*Assistant Examiner*—W. E. Duncanson, Jr.

*Attorney, Agent, or Firm*—D. R. Lackey

[57] ABSTRACT

An elevator system including supervisory system control for controlling a plurality of elevator cars to answer calls for elevator service. The supervisory system control, using information provided by the cars, groups the floors of a building, and service directions therefrom, into sets, each of which indicates those floors and service directions served by the same combination of in-service elevator cars. The supervisory system control periodically determines, for each set, the average number of floors and service directions therefrom, and the average number of calls, per in-service elevator car serving the set. The supervisory system control then assigns floors and service directions therefrom to the cars, using these averages, to substantially equally distribute the floors, and service directions therefrom, for each set, among the elevator cars serving the set, as well as to substantially equally distribute the calls for elevator service among the elevator cars.

78 Claims, 27 Drawing Figures

PKFL
DNIN
UPIN
SUT
SDT
DOPN
NEXT
242
240
256
258
260
262
264
244
234
232
12V
Q
TRIG
RETRIG
R
AS
-TR
246
248
250
252
254
D
C
RES
SET
274
276
278
280
28
230
238
236
272
270
S/R
REC
MODE
CL
210
220
226
214
228
216
218
224
212
266
222
STB
STA
INSC
COMO
KO8
STD
KO8
S300
S100
DECO
DEC1
DEC2
KO8S
SECO
STC
DEC3

28

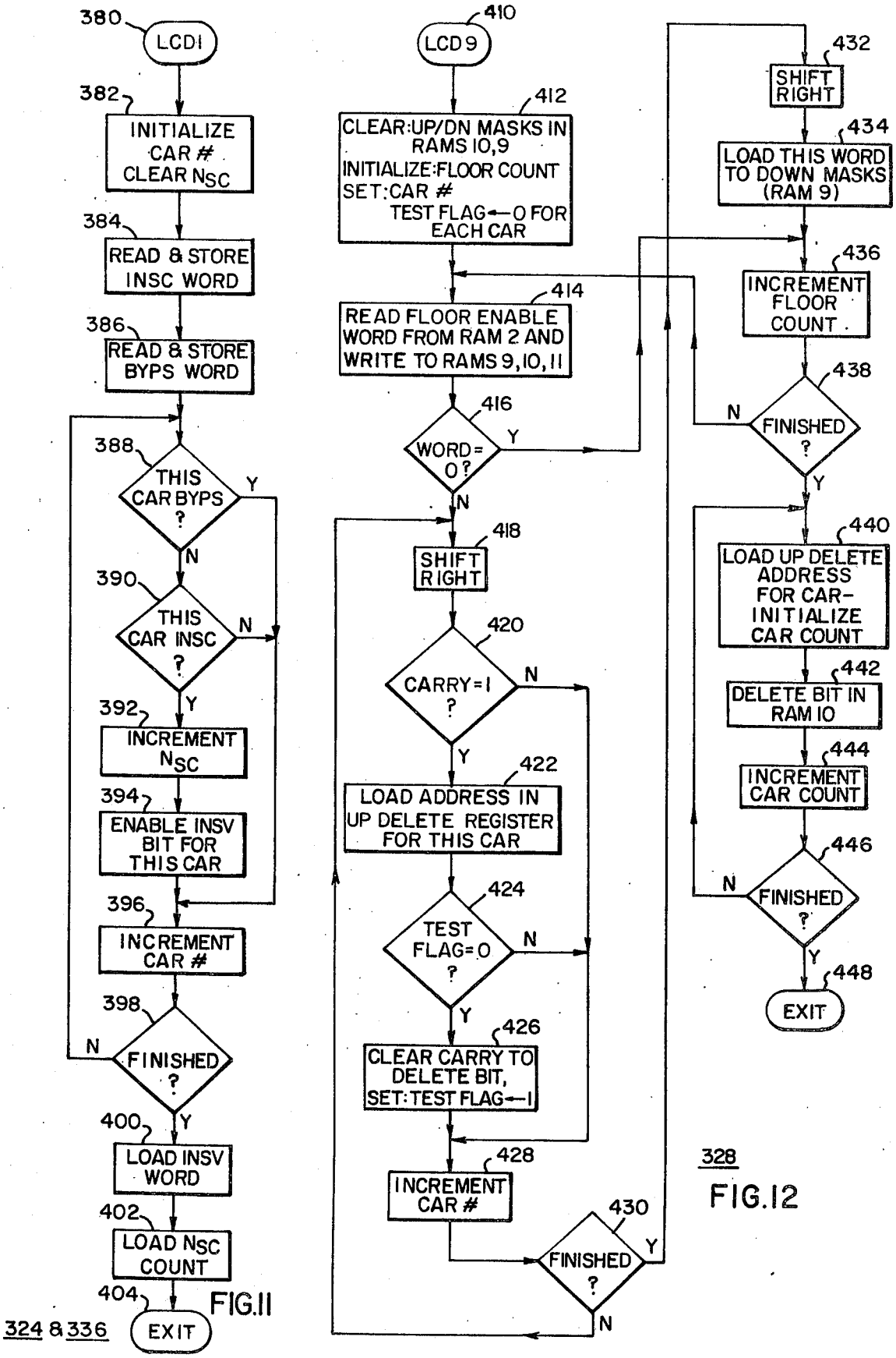
380
LCD1
382
INITIALIZE CAR # CLEAR NSC
384
READ & STORE INSC WORD
386
READ & STORE BYPS WORD
388
THIS CAR BYPS ?
390
THIS CAR INSC ?
392
INCREMENT NSC
394
ENABLE INSV BIT FOR THIS CAR
396
INCREMENT CAR #
398
FINISHED ?
400
LOAD INSV WORD
402
LOAD NSC COUNT
404
EXIT
324 & 336
FIG.11
410
LCD9
412
CLEAR:UP/DN MASKS IN RAMS 10,9
INITIALIZE:FLOOR COUNT
SET:CAR #
TEST FLAG←0 FOR EACH CAR
414
READ FLOOR ENABLE WORD FROM RAM 2 AND WRITE TO RAMS 9,10,11
416
WORD=0?
418
SHIFT RIGHT
420
CARRY=1 ?
422
LOAD ADDRESS IN UP DELETE REGISTER FOR THIS CAR
424
TEST FLAG=0 ?
426
CLEAR CARRY TO DELETE BIT, SET:TEST FLAG←1
428
INCREMENT CAR #
430
FINISHED ?
432
SHIFT RIGHT
434
LOAD THIS WORD TO DOWN MASKS (RAM 9)
436
INCREMENT FLOOR COUNT
438
FINISHED ?
440
LOAD UP DELETE ADDRESS FOR CAR-INITIALIZE CAR COUNT
442
DELETE BIT IN RAM 10
444
INCREMENT CAR COUNT
446
FINISHED ?
448
EXIT
328
FIG.12

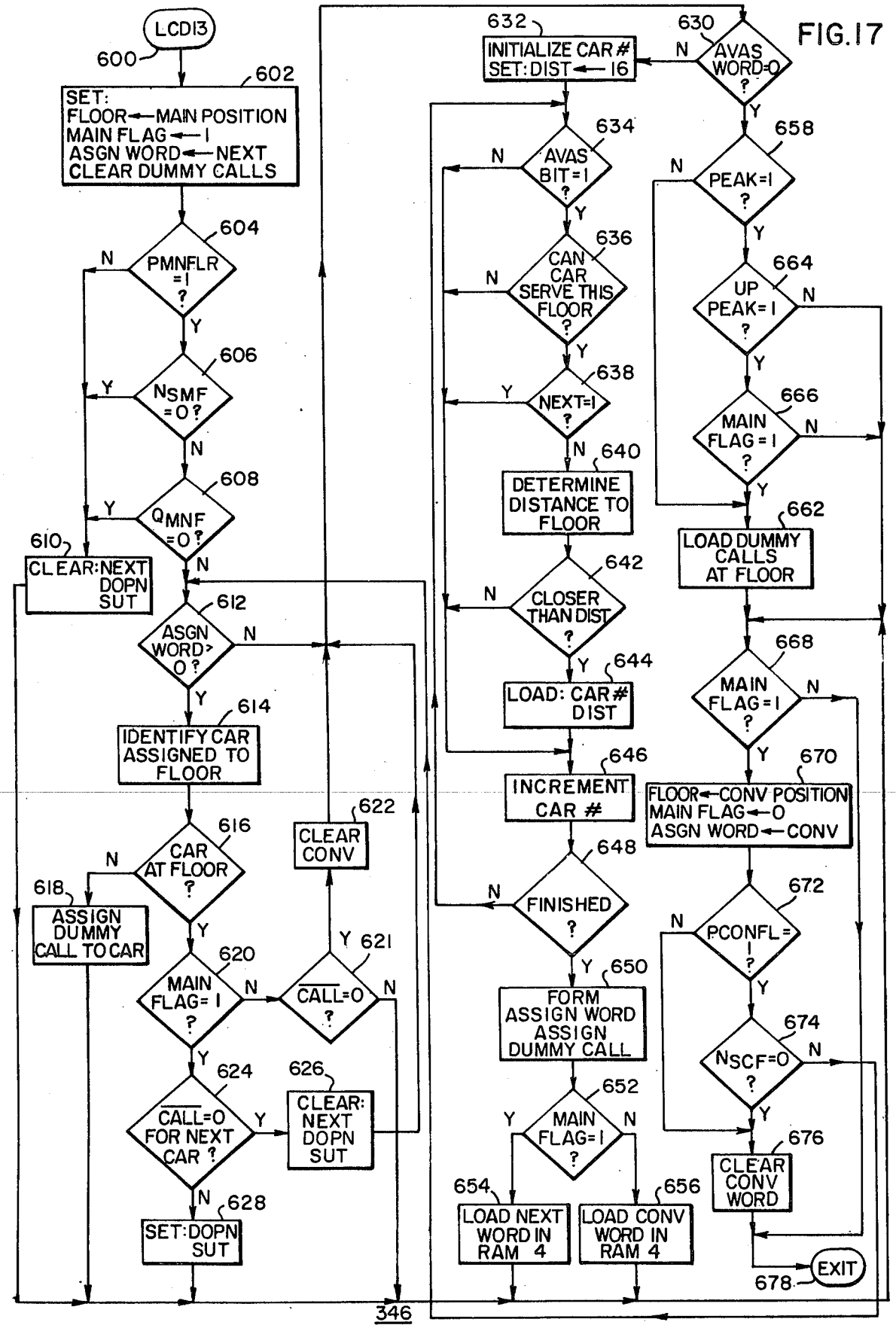
FIG.17
LCD13
600
602
SET:
FLOOR←MAIN POSITION
MAIN FLAG←1
ASGN WORD←NEXT
CLEAR DUMMY CALLS
604
PMNFLR =1 ?
606
NSMF =0 ?
608
QMNF =0 ?
610
CLEAR:NEXT DOPN SUT
612
ASGN WORD> 0 ?
614
IDENTIFY CAR ASSIGNED TO FLOOR
616
CAR AT FLOOR ?
618
ASSIGN DUMMY CALL TO CAR
620
MAIN FLAG=1 ?
621
CALL=0 ?
622
CLEAR CONV
624
CALL=0 FOR NEXT CAR ?
626
CLEAR: NEXT DOPN SUT
628
SET:DOPN SUT
630
AVAS WORD=0 ?
632
INITIALIZE CAR# SET:DIST←16
634
AVAS BIT=1 ?
636
CAN CAR SERVE THIS FLOOR ?
638
NEXT=1 ?
640
DETERMINE DISTANCE TO FLOOR
642
CLOSER THAN DIST ?
644
LOAD: CAR# DIST
646
INCREMENT CAR #
648
FINISHED ?
650
FORM ASSIGN WORD ASSIGN DUMMY CALL
652
MAIN FLAG=1 ?
654
LOAD NEXT WORD IN RAM 4
656
LOAD CONV WORD IN RAM 4
658
PEAK=1 ?
664
UP PEAK=1 ?
666
MAIN FLAG=1 ?
662
LOAD DUMMY CALLS AT FLOOR
668
MAIN FLAG=1 ?
670
FLOOR←CONV POSITION
MAIN FLAG←0
ASGN WORD←CONV
672
PCONFL= 1 ?
674
NSCF=0 ?
676
CLEAR CONV WORD
678
EXIT
346

| SCAN SLOTS | FLOOR POSITION | FLOOR FUNCTION | CARS 3 U | CARS 3 D | CARS 2 U | CARS 2 D | CARS 1 U | CARS 1 D | CARS 0 U | CARS 0 D | SCAN SLOTS | HALL CALLS (RAM 1) U | HALL CALLS (RAM 1) D | ASSIGNMENT TABLES UP (RAM 6) CARS 3 | UP 2 | UP 1 | UP 0 | DN (RAM 7) CARS 3 | DN 2 | DN 1 | DN 0 | SET ADDRESSES | | | | $A_{CI}$ (RAM 2) | $A_{SI}$ (RAM 8) | DN CALL MASKS (RAM 9) CARS 3 | DN 2 | DN 1 | DN 0 | UP CALL MASKS (RAM 10) CARS 3 | UP 2 | UP 1 | UP 0 |
|---|---|---|---|---|---|---|---|---|---|---|---|---|---|---|---|---|---|---|---|---|---|---|---|---|---|---|---|---|---|---|---|---|---|---|---|
| 15 | 16 | TE2 | | | | | | | | | 15 | | ∇ | | | | | | X | | | 1 | 1 | 1 | 1 | $A_{CI}=1$ | $A_{SI}=6$ | 1 | 1 | 0 | 0 | 0 | 0 | 0 | 0 |
| 14 | 15 | TE1 | | | | | | | | | 14 | Δ | | X | | | | | X | | | 1 | 1 | 1 | 0 | | | 1 | 1 | 0 | 0 | 1 | 1 | 0 | 0 |
| 13 | 14 | 12 | cc | | | | | | | | 13 | | ∇ | X | | | | X | | | | 1 | 1 | 0 | 1 | | | 1 | 1 | 1 | 1 | 1 | 1 | 0 | 0 |
| 12 | 13 | 11 | ↑ | | | | | | | | 12 | | | | | X | | | | X | | 1 | 1 | 0 | 0 | $A_{CI}=2$ | $A_{SI}=2$ | 1 | 1 | 1 | 1 | 1 | 1 | 1 | 1 |
| 11 | 12 | 10 | | | | | | | | | 11 | | | | | X | | | | X | | 1 | 0 | 1 | 1 | | | 1 | 1 | 1 | 1 | 1 | 1 | 1 | 1 |
| 10 | 11 | 9 | | | | | cc | | | | 10 | Δ | | | | X | | X | | | | 1 | 0 | 1 | 0 | | | 1 | 1 | 1 | 1 | 1 | 1 | 1 | 1 |
| 09 | 10 | 8 | | | | | ↑ | | | | 09 | | ∇ | | | X | | | | X | | 1 | 0 | 0 | 1 | | | 1 | 1 | 1 | 1 | 1 | 1 | 1 | 1 |
| 08 | 9 | 7 | | | | | | | | | 08 | | ∇ | | X | | | | | | | 1 | 0 | 0 | 0 | | | 1 | 1 | 1 | 1 | 1 | 1 | 1 | 1 |
| 07 | 8 | 6 | | | | | | | | | 07 | | | | X | | | X | | | | 0 | 1 | 1 | 1 | | | 1 | 1 | 1 | 1 | 1 | 1 | 1 | 1 |
| 06 | 7 | 5 | | | | | | | | | 06 | | | | | | X | X | | | | 0 | 1 | 1 | 0 | | | 1 | 1 | 1 | 1 | 1 | 1 | 1 | 1 |
| 05 | 6 | 4 | | | | | | | | | 05 | | | | | | X | X | | | | 0 | 1 | 0 | 1 | | | 1 | 1 | 1 | 1 | 1 | 1 | 1 | 1 |
| 04 | 5 | 3 | | | | | | | | ↓ | 04 | | | | | | X | X | | | | 0 | 1 | 0 | 0 | | | 1 | 1 | 1 | 1 | 1 | 1 | 1 | 1 |
| 03 | 4 | 2 | | | | | | | | | 03 | Δ | | | | | X | | | | X | 0 | 0 | 1 | 1 | $A_{CI}=0$ | $A_{SI}=1$ | 1 | 1 | 1 | 1 | 1 | 1 | 1 | 1 |
| 02 | 3 | 1 | | | N | | | | | cc | 02 | | | | X | | | | | | X | 0 | 0 | 1 | 0 | | | 0 | 0 | 1 | 1 | 1 | 1 | 1 | 1 |
| 01 | 2 | B1 | | | | | | | | | 01 | | | | | X | | | | | X | 0 | 0 | 0 | 1 | $A_{CI}=1$ | $A_{SI}=2$ | 0 | 0 | 0 | 1 | 0 | 0 | 1 | 1 |
| 00 | 1 | B2 | | | | | | | | | 00 | Δ | | | | | X | | | | | 0 | 0 | 0 | 0 | | | 0 | 0 | 0 | 0 | 0 | 0 | 0 | 1 |
| | | | | | | | | | | | | | | | | | | | | | | | | | | $A_{CB}=2$ | $A_{SB}=8$ | | | | | | | | |

FIG. 24

ELEVATOR SYSTEM

This is a continuation-in-part of application Ser. No. 503,201 filed Sept. 4, 1974, now abandoned.

CROSS REFERENCE TO RELATED APPLICATIONS

Certain of the apparatus disclosed and described in this application is claimed in the following concurrently filed applications, which are assigned to the same assignee at the present application.

Ser. No. 574,664, filed May 5, 1975 in the names of C. L. Winkler and K. M. Eichler, which application is a continuation-in-part of Ser. No. 503,212, filed Sept. 4, 1974, now abandoned.

Ser. No. 574,662, filed May 5, 1975 in the names of A. E. Kirsch and C. L. Winkler, which application is a continuation-in-part of Ser. No. 503,146, filed Sept. 4, 1974, now abandoned.

BACKGROUND OF THE INVENTION

1. Field of the Invention

The invention relates in general to elevator systems, and more specifically to new and improved supervisory system control and strategies for directing a plurality of elevator cars to answer calls for elevator service.

2. Description of the Prior Art:

Early attempts in the elevator industry to distribute calls for elevator service among a plurality of elevator cars set up service zones which extended from one car to the next busy car operating ahead of it. U.S. Pat. No. 2,064,045 is an example of this type of zoning. In U.S. Pat. No. 2,066,906 pushbuttons were provided at each landing for each car, with the service zone of a car illuminating the floor pushbuttons located at the floors of the service zone to indicate to prospective passengers which button to actuate in order to receive the most prompt service.

An early attempt at quota type control is disclosed in U.S. Pat. No. 2,020,981, which permitted an elevator car to stop only at those hall calls registered before it left the terminal. Later, quota controls were imposed on service zones. The quoto mechanism could be set to prevent a car from appropriating more unanswered calls from its service zone at any one time than the quota, or it could be set to limit the number of stops a car made on a round trip by preventing the car from accepting any further calls once it had accepted its quota. U.S. Pat. No. 2,104,478 is an example of quota zoning.

Down peak zoning divides the building into zones during a down peak traffic condition to prevent inequitable service to the lower floors of the building. U.S. Pat. No. 2,376,113 reversed certain uptraveling cars at the highest call of the lower of two zones when the traffic level of the lower zone reached a predetermined magnitude. U.S. Pat. No. 2,447,935 reversed cars at the highest down call of a zone when the traffic level reached a predetermined level and there were no cars in the zone.

U.S. Pat. Nos. 2,470,495 and 2,470,496 disclosed timed dispatching systems which automatically switched between a plurality of different traffic patterns based upon detected traffic conditions, including zoning during up peak and down peak conditions.

U.S. Pat. No. 3,256,958 discloses a zoned demand system, in which the elevator cars operate in response to demands, instead of a timed dispatching sequence.

U.S. Pat. No. 3,614,997 determines the traffic level in each car's service zone, and the traffic levels are summed and divided by the number of cars to obtain an average. This average traffic level in the zones is used to control spacing and work load of the cars by causing a car ahead of a car having a less than average work load to by-pass hall calls, and also to determine when a car is available for special direct service to a priority hall call.

U.S. Pat. No. 3,729,066 develops service zones between elevator cars and shifts the service zones to balance the service by generating imaginary positions of the cars, and considers the service zones from these imaginary positions.

The early supervisory system controls were relay implemented, while the later controls utilize solid state technology. The switch to solid state supervisory system control continued the philosophy of the large, complex relay implemented control, with the handling of the large amount of data associated with a plurality of elevator cars in a large building requiring either a complex hardwired logic system, or a powerful general purpose minicomputer. While these approaches are well suited for the larger banks of high speed elevators, it is too costly for the smaller banks of medium speed elevators.

The microprocessors, such as Intel's MCS-4 and MCS-8, Rockwell's PPS, Signetic's PIP, National's GPC/P and AMI's 7300, offer an attractive cost package as well as flexibility due to the LSI circuitry and programmability. The central processing unit (CPU) is usually a single chip, with the typical softward package stored in companion read-only-memories (ROMS). Data is stored in random access memories (RAMS).

While the microprocessor offers programming flexibility at a modest cost, it also imposes certain restrictions due to its relatively limited speed and memory capacity.

It would thus be desirable to provide a new and improved universal operating strategy for control of a group of elevator cars which will lend itself to use with a microprocessor, taking full advantage of the capabilities of the microprocessor, while working within its memory and speed limitations, to achieve fast, efficient elevator service for the floors of an associated building.

SUMMARY OF THE INVENTION

Briefly, the present invention is a new and improved elevator system having a plurality of elevator cars controlled according to a new and improved universal strategy which accomodates all possible building configurations in which any elevator car may serve any combination of floors. The individual car controllers provide complete information as to the building configuration which exists at any instant, and thus the supervisory control may be universally applied to any system without any significant modification. Further, the new and improved operating strategy distributes the work load evenly among all the elevator cars, according to a relatively simple program which operates effectively within the speed and memory restrictions of a microprocessor.

More specifically, the new and improved elevator system and supervisory system control includes means for dividing successive like intervals of time into a plurality of equal time intervals or time slots termed scan slots, with each floor of a building to be served being assigned to a different scan slot. Assignments are made for floors on the basis of service direction therefrom, and thus while each floor has only one scan or timing slot assigned thereto, if it can be served from both the up and down directions it will be referred to as having two scan slots, one for the up direction and one for the down direction, and each scan slot may be assigned to a different car. Thus, when a specific scan slot is assigned to a car by the supervisory system control, the car is able to see a hall call from the floor associated with that scan slot, for the service direction from that floor associated with that scan slot. Assignments of scan slots are made to the various elevator cars by not generating an inhibit signal for the assigned scan slot. Failure of the supervisory system control to provide inhibit signals will not disable the elevator cars, as each car will see hall calls according to its car control strategy, and will thus continue to operate under individual car control, without group supervisory control, until the supervisory system control again functions to provide inhibit signals.

Read-only-memories in each car control are set to provide binary signals for the supervisory system control indicating which floors, and service directions therefrom, such elevator car is enabled to serve hall calls from. The supervisory system control utilizes these signals to divide the floors and service directions therefrom, i.e., scan slots, into sets, with each set being served by the same combination of cars. With a four car bank, 16 different sets are possible, i.e., those scan slots served by one car, those served by any combination of two or three cars, those served by all four cars, and those served by no cars. The scan slots which are not served by any car are an invalid set. If all cars are enabled for all floors and all service directions, there could be but one set. Once the sets are defined, they are undisturbed until a car provides a signal which indicates that it is going into or out of service, at which time the sets are redefined.

The supervisory system control includes storge means for storing the binary signals relative to which cars are enabled to serve the floors, and service directions therefrom. The binary signals form a binary word for each floor, and service directions therefrom. The binary words are utilized as the set numbers, and also as the address for storing information relative to these set numbers in addressable storage means.

Each time the sets are redefined, the supervisory system control determines the average number of scan slots $A_{SB}$ in the building per in-service elevator car. The central processor also determines the average number of scan slots $A_{SI}$ within each set per in-service elevator car capable of serving the set. These averages are stored until the sets are redefined.

The supervisory system control intermittently, and at a relatively rapid rate, reads hall calls and car status information and makes assignments of scan slots to the cars.

If a set is served by only one in-service car, the scan slots of the set are automatically assigned to that car, with the number of scan slots and number of hall calls in those scan slots being tabulated. Each scan slot is assigned to only one car, and the assigned scan slots are marked to indicate that they have been assigned.

In order to assign scan slots associated with floors served by more than one elevator car, the supervisory system control determines the average $A_{CB}$ of registered up and down hall calls in the building per in-service elevator car, and it determines the average number of hall calls per inservice car for each set ($A_{CI}$), and it assigns a scan direction to each elevator car.

In preparation for the updating of the scan slot assignments, the previous assignment table for each car is cleared of all scan slot assignments except those scan slots served by only one car, and those scan slots having registered hall calls. The unassigned scan slots are then assigned in three assignment passes for each set, with the sets being handled in the order of increasing number of cars associated with each set.

On the first assignment pass the up and down scan slots associated with the floor at which an in-service idle car is parked, are assigned to that car. If the main floor and/or convention floor features are active, the car designated as the next car to leave the main floor is given the main floor up scan slot assignment, and a car with an assignment for the convention floor is given the up and down scan slots associated with the convention floor. Also, each scan slot is examined to see if a car has a car call for the floor associated therewith If so, a car set for up travel is assigned the up scan slot for this floor if it is not already assigned, and is not a terminal floor for this car. If it is a terminal floor it would be assigned the down scan slot for this floor. If the car is set for down travel it would be assigned the down scan slot for this floor if it is not already assigned, and is not a terminal floor for this car. If it is a terminal floor it would be assigned the up scan slot for this car. These assignments are made within the restrictions of the averages $A_{SB}$, $A_{SI}$, $A_{CB}$ and $A_{CI}$.

On the second assignment pass, the scan slots of a set not already assigned, are assigned to the cars. When the number which have been assigned to a car reaches $A_{SI}$ scan slots within the set, the assignment of scan slots to this car is terminated. If the total number of scan slots assigned to a car reaches $A_{SB}$ scan slots before reaching $A_{Si}$, the assignment of scan slots to this car is terminated at this point. If the number of registered up and down hall calls associated with scan slots assigned to a car from the set reaches $A_{CI}$ for the set, or the total number of registered hall calls assigned to a car reaches $A_{CB}$, which ever occurs first, this car will be assigned scan slots which have no hall calls associated therewith until $A_{SI}$ or $A_{SB}$ is reached, depending upon which occurs first.

A third assignment pass is also made in order to assign any unassigned scan slots which might remain after the second assignment pass. Any remaining unassigned scan slots are assigned to the cars, but this time only the average $A_{CB}$ is applied. Thus, on the third pass, the scan slot assignments may exceed the averages $A_{SB}$, $A_{SI}$ and $A_{CI}$.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIGS. 10 through 23 are detailed flow charts of subprograms which may be used to perform the various functions shown in block form in the flow chart of FIG. 9;

FIG. 24 is a graph which illustrates the assignment of scan slots to cars for a specific example, according to the teachings of the invention.

DESCRIPTION OF PREFERRED EMBODIMENTS

FIG. 1

Figure 1:
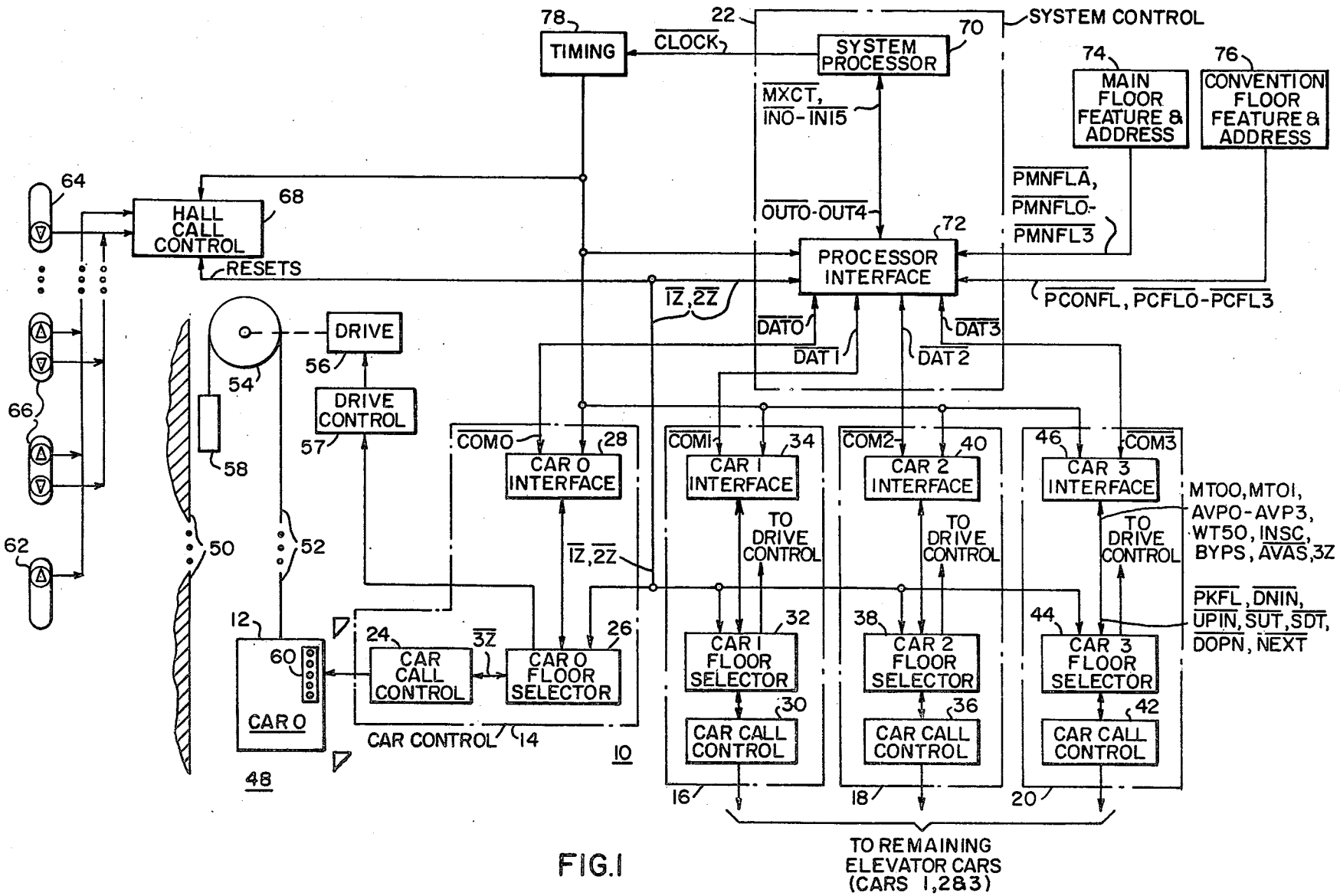
FIG. 1 is a partially schematic and partially block diagram of an elevator system, including supervisory system control, which may utilize the teachings of the invention.

Referring now to the drawings, and FIG. 1 in particular, there is shown an elevator system 10 which may utilize the teachings of the invention. Elevator system 10 includes a bank of elevator cars, with the controls 14, 16, 18 and 20 for four cars being illustrated for purposes of example. Only a single car 12 is illustrated, associated with car control 14, in order to simplify the drawing, since the remaining cars would be similar. Each car control includes a car call control function, a floor selector function, and an interface function for interfacing with supervisory system control 22. The supervisory system control 22 control the operating strategy of the elevator system as the elevator cars go about the business of answering hall calls.

More specifically, car control 14 includes car call control 24, a floor selector 26, and an interface circuit 28. Car control 16 includes car call control 30, a floor selector 32, and an interface circuit 34. Car control 18 includes car call control 36, a floor selector 38, and an interface circuit 40. Car control 20 includes car call control 42, a floor selector 44, and an interface circuit 46. Since each of the cars of the bank of cars and their controls are similar in construction and operation, only the controls for car 12 will be described in detail.

Car 12 is mounted in a hatchway 48 for movement relative to a building 50 having a plurality of floors or landings, with only a few landings being illustrated in order to simplify the drawing. The car 12 is supported by a rope 52 which is reeved over a traction sheave 54 mounted on the shaft of a suitable drive motor 56. Drive motor 56 is controlled by drive control 57. A counterweight 58 is connected to the other end of the rope 52.

Car calls, as registered by pushbutton array 60 mounted in the car 12, are recorded and seralized in the car call control 24, and the resulting serialized car call information is directed to the floor selector 26.

Hall calls, as registered by pushbuttons mounted in the halls, such as the up pushbutton 62 located at the bottom landing, the down pushbutton 64 located at the uppermost landing, and the up and down pushbuttons 66 located at the intermediate landings, are recorded and serialized in hall call control 68. The resulting serialized hall call information is directed to the floor selectors of all of the elevator cars, as well as to the supervisory system control 22.

The floor selector 26 keeps track of the car 12 and the calls for service for the car, and provides signals for the drive control 57. The floor selector 26 also provides signals for controlling such auxiliary devices as the door operator and hall lanterns, and it controls the resetting of the car call and hall call controls when a car or hall call has been serviced.

The present invention relates to new and improved group supervisory control for controlling a plurality of elevator cars as they go about the tank of answering calls for elevator service, and any suitable floor selector may be used. For purposes of example, it will be assumed that the floor selector disclosed in U.S. Pat. No. 3,750,850, issued Aug. 7, 1973, will be used, which patent is assigned to the same assignee as the present application. This patent describes a floor selector for operating a single car, without regard to operation of the car in a bank of cars. U.S. Pat. No. 3,804,209, issued Apr. 16, 1974, discloses modifications to the floor selector of U.S. Pat. No. 3,750,850 to adapt it for control by a programmable system processor. In order to avoid duplication and limit the complexity of the present application, these patents, which are assigned to the same assignee as the present application, are hereby incorporated into this application by reference.

The supervisory system control 22 includes a processing function 70 and an interface function 72. The processing function 70 receives car status signals from each of the car controllers, via the interface function 72, as well as the up and down hall calls, and provides assignment words for each car controller, which cause the elevator cars to serve the calls for elevator service according to a predetermined strategy. The car status signals provide information for the processing function 70 relative to what each car can do in the way of serving the various floors, and the processing function 70 makes assignments based on this car supplied information.

Main floor and convention floor features, shown generally at 74 and 76, respectively, may be activated to provide special optional strategies, as will be hereinafter explained.

The supervisory system control 22 provides a timing signal $\overline{\text{CLOCK}}$ for synchronizing a system timing function 78. The system timing function 78 provides timing signals for controlling the flow of data between the various functions of the elevator system.

FIG. 2

Figure 2:
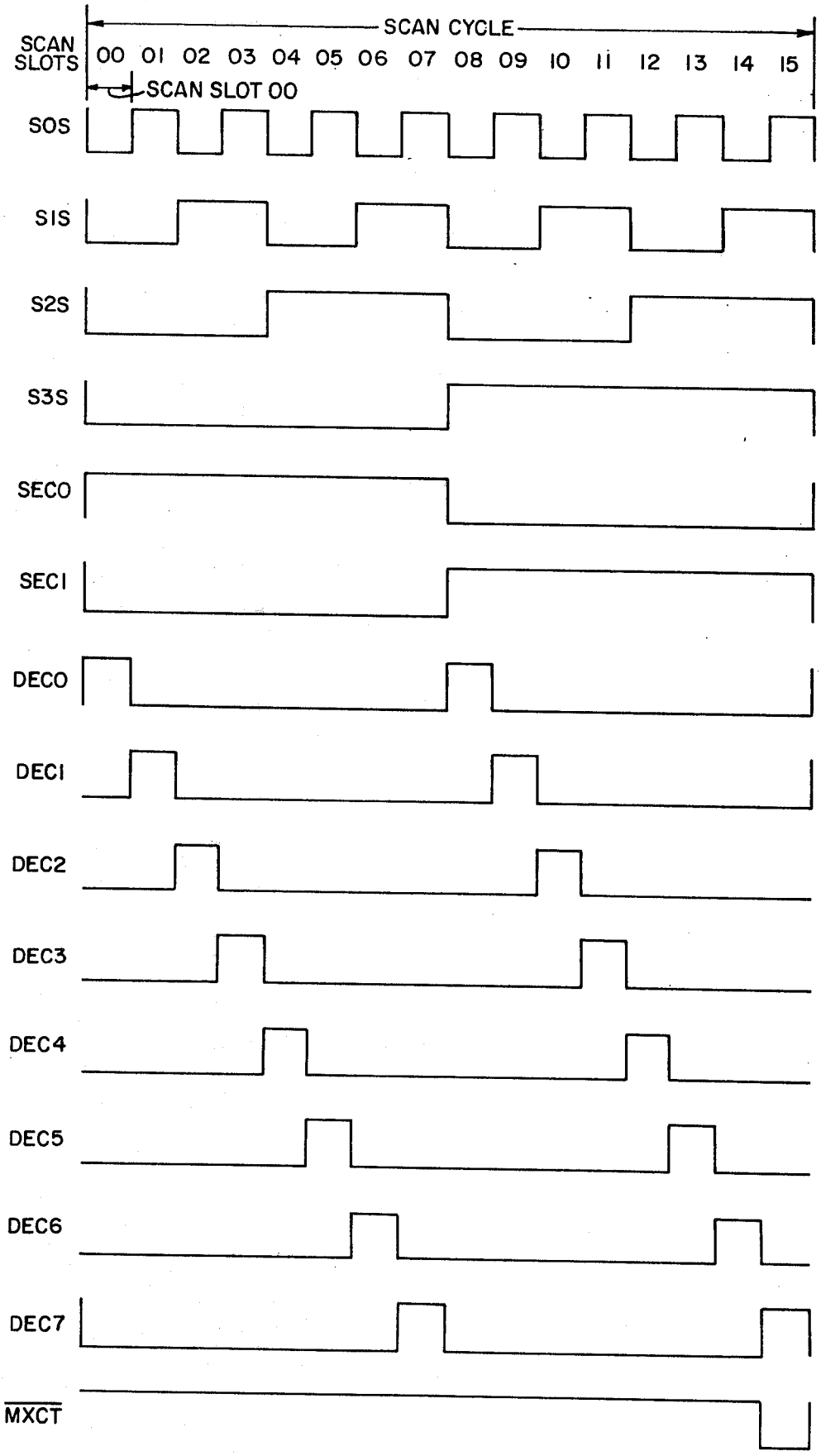
FIG. 2 is a timing diagram which illustrates the timing signals generated for one complete cycle of scan slots.

FIG. 2 illustrates certain timing signals provided by the timing function 78, with the timing signals in FIG. 2 relating to a complete scan cycle. The elevator system 10 is basically a serial, time multiplexed system, and as such precise timing must be generated in order to present data in the proper timed relationship. Each floor of the building to be serviced is assigned its own time or scan slot in each time cycle, and thus the number of time slots in a cycle is dictated by the number of floors in the associated building. Each floor has a different timing scan slot associated therewith, but it is not necessary that every scan slot be assigned to a floor level. Scan slots are generated in cycles of 16, 32, 64 or 128, so the specific cycle is selected such that there will be at least as many scan slots available as there are floor levels. For purposes of examle, it will be assumed that there are 16 floors in the building described herein, so the cycle with 16 scan slots will be sufficient.

The 16 scan slot cycle is generated by a binary counter having outputs S0S, S1S, S2S and S3S, as illustrated in FIG. 2. The binary address of scan slot 00 is 0000, responsive to S3S, S2S, S1S and S0S, respectively, the binary address of scan slot 01 is 0001, etc.

The scan slot cycle is divided into two equal parts ie., 8 scan slots each, by timing signals SEC0 and SEC1. Signal SEC0 is true for the first one-half of the scan cycle, while signal SEC1 is true for the last one-half of the scan cycle. Timing signals DECO–DEC7 are each true for a different scan slot during each one-half scan cycle, with the true scan slots being separated by seven scan slots. Thus, any one of the 16 scan slots may be selected by logically combining one of the signals DECO–DEC7 with one of the signals SECO or SEC1. Timing signal $\overline{\text{MXCT}}$, for example, is true only during the last scan slot, ie., scan slog 15, during each scan cycle, and is produced by the logical combination of signals DEC7 and SEC1.

FIG. 3

Figure 3:
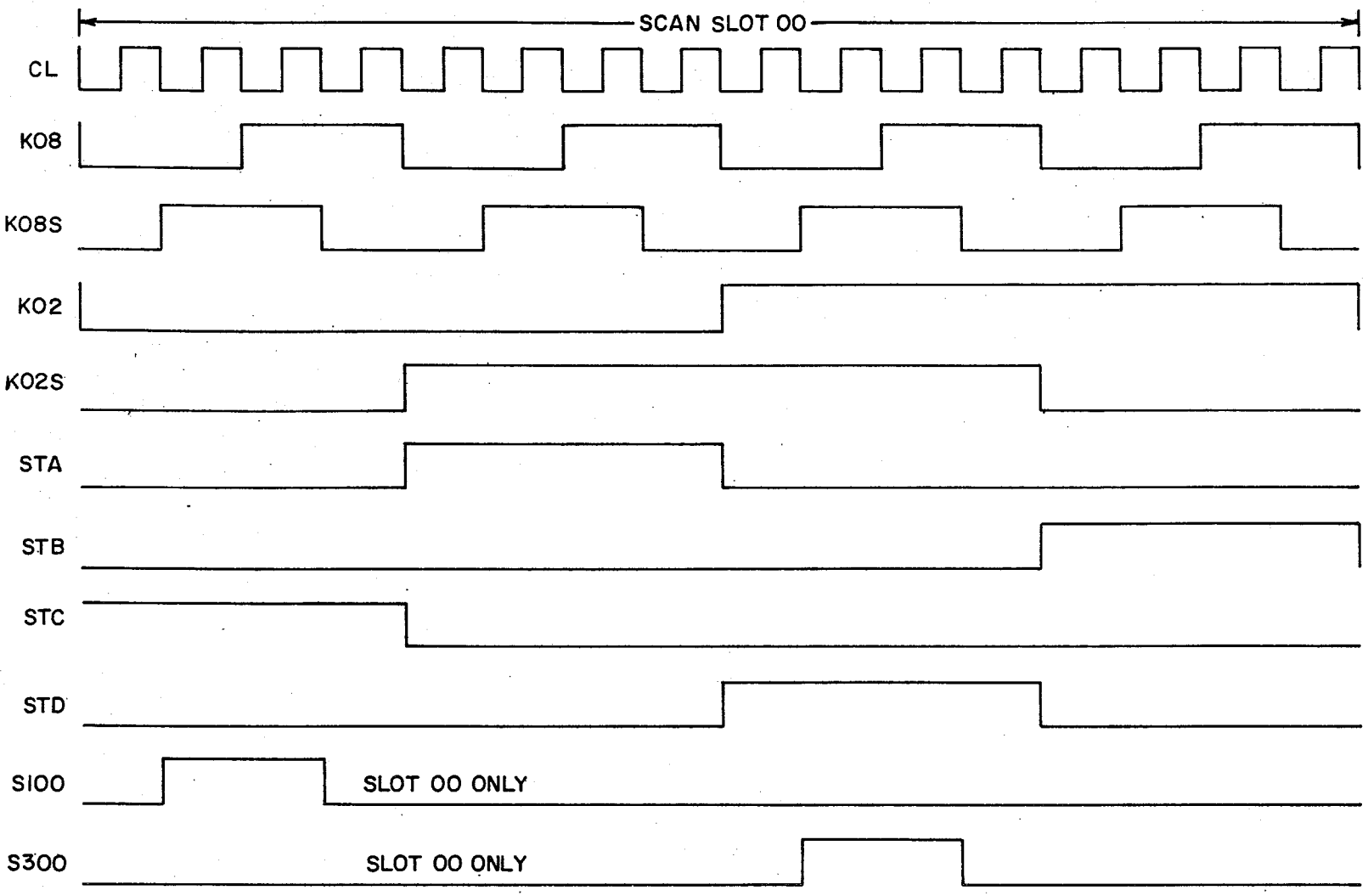
FIG. 3 is a timing diagram which illustates the timing signals associated with a single scan slot.

FIG. 3 illustrates timing signals, also provided by timing function 78, with the timing signals of FIG. 3 relating to those associated with a scan slot. The timing signals of FIG. 3 are generated during each scan slot, with the exception of signals S100 and S300, which only occur during scan slot 00.

The basic clock CL is used to derive a signal K08 which divides the scan slot into 8 equal parts, and signal K08 is shifted forward by 90° to provide K08S. Signal K02 divides the scan slot into two equal parts, and signal K02 is shifted forward by 90° to provide K02S. Strobe signals STA, STB, STC and STD are each true for a different quarter of a scan slot, ie., the second, fourth, first and the third quarters, respectively. Signals S100 and S300 occur during central portions of the first and third quarters, respectively, of scan slot 00.

In describing the elevator system 10 shown in FIG. 1 in more detail it will be helpful to set forth the various signals and their functions which will be hereinafter referred to, as well as symbols used as program identifiers and program variables in the flow charts.

| SYMBOL | FUNCTION |
|---|---|
| ACCU | Accumulator register in CPU |
| $A_{CB}$ | Average number of calls in the building per in-srvice elevator car |
| $A_{CI}$ | Average number of calls in a set per in-service elevator car |
| $A_{SB}$ | Average number of scan slots in the building per in-service car |
| $A_{SI}$ | Average number of scan slots in a set per in-service car enabled to serve the set |
| AVAS | Car is available according to the floor selector |
| AVP0-AVP3 | Advanced car floor position in binary |
| BYPS | True when the car is by-passing hall calls |
| CALL | True when a car has car call or hall call in an assigned scan slot |
| $\overline{\text{CLOCK}}$ | Timing signal initiated by the system processor |
| CM-RAM 1 | Command control line from CPU to up to 4 RAMS |
| CM-RAM 2 | Command control line from CPU to up to 4 RAMS |
| CM-ROM | Command control line from CPU to up to 16 ROMS |
| $\overline{\text{COMO-COM3}}$ | Serial control signals from system processor interface to 4 elevator cars |
| CONV | True when a car has a convention floor assignment |
| CY | Carry link flip-flop in CPU |
| DAT0-DAT3 | Serial signal from 4 elevator cars to system processor interface |
| DNAC | Actual number of cars set for down travel |
| DNDES | Desired number of cars set for down travel |
| DNIN | Down hall call inhibit, true when a car is inhibited from answering a down hall call at the associated floor |
| $\overline{\text{DOPN}}$ | Command from system processor to open car doors |
| D0-D3 | 4-bit data bus in system processor |
| D89T | True when motor generator set is shut down |
| FEN | Floor enable--true for floors car is enabled to see hall calls in at least one service direction |
| HRT | Half of a round trip |
| IDLE | True when car is in-service, not NEXT, and available according to floor selector |
| INSC | True when the car is in-service with the system processor |
| INSV | True when the car is in-service with the system processor and is not bypassing hall calls |
| $\overline{\text{IN0-IN15}}$ | 16 inputs to the system processor |
| MDCL | A door signal which is true when the doors are closed |
| MT00 | Memory track signals which is true for floors |

-continued

| SYMBOL | FUNCTION |
|---|---|
| | for which car is enabled to see up hall calls |
| MT01 | Memory track signal which is true for floors car is enabled to see down hall calls |
| $\overline{MXCT}$ | Timing signal which is true during the last scan slot of the scan cycle |
| $N_{HCI}$ | Number of hall calls assigned to a car from a 1 car set |
| $N_{HCT}$ | Total number of hall calls assigned to car so far |
| $N_{CI}$ | Number of hall calls assigned to a car so far in the set being considered |
| $N_{CP}$ | A counter whch is initialized to a count responsive to the position of the car |
| $N_{DIST}$ | Number of valid scan slots from the car so far in the assignment routine (used to determine when the half round trip limitation is met) |
| $\overline{NEXT}$ | Signal from system processor which is true when a car is designated as the next car to leave the main floor |
| $N_{POS}$ | The scan slot number which corresponds to the position of the car |
| $N_{RCC}$ | Number of registered hall calls assigned to a car in a set served by more than one car |
| $N_{SC}$ | Number of cars in-service in the bank |
| $N_{SCI}$ | Number of cars enabled to serve a set |
| $N_{SCF}$ | Number of cars enabled to serve the convention floor |
| $N_{SI}$ | Number of scan slots assigned to a car so far in the set being considered |
| $N_{SMF}$ | Number of cars which can serve the main floor |
| $N_{SS}$ | Total number of scan slots assigned to car so far |
| $\overline{OUT0}$-$\overline{OUT4}$ | Serial signals from system processor to system processor interface |
| $\overline{PCONFL}$ | A signal which is true when the convention floor feature is activated |
| $\overline{PCFI0}$-$\overline{PCFL3}$ | The binary address of the convention floor |
| $\overline{PKFL}$ | Parking signal from the system processor |
| PMNFL | A signal which is true when the main floor feature is activated |
| $\overline{PMNF0}$-$\overline{PMNFL3}$ | The binary address of the main floor |
| $Q_{MNF}$ | Quota of cars to be maintained at the main floor |
| RAM | Random access memory |
| RES | Reset signal used to start up the supervisory system control |
| $\overline{ROM}$ | Read only memory |
| SDT | A command from the system processor to set the floor selector for down travel |
| $\overline{SUT}$ | A command from the system processor to set the floor selector for up travel |
| SYNC | Synchronizing signal generated by the system processor at the start of an instruction cycle |
| UPAC | Actual number of cars set for up travel |
| UPDES | Desired number of cars set for up travel |
| UPIN | The up call inhibit signal from the system processor |
| UPSCAN | Scanning direction for assigning a scan slots to a car, 1 = UP 0 = DOWN |
| WT50 | Indicates car load, 1 = greater than 50% 0 = less than 50% |
| 1Z | Serial up hall calls |
| 2Z | Serial down hall calls |
| 3Z | Serial car calls |
| 01 | Phase 1 of two non-overlapping clocks in the system processor |
| 02 | Phase 2 of two non-overlapping clocks in the system processor |

FIG. 4

Figure 4:
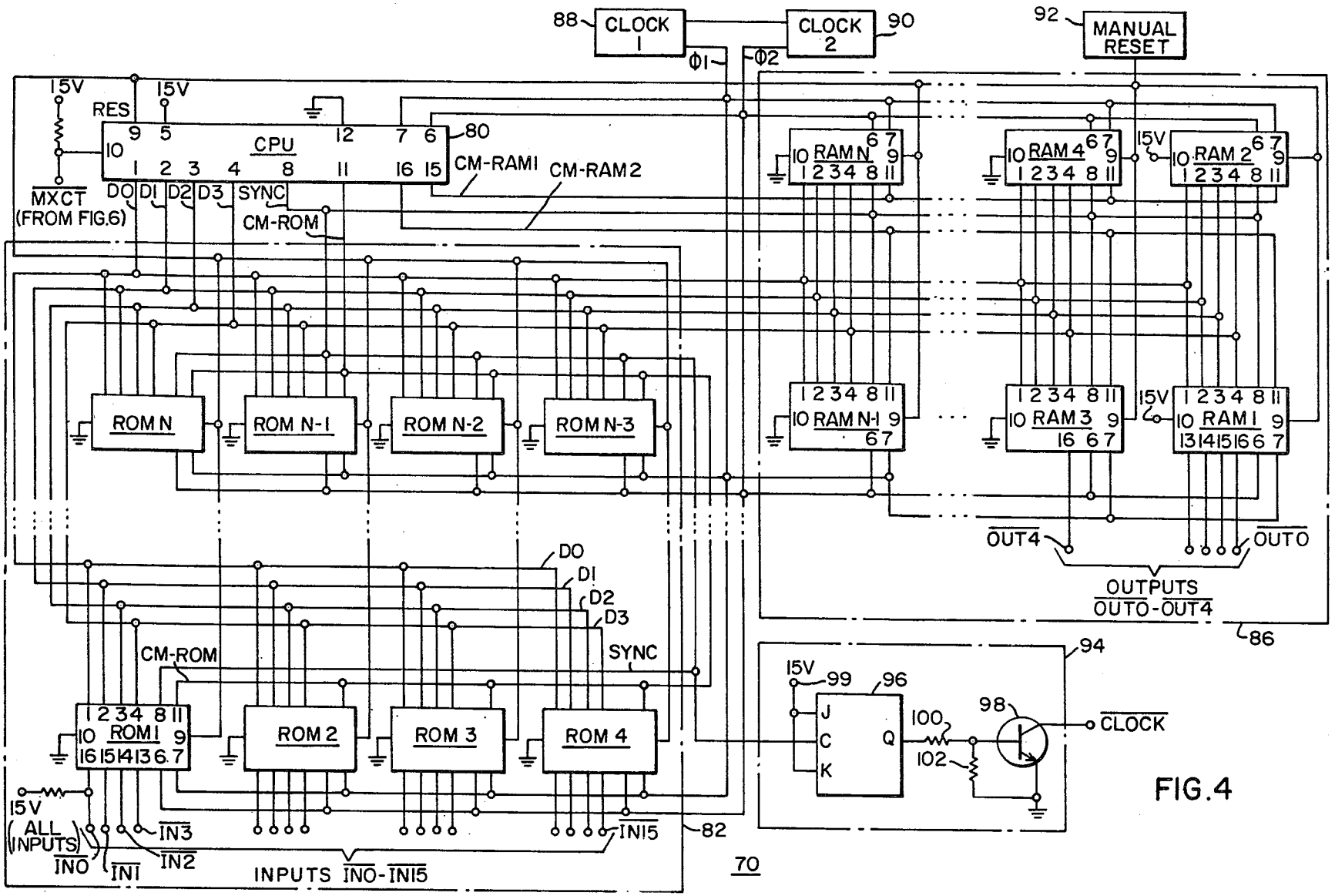
FIG. 4 is a schematic diagram of a system processor, including a central processing unit and companion ROMS and RAMS, which may be used for the system processor shown in block form in FIG. 1.

FIG. 4 is a schematic diagram of a system processor 70 which may be used for the processing function 70 of the supervisory system control 22 shown in block form in FIG. 1. Any suitable microprocessor may be used for the system processor 70, such as one of the hereinbefore mentioned microprocessors. For purposes of example, Intel Corporations' MSC-4 micro computer set will be described.

More specifically, the MCS-4 microprocessor includes a 4-bit parallel control and arithmetic unit 80 (Intel's 4004), hereinafter referred to as CPU 80, a control memory 82 which includes a plurality of programmable read only memories (ROMS) such as ROM 1 through ROM N (Intel's 4001), a data storage memory 86 which includes a plurality of random access memories (RAMS), such as RAM 1 through RAM N (Intel's 4002), clocks 88 and 90 which generate the basic system timing (750 KHZ) in the form of two non-overlapping clock phases $\phi$1 and $\phi$2, a manual reset 92, and a clock 94 which provides timing signals $\overline{CLOCK}$ for external devices responsive to the timing produced by CPU 80.

CPU 80 communicates with the control memory 82 and the data storage memory 86 via a four line data bus D0, D1, D2 and D3, and with the peripheral portion of the elevator system through input and output ports in the control and data memories 82 and 86, respectively. CPU 80 includes a control line for each set of four RAMS, such as control lines CM-RAM 1 and CM-RAM 2, and a control line CM-ROM which is used to control a bank of up to 16 ROMS. CPU 80 is connected to clocks 88 and 90, and respective thereto, ie., every 8 clock periods, issues a synchronizing signal SYNC. Signal SYNC is sent to the control and data memories 82 and 86, and to clock 94, to indicate the start of a 10.8 microsecond instruction cycle.

CPU 80 is connected to the manual reset 92, and it has a test pin connected to receive signal $\overline{MXCT}$. Signal $\overline{MXCT}$ is generated in the apparatus shown in FIG. 6, and, as shown in the timing diagram of FIG. 2 it is true during the last scan slot of each scan cycle.

Each of the ROMS are connected to the data bus D0, D1, D2 and D3, to the clock phases $\phi$1 and $\phi$2, to ROM control line CM-ROM, to the synchronizing line SYNC, and to the reset 92. ROMS 1, 2, 3 and 4 each have 4 inputs for receiving input information from the elevator system, with these 16 inputs being referenced $\overline{IN0}$ through $\overline{IN15}$.

Each of the RAMS are connected to the data bus D0, D1, D2 and D3, to the clock phases $\phi$1 and $\phi$2, to one of the RAM control lines CM-RAM 1 or CM-RAM 2, to the synchronizing line SYNC, and to the reset 92. RAMS 1 and 3 each have outputs for sending information to the elevator system, with these outputs being referenced $\overline{OUT0}$ through $\overline{OUT4}$.

Reset 92 is manually actuated during start-up of the elevator system. A low reset signal clears the memories and registers in CPU 80, it sets the data bus to zero, it clears static flip-flops in the control memory 82 as well as inhibiting data out, and it clears the data memory 86.

Clock 94 may include a JK flip-flop 96 and an NPN transistor 98. The J and K inputs of flip-flop 96 are connected to a unidirectional supply voltage, at terminal 99, and its clock input C is connected to the synchronizing line SYNC. Its Q output is connected to the base of transistor 98 via resistor 100. The base of transistor 98 is also connected to ground via resistor 102, its emitter is connected to ground, and its collector is connected to output terminal $\overline{CLOCK}$. Signal SYNC is low during the last subcycle (1.35 microsecond) of the 10.8 microsecond instruction cycle and the flip-flop 96 changes its output state on the positive going transition of SYNC. Thus, the signal $\overline{CLOCK}$ is a square wave, with each half cycle being one complete intruction cycle (10.8 microseconds).

CPU 80 includes an address register, an index register, a 4-bit adder, and an instruction register. The index register is a random access memory of 16 × 4 bits. The 16 4-bit locations, referenced R0–R15, may be directly addressed for computation and control, and they may also be addressed as 8 pairs of storage locations, referenced P0–P7 for addressing RAMS or ROMS, or storing data from the ROMS.

Each of the ROMS of the control memory 82 stores 256 × 8 words of program or data tables, and is provided with 4 I/O pins and control for performing input and output operations. CPU 80 sends an address to the control memory, along with a ROM number, during the first three instruction subcycles, and the selected ROM sends an instruction to CPU 80 during the next two instruction subcycles. The instruction is executed, ie., data is operated on in CPU 80, or data or address is sent to or from CPU 80, during the last three subcycles of the instruction cycle. When an I/O instruction is received from the control memory 82, data is transferred to or from the accumulator of CPU 80 on the 4 data lines connected to the control memory 82.

Each of the RAMS of the data memory 86 stores 320 bits arranged in 4 registers of twenty 4-bit characters each, 16 of which are addressable by one instruction, and 4 of which are addressable by another instruction. The 16 bits of each register form a main memory, while the 4 bits form a status character memory. The address of one of the RAMS, register and character is stored in two index registers in CPU 80 and is transferred to the selected RAM during the two subcycles of the instruction cycle when a RAM instruction is executed. When the RAM output instruction is received by CPU 80, the content of the accumulator of CPU 80 is transferred to the four RAM output lines.

FIG. 5

Figure 5:
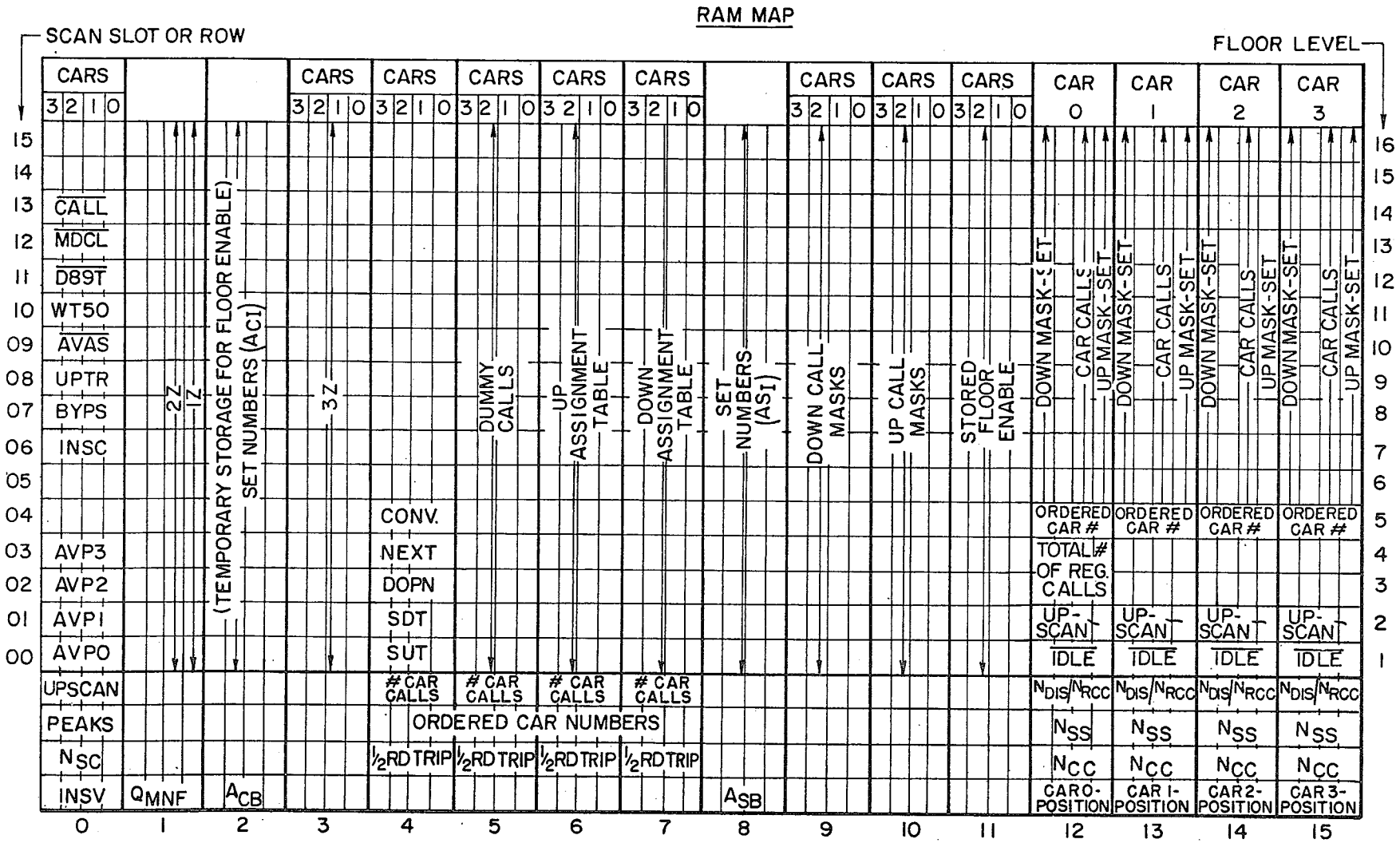
FIG. 5 is a map illustrating the format of sixteen 20-bit registers provided by the RAMS shown in FIG. 4.

FIG. 5 is a RAM map, which diagrammatically illustrates 16 of the registers, 0–15 in the data memory 86. The lower four rows form the status character memories of the registers, while the upper 16 rows, labeled 00–15 form the main memories of the registers. The specific functions of the registers will be hereinafter described as the signals and data stored therein are referred to.

Figure 6:
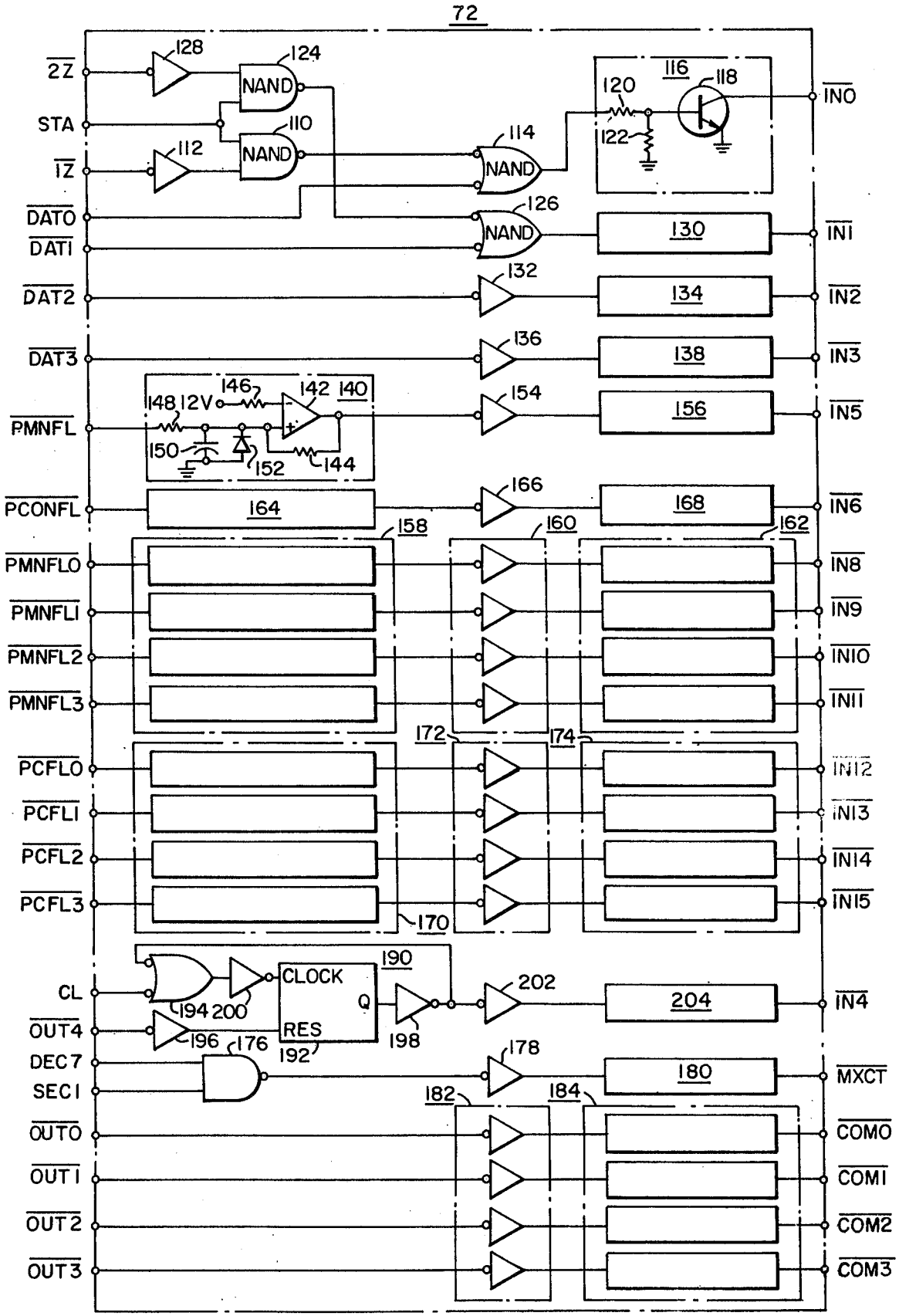
FIG. 6 is a schematic diagram of an interface circuit which may be used for the system processor interface shown in FIG. 1.
Figure 7:
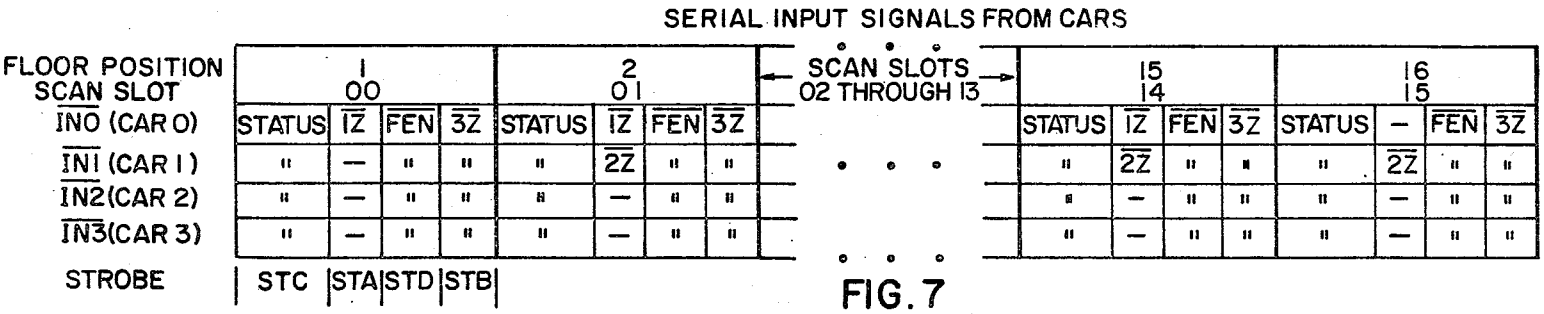
FIG. 7 is a chart illustrating the format of the serial signals from the elevator cars to the system processor, as they appear at the output of the system processor interface circuit shown in FIG. 6.

FIGS. 6 and 7

FIG. 6 is a schematic diagram of a processor interface 72 which may be used for function 72 shown in block form in FIG. 1. Each of the four elevator cars sends its status signals to the system processor 70 of the supervisory system control 22, via the interface 72. The status signals from each car are serialized by multiplexers, as will be hereinafter described relative to FIG. 8B, with these serial signals from elevator cars 0, 1, 2 and 3 being indicated by symbols $\overline{DAT0}$, $\overline{DAT1}$, $\overline{DAT2}$, and $\overline{DAT3}$, respectively.

The up and down hall calls are each serialized in the hall call control 68 shown in FIG. 1, with the serial up and down hall calls being referred to as $\overline{1Z}$ and $\overline{2Z}$, respectively. The serial signals $\overline{DAT0}$, $\overline{DAT1}$, $\overline{DAT2}$, $\overline{DAT3}$, $\overline{1Z}$ and $\overline{2Z}$ are all applied to interface 72. The up hall calls $\overline{1Z}$ and the down hall calls $\overline{2Z}$ are combined with the status signals $\overline{DAT0}$ and $\overline{DAT1}$, respectively, in interface 72. This is accomplished by dividing each of the scan slots 00 through 15 shown in FIG. 2 into 4 parts, using the strobes STC, STA, STD and STB shown in FIG. 3.

FIG. 7 illustrates the format of the signals from the interface 72 to the system processor 70, diagrammatically illustrating how each scan slot is divided into quarters by the strobe signals. Status signal from the cars appear in the first quarter of a scan slot, as strobed by STC. Up hall calls appear in the second quarter of the scan slots of the serial signal $\overline{IN0}$ from car 0, as strobed by STA. Down hall calls appear in the second quarter of the scan slots of the serial signal $\overline{IN1}$ from car 1, also strobed by STA. The second quarter of the scan slots relative to the serial signal from cars 2 and 3 are not used. The hall calls in serial signals $\overline{1Z}$ and $\overline{2Z}$ appear in the scan slot associated with the floors the calls are registered from.

The third quarter of each scan slot, strobed by STD, includes the floor enable signal $\overline{FEN}$. If the car is enabled to serve a floor, signal $\overline{FEN}$ will be true during the scan slot associated with this floor.

The fourth quarter of each scan slot, strobed by STB, includes the car calls $\overline{3Z}$. If a car has a car call for a specific floor, it will be indicated in the fourth quarter of the scan slot associated with this floor.

Referring again to FIG. 6, the serial signals appearing in signal $\overline{IZ}$ are synchronized with strobe STA in a dual input NAND gate 110, with strobe STA connected to one input of the NAND gate, and signal $\overline{IZ}$ connected to the other input via an inverter or NOT gate 112. The serial up calls $\overline{IZ}$ are introduced into serial signal $\overline{DATO}$ from car O in a dual input NAND gate 114, with the output of NAND gate 110 being connected to one input of NAND gate 114 and signal $\overline{DATO}$ connected the other input. The output of NAND gate 114 is connected to output terminal $\overline{INO}$ via an inverting buffer 116. Buffer 116 may include an NPN transistor 118, and resistors 120 and 122. The output of NAND gate 114 is connected to the base of transistor 118 via resistor 120, and the base is connected to ground via resistor 122. The collector electrode is connected to output terminal $\overline{INO}$, and the emitter electrode is connected to ground.

Signal $\overline{DATO}$ will be high during the second quarter of each scan slot, enabling NAND gate 114. A serial UP call for a scan slot appearing in signal $\overline{IZ}$ will drive the output of NAND gate 110 low during the time of STA and the output of NAND gate 114 will be driven high during each second quarter of a scan slot having a up call present. The high output of NAND gate 114 switches transistor 118 to its conductive state and output terminal $\overline{INO}$ is connected to ground. If there is no up hall call during a scan slot, the output of NAND gate 110 will be high and the output of NAND gate 114 will be low. Thus, transistor 118 will be in its non-conductive state and output terminal $\overline{INO}$ will be at +15 volts, as shown in FIG. 4. During the first, third and fourth cycles, strobe STA will be low and the output of NAND gate 110 will be high, enabling NAND gate 114 to pass true signals during these three quarters of a scan slot, which signals appear in signal $\overline{DATO}$.

In like manner, the down hall calls appearing in serial signal $\overline{2Z}$ are inserted into the second quarter of the scan slots they are associated with, using dual input NAND gates 124 and 126, inverter 128 and buffer 130. Strobe STA is connected to one input of NAND gate 124, and signal $\overline{2Z}$ is connected to the other input, via inverter 128. The output of NAND gate 124 is connected to one input of NAND gate 126, and the serial signal $\overline{DAT1}$ from car 1 is connected to the other input. The output of NAND gate 126 is connected to output terminal $\overline{IN1}$ via buffer 130. Buffer 130 is similar to buffer 116, as are the remaining output buffers in FIG. 6, and hence they are shown in block form.

The serial signal $\overline{DAT2}$ from car 2 is connected to output terminal $\overline{IN2}$ via an inverter 132 and an output buffer 134, and the serial signal $\overline{DAT3}$ is connected to output terminal $\overline{IN3}$ via an inverter 136 and an output buffer 138.

The elevator system 10 may be operated with or without a floor designated as the main floor, with the main floor feature being illustrated by block 74 in FIG. 1. Further, when it is operated with a main floor, any floor of the building may be selected as the main floor by means of a main floor binary number. If the elevator system is operating with a main floor, a predetermined quota is selected which indicates the desired number of cars to be maintained at the main floor, and this quota may be modified automatically by existing traffic conditions. For example, in a 4-car system the main floor quota may be selected to be one, which is modified to two during an up peak condition, and to zero during a down peak condition.

An up peak condition may be detected by a car leaving the main floor in the up direction with a predetermined load, and if the system is not on down peak, this occurrence starts a timer to place the system on up peak for a predetermined period of time. Each subsequent car leaving the main floor set for up travel, set to bypass hall calls, resets the timer to its maximum count, to extend the time the system is on up peak.

A down peak condition may be detected by a car above the main floor generating a bypass signal in the down direction. This occurrence also starts the peak timer, placing the system on down peak for a predetermined time period, overriding up peak if the system should happen to also be in an up peak condition. Each subsequent car which bypasses hall calls in the down direction resets the timer to its maximum count.

The main floor feature is selected by a switch (not shown) connected to input terminal $\overline{PMNFL}$, illustrated in FIG. 6. The switch applies a relatively high voltage to input terminal $\overline{PMNFL}$ when the main floor feature is not desired, and a low voltage or ground level signal when the feature is desired. Input terminal $\overline{PMNFL}$ is connected to a high level input interface 140. Interface 140 may include operational amplifier 142, resistors 144, 146 and 148, a capacitor 150, and a diode 152. Resistor 144 is connected from the output of amplifier 142 to its non-inverting input. Its inverting input is connected to a positive unidirectional voltage supply, such as 12 volts, via resistor 146. Its non-inverting input is connected to input terminal $\overline{PMNFL}$ via resistor 148, to ground via capacitor 150, and to ground via diode 152. Diode 152 is poled to conduct current from ground into the non-inverting terminal. When terminal $\overline{PMNFL}$ is high, indicating the main floor feature is not desired, the voltage at input terminal $\overline{PMNFL}$ exceeds the voltage applied to the inverting input and the output of the operational amplifier 142 will be positive, i.e., at the logic one level, which is inverted by an inverter 154 to the logic zero level and applied to an output buffer 156. Buffer 156 inverts the logic zero to a logic one, and applies the logic one to output terminal $\overline{IN5}$. When signal $\overline{PMNFL}$ is true (low) the voltage applied to the inverting input exceeds that applied to the non-inverting input and the output of operational amplifier 142 goes to a logic zero level. Inverter 154 inverts this signal to a logic one, and buffer 156 inverts this to a logic zero, which is the true level for output terminal $\overline{IN5}$.

The binary address of the floor selected as the main floor is applied to input terminals $\overline{PMNFL0}$ $\overline{PMNFL1}$, $\overline{PMNFL2}$ and $\overline{PMNFL3}$. The signals applied to these input terminals are applied to output terminals $\overline{IN8}$, $\overline{IN9}$, $\overline{IN10}$ and $\overline{IN11}$, respectively, each via a high level interface, an inverter, and an output buffer, shown generally at 158, 160 and 162, respectively. The high level input interfaces shown generally at 158, as well as the remaining high level input interfaces shown in FIG. 6, are all similar to interface 140.

The elevator system 10 may be operated with or without a floor designated as a convention floor, as desired, with the convention floor feature being indicated at 76 in FIG. 1. The convention floor may be defined as any floor above the main floor at any time by a binary number. Whenever this feature is present, as initiated, for example, by a manual switch, and there is no car present at the designated floor, a dummy or false call is shown to every car until a car stops at the floor.

The convention floor feature is selected by a switch connected to an input terminal $\overline{PCONFL}$ in FIG. 6. Similar to the signal selecting the main floor feature, signal $\overline{PCONFL}$ is applied to a high level input interface 164, the output of which is inverted by inverter 166, and applied to output buffer 168. The output of buffer 168 is connected to output terminal $\overline{IN6}$.

The binary address of the floor selected as the convention floor is connected to input terminals $\overline{PCFL0}$, $\overline{PCFL1}$, $\overline{PCFL2}$ and $\overline{PCFL3}$. The signals applied to these input terminals are applied to output terminals $\overline{IN12}$, $\overline{IN13}$, $\overline{IN14}$ and $\overline{IN15}$, respectively, each via a high level input interface, an inverter, and an output buffer, shown generally at 170, 172 and 174, respectively.

The signal $\overline{MXCT}$ for CPU 80, hereinbefore referred to, is provided by connecting timing signals DEC7 and SEC1 to the two inputs of a dual input NAND gate 176. Signals DEC7 and SEC1 are both high during the last scan slot, as illustrated in FIG. 2, causing the output of NAND gate 176 to be driven low during this time. The low output of NAND gate 176 is inverted to a logic one by inverter 178 and buffer 180 inverts this to a logic zero. The output of buffer 180 is connected to output terminal $\overline{MXCT}$.

Output terminals $\overline{OUT0}$, $\overline{OUT1}$, $\overline{OUT2}$ and $\overline{OUT3}$ from the data memory 86 shown in FIG. 4 intermittently provide serial data words for the elevator cars 0, 1, 2 and 3, respectively. These data words contain the inhibits and commands which cause the elevator cars to answer calls for elevator service according to the operating strategy of the system processor 70. These output terminals, along with output terminal $\overline{OUT4}$, are connected to the processor interface 72, shown in FIGS. 1 and 6. Additional output terminals from the data memory 86 would be provided for elevator systems having more than 4 cars.

Terminals $\overline{OUT0}$, $\overline{OUT1}$, $\overline{OUT2}$ and $\overline{OUT3}$ are connected to output terminals $\overline{COM0}$, $\overline{COM1}$, $\overline{COM2}$ and $\overline{COM3}$, respectively, each through an inverter and an inverting output buffer, shown generally at 182 and 184, respectively.

Output terminal $\overline{OUT4}$, is used to start an external timer 190, with input terminal $\overline{IN4}$ going low when the timer times out. Timer 190 includes a counter 192, such as RCA's CD4024 binary counter, a dual input NAND gate 194, and inverters 196, 198 and 200. Terminal $\overline{OUT4}$ is connected to the reset input RES of counter 192 via inverter 196. An input terminal CL is connected to one input of NAND gate 194, and the output of NAND gate 194 is connected to the clock input CLOCK of counter 192 via inverter 200. An output Q of the counter 192 is connected to output terminal $\overline{IN4}$ via inverter 198, an inverter 202, and an inverting buffer 204. The output Q of counter 192 is also connected to the remaining input of NAND gate 194 via inverter 198. Input terminal CL is connected to receive a timing signal CL from the timing function 78. The frequency of the signal CL and output of the counter are selected such that the output will go high at the end of the desired time interval.

When the system control wishes to start timing something it provides a low signal at output terminal $\overline{OUT4}$ which resets the timer to zeros and the high output of inverter 198 unblocks NAND gate 194. NAND gate 194 thus applies clock pulses to the clock input of counter 192 via inverter 200. Counter 192 is advanced one count on the negative going transition of each input pulse. While the counter 192 is active, the selected output terminal of counter 192 will be low, and terminal $\overline{IN4}$ will be high. When timer 190 reaches the selected count the output of counter 192 will go high, and terminal $\overline{IN4}$ will go low. When this selected count is reached, the output of inverter 198 will go low, which blocks NAND gate 194 from passing any further pulses from the CL input terminal to the clock input of the counter 192, until the system control resets the counter by driving terminal $\overline{OUT4}$ low.

FIG. 8

Each of the per car interfaces 28, 34, 40 and 46 shown in FIG. 1 are of like construction, and thus only the per car interface 28 for car 0 will be described. For convenience in describing interface 28, it is divided into the interface function shown in FIG. 8A, which function handles the flow of information from the supervisory system control 22 to the floor selector 26 and the interface function shown in FIG. 8B which handles the flow of information from the floor selector 26 to the supervisory system control.

The interface function from the supervisory system control to the floor selector of each car is critically important when using a microprocessor, as the floor selector operates in a synchronous or continuous mode, ie., requires continuous control signals from the supervisory system control, while the microprocessor operates in an asynchronous or batch type mode with limited memory capacity and operating speed. The microprocessor prepares the data words for each of the elevator cars, sends them to the various car controllers, and then goes about other tasks such as reading the status signals from the various cars and preparing new command words for the cars based on the latest information received from the cars.

The floor selector 26 operates in a serial mode, synchronized by the scan slots provided by timing signals SOS–S3S, and the commands from the supervisory system control 22 must appear in the proper scan slots each time the continuously counting counter SOS–S3S counts through the scan slots of the scan cycle. Failure to provide a command or inhibit signal from the supervisory system control 22 during a scan slot causes the superivisory system control to lose its overriding control and each car automatically operates on the strategy of its individual car control. The car control strategy is to answer all calls ahead of its travel direction, and when there are no further calls ahead, it will answer all calls in the opposite direction until there are no further calls in this direction. A hall call above or below an idle car sets it for the proper travel direction to answer the call.

Figure 8C:
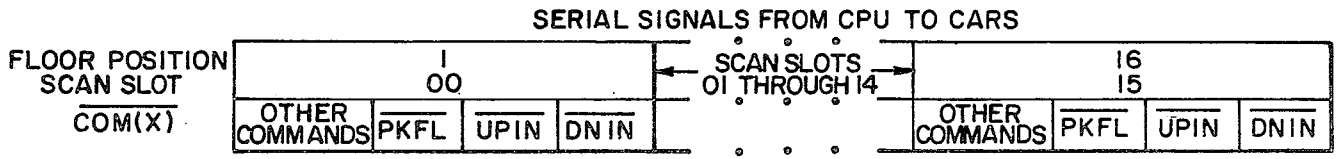
FIG. 8C is a chart illustrating the format of the serial signals from the supervisory system control to each of the elevator cars.
Figure 8A:
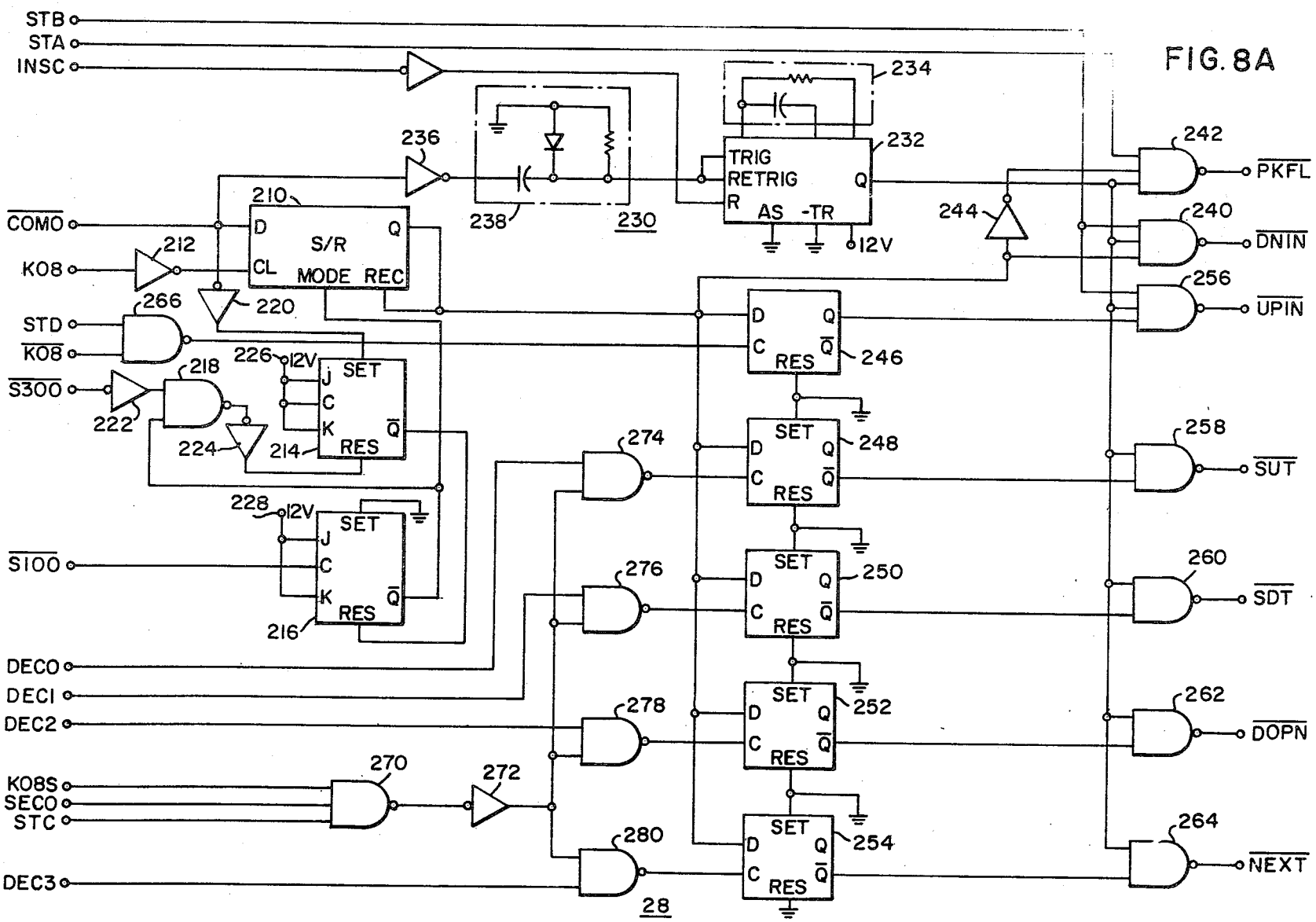
FIGS. 8A and 8B are schematic diagrams of interface circuits which may be used for each elevator car interface circuit shown in block form in FIG. 1.

The interface 28 shown in FIG. 8A solves the interfacing problem between the supervisory system control 22 and the car call control by storing the serial data word received from the supervisory system control and repetitively and serially reading out the stored data word to its associated car control means. The serial data word is stored in a constantly scanned, serially accessed memory which reads out and recirculates the data until a new data word is received. When the new data word is received the mode of the serially accessed memory is changed from the recirculation mode to allow the new data word to enter the memory. This is accomplished without a separate read line from the supervisory system control, and without interrupting the serial timed flow of commands from the serially accessed memory to the floor selector. When the new data word is completely within the serially accessed memory, the memory mode automatically switches back to the recirculation mode to retain this new word until the next data word is received.

More specifically, the serially accessed memory may be in the form of a shift register 210, such as RCA's CD4031, which has a data input D, a clock input CL, a mode input MODE, a recirculating input REG and an output Q. The serial command word $\overline{COMO}$, which is intermittently sent from the system control 22 is applied to input terminal $\overline{COMO}$, and input terminal $\overline{COMO}$ is connected to the data input D of the shift register 210. Timing signal KO8 is connected to the clock input CL of the shift register 210 via an inverter 212. As illustrated in FIG. 3, signal KO8, inverted, has a positive going transition at the start of each quarter of a scan slot. When the input terminal MODE of shift register 210 is low, the logic level at the data input D is transferred into the first stage of the shift register at each positive going transition of $\overline{KO8}$. Thus, shift register 201 is clocked four times during each scan slot, enabling 4 bits of information to be contained in each scan slot similar to the serial input signal from each car to the supervisory system control shown in FIG. 7. FIG. 8C illustrates the format of the serial signals from the supervisory system control 22 to each of the cars. The command words which are not floor related are contained in the first quarter of each scan slot. For example, the command signal $\overline{SUT}$, which requests that the floor selector of the car be set for up travel, may be sent in scan slot 00, the commond $\overline{SDT}$, which requests that the floor selector of the car be set for down travel, may be sent in scan slot 01; the command $\overline{DOPN}$ which requests a car to open its doors, may be sent in scan slot 02; and the command $\overline{NEXT}$, which notifies a car that it is to be the next car to leave the main floor, may be sent in scan slot 03.

The floor related signals $\overline{PKFL}$, $\overline{UPIN}$ and $\overline{DNIN}$ may be sent during any scan slot associated with a floor which the elevator car is enabled to serve. A true signal $\overline{PKFL}$ is sent to a car when the system control 22 gives the car a command to park at a specific floor, with the single appearing in the second quarter of the scan slot associated with the floor at which the car is to park. A true signal $\overline{UPIN}$ is sent to the floor selector of a car for those floors which the elevator car is capable of providing up service from, but which the system control wishes to block up hall calls registered therefrom from being considered by the car. In like manner, a true signal $\overline{DNIN}$ is sent to a car for those floors which the elevator car is capable of providing down service from, but which the system control wishes to block down hall calls registered therefrom from being considered by the car. Thus, to assign a down call from floor 6 to car 0, for example, the supervisory system control 22 would send true $\overline{DNIN}$ signals to cars 1, 2 and 3 in the fourth quarter of scan slot 05, which is associated with floor position 6.

When input MODE of shift register 210 is high, the recirculating input REC is enabled, and the output Q is clocked back into the shift register 210.

The system control 22 could directly control the MODE input of shift register 210, but this would require another conductor from the supervisory system control 22 to each car, as well as adding to the strategy program, increasing the demands on a memory which is of limited capacity. Further, the system processor 22 is relatively slow, and the requirement of sending a serial data word along with a separate signal which must precisely load the word into the dynamic memory without interrupting the serial output of the memory, and without losing any bits of the transmission, may be too server.

The arrangement of FIG. 8A solves the problem of precisely loading the data word from the system control 22 into the shift register 210, using only one conductor from the supervisory system control 22 to each car, and without danger of losing data bits, by using the format of the data word to control the mode control function.

More specifically, the mode control function is performed by first and second J-K flip-flops 214 and 216, respectively, such as RCA's CD4027, a dual input NAND gate 218, and inverters 220, 222 and 224. Input terminal $\overline{COMO}$ is connected to the set input of the first J-K flip-flop 214, via inverter 220. The J, C and K inputs of flip-flop 214 are connected to a source of unidirectional potential at terminal 226. Timing signal $\overline{S300}$, shown in FIG. 3, which is true only during a portion of the third quarter of scan slot 00, is connected to a input of NAND gate 218 via inverter 222. The output of NAND gate 218 is connected to the reset input of flip-flop 214 via inverter 224.

The set input of the second J-K flip-flop 216 is connected to ground. The J and K inputs of flip-flop 216 are connected to a source of unidirectional potential at terminal 228. The clock input is connected to receive timing signal $\overline{S100}$, which is true only during a portion of the first quarter of scan slot 00. The reset input of flip-flop 216 is connected to the $\overline{Q}$ output of flip-flop 214. The $\overline{Q}$ output of flip-flop 216 is connected to the remaining input of NAND gate 218, and also to the input MODE of the shift register 210.

In the operation of the mode control, it will be assumed that the $\overline{Q}$ output of flip-flop 216 is at the logic one level, which places shift register 210 in the recirculating mode. The high $\overline{Q}$ output from flip-flop 216 enables NAND gate 218, and timing signal $\overline{S300}$ resets flip-flop 214. Thus, the $\overline{Q}$ output of flip-flop 214 is maintained high, which in turn insures that the $\overline{Q}$ output of flip-flop 216 remains high to keep the shift register 210 in the recirculate mode.

When the supervisory system control 22 wishes to send a data word to the cars, it detects the negative going transition of timing signal $\overline{MXCT}$ (see FIG. 2), and sends a leading zero to each car during $\overline{MXCT}$, followed by the data word. The leading zero on the data stream is inverted to a logic one by inverter 220, setting flip-flp 214 to provide a low $\overline{Q}$ output. Flip-flop 216 now has a low signal at its reset input, which "unlocks" this flip-flop. Timing signal $\overline{S100}$, which occurs in the central portion of the first quarter of scan slot 00 triggers flip-flop 216 into its opposite state, and thus its $\overline{Q}$ output goes low enabling the data input D of shift register 210, and blocking NAND gate 218 from passing timing signal $\overline{S300}$. Clock KO8 thus clocks the flour bits of data in each of the 16 scan slots into the 64 stage shift register 210. On the positive going transition of the next timing signal $\overline{S100}$, flip-flop 216 is triggered into its opposite state, driving its $\overline{Q}$ output high. This high output enables the recirculate mode of shift register 210 before the end of the first quarter of scan slot 00, to recirculate the new data word until the next data word is received. The high $\overline{Q}$ output of flip-flop 216 also enables NAND gate 218 so the timing signal $\overline{S300}$ resets flip-flop 214, applying a logic one to the reset input of flip-flop 216 to prevent subsequent timing signals $\overline{S100}$ from triggering flip-flop 216 until the next command data word is received from the system control 22.

In order to remove each car from indefinite control by the system processor's last command word, should the system processor fail to provide further signals, and to remove each car from control by an erratic system processor which is not providing command words within a preset time interval, the command words are monitored by timing means 230. Timing means 230 may include a multivibrator 232, such as RCA's CD4047A, connected such that is Q output remains high as long as the input pulse period is shorter than the timing period determined by the RC components of timing means 234.

The input pulse which triggers the multivibrator 232, and retriggers it to keep the CL output high is the leading zero on the serial signal $\overline{COMO}$. Input terminal $\overline{COMO}$ is connected to the trigger and retrigger inputs TRIG and RETRIG, respectively of multivibrator 232 via an inverter 236 and an A.C. coupler 238. The A.C. coupler prevents multivibrator 232 from having its input stuck in the high state. The high Q output of multivibrator 232 enables command signals to be sent from the supervisory system control 22 to the cars. Should the multivibrator 232 time out before receiving a command data word, the Q output goes low to inhibit all signals from the supervisor system control 22 to the cars, and the cars when operate independently according to their individual car control strategy, with each car being enabled for all hall calls.

The serial command word from the supervisory system control 22 appearing at the Q output of shift register 210 is connected to an input of a three input NAND gate 240, to an input of a three input NAND gate 242 via an inverter 244, and to the D inputs of D-type flip-flops 246, 248, 250, 252 and 254, such as RCA's CD4013. The $\overline{Q}$ output of flip-flop 246 is connected to an input of a three input NAND gate 256. The $\overline{Q}$ outputs of flip-flops 248, 250, 252 and 254 are connected to an input of dual input NAND gates 258, 260, 262 and 264, respectively. The Q output of multivibrator 232 is connected to an input of each of the NAND gates 240, 242, 256, 258, 260, 262 and 264, enabling these gates as long as the supervisory system control 22 is operating in a timely manner.

Strobe STA, which occurs during the second quarter of each scan slot, is connected to the remaining input of NAND gate 242. The output of NAND gate 242 is connected to output terminal $\overline{PKFL}$, providing a true signal $\overline{PKFL}$ in the second quarter of those scan slots which contain a true parking command from the system control 22.

Assignments from the system control 22 are low true in serial signal $\overline{COMO}$, and since the inhibit signals $\overline{UPIN}$ and $\overline{DNIN}$ are low when a car is inhibited from seeing a hall call at the associated floor, the system control 22 makes assignments of floors to a car with high signals $\overline{UPIN}$ and $\overline{DNIN}$. Thus, a low true assignment signal in $\overline{COMO}$ must provide a high $\overline{UPIN}$ or $\overline{DNIN}$ signal.

More specifically, strobe STB, which occurs during the last quarter of each scan slot, is connected to the remaining input of NAND gate 240. The output of NAND gate 240 is connected to output terminal $\overline{DNIN}$, providing a high down inhibit signal $\overline{DNIN}$ in the last quarter of those scan slots which contain a true (low) assignment signal from the system control 22. Floors which are not assigned to the car will have a high signal in the last quarter of their associated scan slots, providing true inhibit signals $\overline{DNIN}$ for those floors.

Timing signal $\overline{KO8}$ and strobe STD are connected to the two inputs of a of a dual input NAND gate 266, and the output of NAND gate 266 is connected to the clock input C of flip-flop 246. The output of NAND gate 266 will be low for the first portion of the third quarter of each scan slot, clocking the data appearing at the D input during the positive going transition of the clock pulse to the Q output. If the up service direction from the floor associated with a scan slot is not assigned to the car associated with signal $\overline{COMO}$, the D input of flip-flop 246 will be high during the third quarter of the scan slot and the Q output of flip-flop 246 will be driven high. If the up service direction from the floor associated with a scan slot is assigned to this car, the D input of flip-flop 246 will be low during the third quarter and the Q output of flip-flop 246 will be low. Flip-flop 246 is used to store the up inhibit or assignment so it can be presented to the floor selector 26 simultaneously with down inhibit or assignment for each scan slot. Since the down assignment was strobed with strobe STB, NAND gate 256, which provides up assignments, is also strobed with STB. If the floor of the associated scan slot is not assigned to this car the Q output of flip-flop 246 will be high when the fourth quarter of the scan slot starts, to drive the output of NAND gate 256 low and provide a true up inhibit signal $\overline{UPIN}$ during the fourth quarter of the associated scan slot. If the floor of the associated scan slot is assigned to this car, the Q output of flip-flop 246 will be low at the start of the fourth quarter of the associated scan slot and the output of NAND gate 256 will be driven high, enabling the car to see an up hall call at this floor.

The remaining commands $\overline{SUT}$, $\overline{SDT}$, $\overline{DOPN}$ and $\overline{NEXT}$ from the system control 22 are not floor related and are inserted into the first quarter of scan slots 00, 01, 02 and 03, respectively. Further, once one of these commands is recieved it should persist until the command is again received one full cycle later, and not just during the scan slot in which the command was sent.

The first command, $\overline{SUT}$, which requests that the floor selector 26 be set for up travel is picked out of the first quarter of scan slot 00 by flip-flop 248 and by timing means which includes a three input NAND gate 270, an inverter 272 and a dual input NAND gate 274. Timing signals KO8S and SECO and strobe STC are applied to the three inputs of NAND gate 270. These signals will all be high during the central portions of scan slots 00 through 07 driving the output of NAND gate 270 low during this time, which low signal is converted to a high signal by inverter 272. Scan slot 00 is picked out of scan slots 00 through 07 by timing signal DECO which is high only during scan slots 00 and 08 of each scan cycle. The output of inverter 272 and timing signal DECO are applied to the two inputs of NAND gate 274, and the output of NAND gate 274 is connected to the clock input C of flip-flop 248. If the system control 22 is requesting that the floor selector 26 be set for up travel, the first quarter of scan slot 00 will be low, and thus the D input of flip-flop 248 will be low during this time. This low signal is clocked to output Q. Thus, output $\overline{Q}$, which is connected to an input of NAND gate 258, will be driven high, causing the output of NAND gate 258 to be driven low, providing a true signal $\overline{SUT}$. Since flip-flop 248 will not be clocked again until the next scan slot 00, the signal appearing at output terminal $\overline{SUT}$ will persist until the logic level in the first quarter of scan slot 00 is again examined.

The command $\overline{SDT}$ from the system control 22 requesting that the floor selector 26 be set for down travel is picked from the first quarter of scan slot 01 by a dual input NAND gate 276 having one input connected to the output of inverter 272 and an input connected to timing signal DEC1. The output of NAND gate 276 is connected to the clock input C of flip-flop 250, the $\overline{Q}$ output of flip-flop 250 is connected to an input of NAND gate 260, and the output of NAND gate 260 provides command $\overline{SDT}$.

The command $\overline{DOPN}$ from the system control 22 requesting that the doors of the car be open, is picked from the first quarter of scan slot 02 by a dual input command gate 278 having one input connected to the output of inverter 272, and an input connected to timing signal DEC2. The output of NAND gate 278 is connected to the clock input C of flip-flop 252, the $\overline{Q}$ output of flip-flop 252 is connected to an input of NAND gate 262, and the output of NAND gate 262 provides command $\overline{DOPN}$.

The command $\overline{NEXT}$ from the system control 22, designating the car as the next car to leave the main floor, is picked from the first quarter of scan slot 03 by a dual input NAND gate 280 having an input connected to the output of inverter 272 and an input connected to timing signal DEC3. The output NAND gate 280 is connected to the clock input C of flip-flop 254, the $\overline{Q}$ output of flip-flop 254 is connected to an input of NAND gate 264, and the output of NAND gate 264 provides signal $\overline{NEXT}$.

Figure 8B:
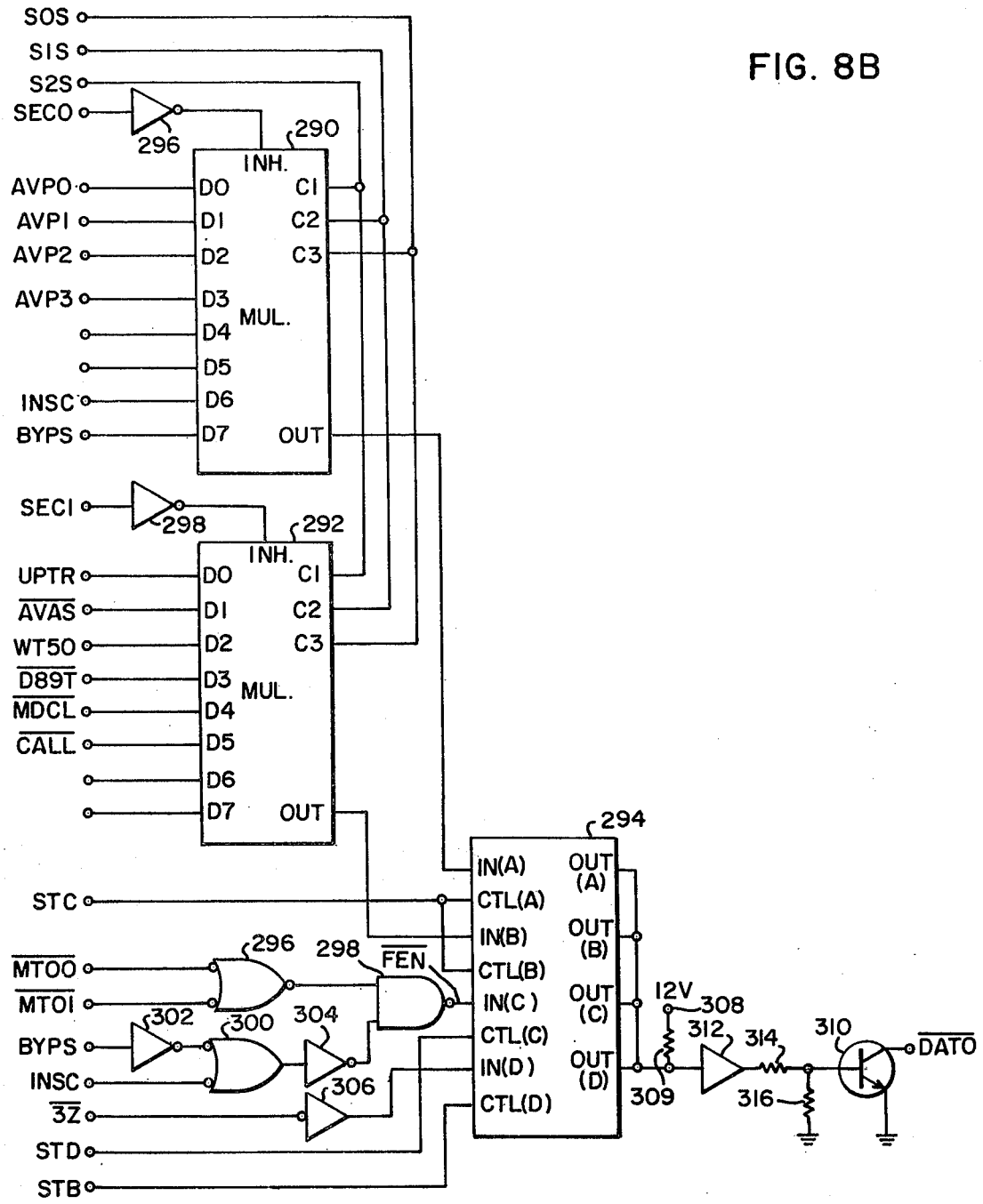

The portion of interface 28 which relates to information flow from the floor selector 26 to the system control 22 is shown in FIG. 8B. The floor selector 26 provides status signals AVPO–AVP3, INSC, BYPS, UPTR, $\overline{AVAS}$, WT50, $\overline{D89T}$, $\overline{MDCL}$, and $\overline{CALL}$, which, when received by the system control, are stored in RAM0 shown in FIG. 5. The floor enable signals $\overline{FEN}$, and car calls $\overline{3Z}$, are stored in RAM2 and RAM3, respectively shown in FIG. 5. Signals AVPO-AVP3 provide the binary address of the floor at which a stationary car is standing, and when the car is moving it provides the binary address of the closest floor at which the car could make a normal stop. Signal INSC is true when the car is in-service with the system control 22. Signal BYPS is true when the car is set to bypass hall calls. For example, when a down travelling car becomes loaded, it will bypass hall calls on its way to the main floor. Also, when a car at the main floor becomes loaded, it will bypass up hall calls. In both situations, the car will issue a true BYPS signal. Signal UPTR is high or true when the car is set for up travel, and low when the car is set for down travel. Signal $\overline{AVAS}$ is true when the car is in-service, it has answered all of its calls, and is standing at a floor with its doors closed. Thus, the NEXT car, which normally stands at the main floor with its door open and up hall lantern lit, is not considered an AVAS car. Signal WT50 is true when the weight of the load in the elevator car exceeds 50% of its rated load. Signal $\overline{D89T}$ is true when the motor generator set which provides electrical power for the elevator drive motor is shut down. Signal $\overline{MDCL}$ is true when the car doors are closed, and signal $\overline{CALL}$ is true when the elevator car has a car call registered.

System control 22 may be applied to any structure without requiring the system control to be specifically tailored to the building configuration, or to be initially designed with the knowledge of which cars are capable of serving the various floors. All of this information is applied to the system control 22 in the form of signals from the car control 14. This is an important feature which adds significantly to the universality aspect of the system control 22. Signals $\overline{MTO0}$ and $\overline{MTO1}$ are serial signals which may be provided by a read-only memory track in the car control 14, and they are true in the scan slots associated with floors which the car is enabled to serve calls for service in the up and down directions, respectively. Signal $\overline{3Z}$ is a serial, floor related signal which is true during the scan slots associated with floors for which the car has a registered car call.

Multiplexers 290 and 292, such as RCA's CD4051A, and a quad switch 294, such as RCA's CD4016AD used as a gate, are used to provide the serial signal $\overline{DAT0}$. Multiplexers 290 and 292 are used to insert the non-serial signals into scan slots, while the quad bilateral switch 294 multiplexes the serial outputs of the multiplexers 290 and 292 with the already serialized floor enable signal $\overline{FEN}$ and car call signal $\overline{3Z}$.

Multiplexer 290 is enabled for the first 8 scan slots of the 16 scan slot cycle by connected timing signal SECO to the inhibit input via an inverter 296, and multiplexer 292 is enabled for the last 8 scan slots of a scan cycle by connecting timing signal SEC1 to the inhibit input of multiplexer 292 via an inverter 298. The data inputs D0 through D7 of multiplexers 290 and 292 are connected to receive the signals to be multiplexed, and their control inputs C1, C2 and C3 are connected to the timing signals, S0S, S1S and S2S. As the binary address applied to the control inputs changes, a different one of the data inputs is connected to the output OUT. As illustrated in FIG. 8B, the advanced car position signals AVP-0–AVP3, the in-service signal INSC and the by-pass signal BYPS are connected to data inputs of multiplexer 290, and the travel direction signal UPTR, the availability signal $\overline{AVAS}$, the car load signal WT50, the motor-generator shut down signal $\overline{D89T}$, the door signal $\overline{MDCL}$, and the car call signal $\overline{CALL}$ are connected to the data inputs of multiplexer 292. The output of multiplexer 290 is connected to the input associated with switch A of the quad bilateral switch 294, and the output of multiplexer 292 is connected to the input associated with switch B of quad bilateral switch 294. The control inputs for switches A and B are connected to strobe STC, to place the status signals into the first quarter of their associated scan slots, as shown in FIG. 7.

The floor enable signals $\overline{MT00}$ and $\overline{MT01}$ are combined to provide a master floor enable signal $\overline{FEN}$, which also takes into consideration whether the car is in-service (INSC) with the system control 22, and whether or not the car is by-passing halls (BYPS). These signals are combined by NAND gates 296, 298 and 300, and inverters 302 and 304. Signals $\overline{MT00}$ and $\overline{MT01}$ are connected to the inputs of NAND gate 296 which is a dual input gate, and the output of NAND gate 296 is connected to an input of NAND gate 298, which is also a dual input NAND gate. The output of NAND gate 298, which provides signal $\overline{FEN}$, is connected to the input of quad bilateral switch 294 for switch C. Signal INSC is connected to an input of NAND gate 300, which is a dual input NAND gate, and signal BYPS is connected to the other input of NAND gate 300 via inverter 302. The output of NAND gate 300 is connected to the remaining input of NAND gate 298 via inverter 304. The output of NAND gate 298 will be low if the car is an in-service car which is not bypassing hall calls and is enabled to serve hall calls for at least one service direction from the floor associated with the scan slot being considered. Strobe STD is connected to the control input for switch C, causing the master floor enable signal $\overline{FEN}$ to be inserted into the third quarter of each scan slot.

Serial car calls $\overline{3Z}$ are connected to the data input for switch D of quad bilateral switch 294, via inverter 306, and the control input for switch D is connected to strobe STB, which inserts the car call calls into the fourth quarter of the scan slots.

The outputs of switches A, B, C and D of quad bilateral switch 294 are connected in common, and the common output connection is connected to a source of unidirectional potential at terminal 308, via a resistor 309. The common output connection is also connected to the base of an NPN transistor 310 via a non-inverting buffer 312, such as RCA's CD4050AD and a resistor 314. The base of transistor 310 is also connected to ground via a resistor 316. The emitter of transistor 310 is connected to ground, and the collector is connected to output terminal $\overline{DATO}$, which provides the serial data signal for the processor interface 72.

FIGURE 9

Figure 9:
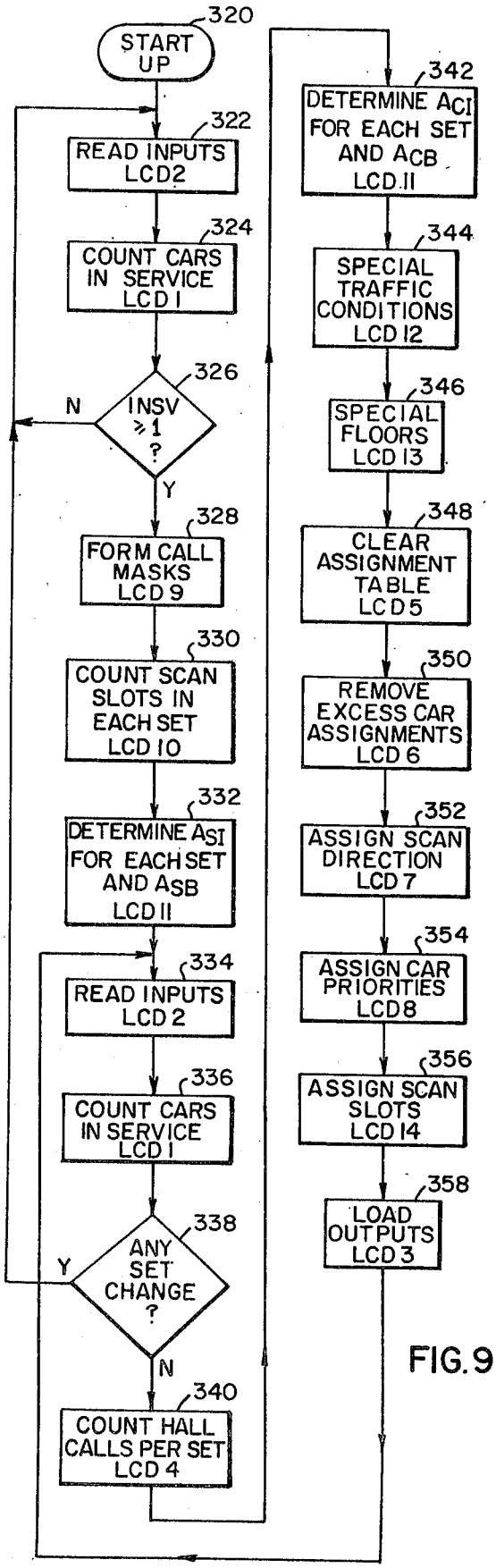
FIG. 9 is a flow chart which illustrates group supervisory strategy for controlling a plurality of elevator cars according to the teaching of the invention.

FIG. 9 is a block diagram which broadly sets forth new and improved group supervisory strategy for controlling the bank of elevator cars to answer calls for elevator service according to the teachings of the invention. The system shown in FIG. 9 outlines a program for implementing the strategy of the invention, with each of the blocks shown in FIG. 9 being fully developed in the flow charts of FIGS. 11 through 23. The flow charts of FIGS. 11 through 23 are programmers flow charts, which, when taken with the remaining figures, the specification, and a user's manual for a microprocessor, provide sufficient detail for a programmer of ordinary skill to write the necessary instructions to program the microprocessor. However, a program listing consisting of pages A1 through A53, illustrative of a specific embodiment of the invention is included in Appendix A in the file history of the application. The blocks of FIG. 9 and the program listing include LCD identification numbers which refer to sub-programs shown in the flow charts of FIGS. 11 through 23.

In general the new and improved group supervisory strategy is universal in character, enabling it to be applied without significant modification to any building. The system processor is completely dependent upon information from the various car controllers as to what each car is capable of doing. The system processor uses this information to set up the specific building configuration which presently exists, i.e., which cars are in service and which floors and service directions therefrom these in-service cars are enabled to serve. The system processor then applies its universal strategy to this configuration.

The universal strategy attempts to evenly distribute, among all in-service cars, the actual work load, as well as the work load which may arise between assignments. The distribution of this actual and possible work load is based upon certain dynamic averages calculated just prior to the making of assignments.

The assignments are primarily "hall button" oriented, rather than "hall call" oriented, at least until the hall calls "assigned" to a car because of the assignment of hall buttons meets one of the applicable dynamic averages. Each hall call button is effectively assigned a scan slot, and these scan slots are assigned to the cars according to the universal strategy. The elevator system is a serial, time multiplexed arrangement in which the scan slots for the floors are taken in turn.

The assignment of scan slots to the various cars is not made on the basis of an inflexible block of adjacent floors, normally associated with the zone concept, it is not made on the basis of a flexible block of adjacent floors normally associated with the floating zone concept between action cars, and it is not a random operation. The assignment of scan slots is built into a predetermined priority structure which includes:

1. the clearing of certain scan slot assignments before each assignment process;
2. the assignment of scan slots in a general order based upon the floors served by the same combination of cars with each such group being called a "set";
3. the assignment of the scan slots of the sets in a plurality of assignment passes, changing the limitations applied and controlling dynamic averages on each pass, with the limitations and dynamic averages including those which are set oriented, as well as building oriented;
4. the assignment of scan slots to the cars enabled for each set according to a dynamic car priority order, calculated prior to each assignment process on the basis of actual work load, as well as considering such factors as whether or not the car has the NEXT assignment, and if the motor-generator set associated with a car is shut down due to a predetermined period of inactivity;
5. the assignment of scan slots to the cars, starting from the cars in a predetermined direction, with the predetermined direction for a busy car being its travel direction and with the predetermined direction for an available car being based upon the currently existing traffic condition and the assignment directions for the busy cars;
6. the assignment of scan slots to busy cars with the limitation that the associated floors are within a predetermined travel distance from the car, as opposed to physical separation; and
7. assigning scan slots to in-service idle cars without the travel distance limitation of (6).

The description of the assignment process refers to the assignment of scan slots to the cars. The scan slots are each associated with a different hall call pushbutton, and the hall call pushbuttons are related to directions from the floors that traffic located at the floors desires to travel. Thus, the assignment of scan slots to the cars may be considered to be the assignment of landings, and service directions therefrom, to the cars, or briefly, the assignment of service directions from landings to the cars. It should be noted that the term "service direction", when applied to landings in the assignment process, refers to the direction from the floor that traffic at the floor desires to travel, and is not related to the setting of the service directions for the various elevator cars.

More specifically, start-up of the elevator system 10 shown in FIG. 1 is indicated at terminal 320. Step 322 reads the input signals $\overline{IN0}$ through $\overline{IN3}$ applied to the input port of the control memory 82 (FIG. 4) from the various cars, and stores the signals in the data storage memory 86. Step 324 counts the number of elevator cars which are in-service with the system control 22 ($N_{SC}$), and step 326 determines if there are at least two cars under the control of the system control 22. If not, there is no need for group supervisory control and the program loops back to step 322. The program remains in this loop until at least two cars are in-service with the system control 22. Without group supervisory control, the cars are enabled to see all hall calls and they will answer calls for elevator service according to the strategy built into their individual car controllers, as hereinbefore described.

If step 326 finds there are least two or more cars in-service with the system control 22, the program advances to step 328 which forms down and up call masks. The down and up call masks are stored in the main memory of RAMS 9 and 10, respectively, of the data storage memory 86. When RAMS 0–15 are referred to, it will be helpful to check the RAM number in the RAM map of FIG. 5. RAMS 9 and 10 essentially display the up and down floor enable signals MT01 and MT00, respectively, indicating, for each car, the floors and directions therefrom which may be served by the car. Thus, if the binary word of RAM 10, which corresponds to floor level 15 is 0111, for example, it would indicate that only cars 0, 1 and 2 are able to serve an up hall call from floor level 15. It will be noted that this arrangement preserves the universality of the program, making it applicable to any building configuration, as the program obtains the information as to the building configuration from the cars, and then stores the building configuration for reference until a change occurs.

Step 330 counts the scan slots in each set as well as the total number of scan slots in the building and stores these sums for future reference. Each hall call pushbutton is assigned a scan slot. Thus, in a building with 16 levels, the first and sixteenth levels would have 1 scan slot, and the intervening 14 floors or levels would each have 2 scan slots, making a total of 30 scan slots. A set refers to a group of floors served by the same combination of cars. With four cars, for example, there may be as many as 16 different sets, with the set 0000 being an invalid set. If all cars serve all floors, there would only be 1 valid set. In the average building configuration, there would usually only be a few sets, but the program will handle the maximum number of sets possible.

Step 322 determines the average number of scan slots per set, $A_{SI}$, by dividing the scan slots in each set, determined in step 330, by the number of in-service cars capable of serving the set ($N_{SCI}$). Step 332 also determines $A_{SB}$, the average number of scan slots in the building per in-service elevator car, by dividing the total number of scan slots in the building by $N_{SC}$, the number of cars in-service.

Steps 334 and 324 then repeat steps 322 and 336, respectively, reading the input port of ROM 1 of control memory 82, and counting the cars in-service. Step 338 determines if there has been a change in the building configuration since the last reading of the input port. For example, step 338 determines if the number of in-service cars has changed. If there has been a change, the program returns to step 322, as the floor enable masks and scan slot averages previously formulated may no longer be valid, and thus should be updated using the lastest building configuration.

If step 338 finds that there has been no change which invalidates $N_{SC}$, $A_{SB}$, or $A_{SI}$ for any set, the program advances to step 340. Step 340 counts the number of hall calls per set, as well as the total number of hall calls in the building, and stores these sums for future reference.

Step 342 determines the average number of registered hall calls per set, $A_{CI}$, by dividing the number of hall calls in each set by the number of in-service cars serving the set. The average number of registered hall calls per car in the building, $A_{CB}$, is determined by dividing the total number of hall calls in the building by $N_{SC}$, the number of in-service elevator cars.

Step 344 checks for special traffic conditions, such as those which initiate up peak and down peak features. If a condition is detected which initiates a peak traffic condition, step 344 implements the strategy associated with the specific peak detected.

Step 346 checks for special floor features, such as main and convention floor features. If a request for one or more special floor features is present, step 346 implements the strategy associated with the special floor features selected.

Step 348 clears the up and down assignment tables, stored in RAMS 6 and 7, respectively, of all scan slot assignments except those previously assigned scan slots which have a registered hall call associated therewith, and those scan slots from a one car set.

Step 350 removes any excess scan slot assignments. For example, if the number of calls from a one car set assigned to the car equals or exceeds the hall call per car building average $A_{CB}$, all other assignments to this car are cleared. If the calls assigned to a car from a one car set do not exceed $A_{CB}$, but all calls assigned to the car equals or exceeds $A_{CB}$, step 350 counts the scan slots assigned to the car which have a registered hall call, starting at the scan slot associated with the position of the car and proceeding in the travel direction of the car, and once the building call average per car $A_{CB}$ is met, all further scan slots assigned to this car are cleared.

Step 352 assigns the direction from an in-service idle car in which the assignment of scan slots are to be made to the car. If a car is busy, the scan direction for assigning scan slots to the car is the car's travel direction. The assigned scan directions of the busy cars are considered, along with the present traffic conditions, in deciding the scan direction to be assigned to an in-service idle car. In certain instances, hereinafter explained, it is also suitable to use the last travel direction of an in-service idle car.

Step 354 assigns the order in which the cars are to be considered when assigning scan slots to them, with the car having the fewest combined car and hall calls being considered first, etc.

Step 356 assigns the scan slots of each set to the cars, in the car order determined by step 354. The sets are considered in the order of increasing number of cars per set. The assignment of the scan slots to the cars associated with each set are made in a plurality of passes, such as three. The first assignment pass is a specific assignment pass which takes care of pre-identified situations and priorities. For example, scan slots associated with floors for which the cars have a car call are assigned to the appropriate cars; the up and down scan slots associated with a floor at which an in-service idle car is standing, are assigned to that car; if there is a car with a NEXT assignment, this car is assigned the scan slot associated with the main floor up service direction; and, if there is a car with a convention floor assignment CONV, this car is assigned both scan slots associated with the convention floor. The second pass is a general assignment which assigns scan slots to the cars of the sets subject to predetermined dynamic limiting averages and a distance limitation. A third pass may be used to try to assign any unassigned scan slots, which may remain after the first two passes. The third pass removes certain limitations used during the second pass.

Step 358 reads RAMS 4, 5, 6 and 7 to the output port of the data storage memory 86, where the information from these RAMS appears as serial output signals $\overline{OUT0}$, $\overline{OUT1}$, $\overline{OUT2}$ and $\overline{OUT3}$ for cars 0, 1, 2 and 3, respectively.

After outputting the assignments to the cars, the program returns to step 334, hereinbefore described.

FIGURE 10

Figure 10:
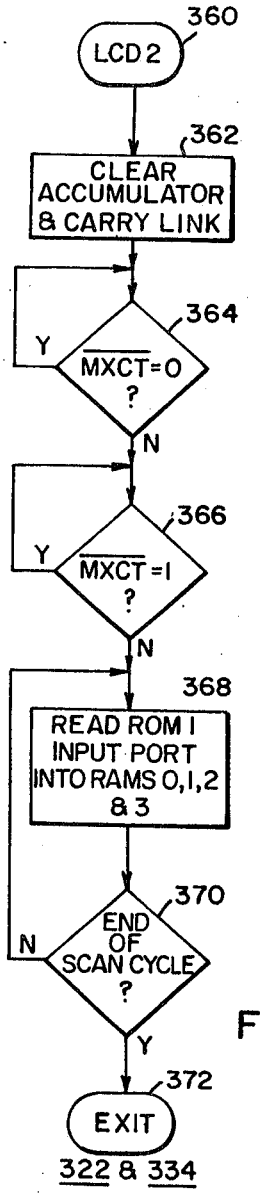

FIG. 10 is a flow chart of the subprogram LCD2 which may be used to read the serial input signals $\overline{IN0}$-$\overline{IN3}$ from the cars, which signals appear at the input port of ROM1, and to store these signals in RAMS 0, 1, 2 and 3. As illustrated in FIG. 5, the status signals from each of the cars, which appear in the first quarter of a scan slot, are stored in RAM 0, the up and down hall calls $\overline{1Z}$ and $\overline{2Z}$, respectively, which appear in the second quarter of signals $\overline{IN0}$ and $\overline{IN1}$, are stored in RAM 1, the floor enable signals $\overline{FEN}$, which appear in the third quarter, are stored in RAM 2, and the car calls $\overline{3Z}$ are stored in RAM 3. As will be hereinafter described, the floor enable signals $\overline{FEN}$ are only temporarily stored in RAM 2, and will be later transferred to another RAM storage location when the up and down call masks are formed.

More specifically, sub-program LCD2 is entered at terminal 360, and step 362 clears the accumulator and carry link CY of CPU 80 shown in FIG. 4, as all input transfers are made through the accumulator. As hereinbefore explained, the signals $\overline{MXCT}$, graphically shown in FIG. 2 and developed by hardware in FIG. 6, is used by CPU 80 to determine the start of a scan cycle. Signal $\overline{MXCT}$ is low during the last scan slot, and CPU 80 synchronizes itself with the scan cycle on the negative going transition of $\overline{MXCT}$. Step 364 loops back on itself when $\overline{MXCT}$ is zero, as it has missed the negative going transition. When $\overline{MXCT}$ is a logic one, the program advances to step 366, which determines if $\overline{MXCT}$ is a logic one. As long $\overline{MXCT}$ remains a logic one, step 366 is repeated. As soon as $\overline{MXCT}$ becomes a logic zero, the program advances to step 368. Step 368 reads the ROM 1 input port into RAMS 0, 1, 2 and 3, a scan slot at a time. After each scan slot, step 370 checks to see if the scan cycle has ended, and if it has not, step 368 is repeated to read and store the next scan slot. When all scan slots have been read and stored, step 370 advances to the sub-program exit terminal 372.

FIGURE 11

FIG. 11 is a flow chart of a sub-program LCD1 which may be used to count the cars in-service with the system control 22, and thus may be used to perform the functions referred to in blocks 324 and 336 of FIG. 9. Since all of the elevator cars will be considered, step 382 prepares the car loop by initializing the car number or count to car 0. Step 382 also clears the binary counter which will contain the number of in-service cars $N_{SC}$.

Steps 384 and 386 read the 4-bit words INSC and BYPS, respectively, which are located in RAM 0 (FIG. 5), and the words are stored in a temporary location where the bits may be examined. Step 388 examines the bit of the BYPS word associated with car 0, and if it is a logic one, the car is by-passing hall calls and it will not be counted as in-service car. The program then advances to step 396 which increments the car number so car 1 may be checked. If the car is not by-passing, step 388 advances to step 390 which checks the bit of the word INSC associated with car 0, to determine if the car is in-service with the system processor according to the car controller of car 0. If this bit is a logic zero, the car is not counted, and the program advances to step 396. If the INSC bit is a logic one, the program advances to step 392 which increments $N_{SC}$, the binary count of in-service cars, from the system control viewpoint. Step 394 enables the bit of word INSV for car 0. Word INSV will be a 4-bit word, one for each car, which indicates whether or not each car is in-service according to the system control 22.

Step 394 advances to step 396 which increments the car number, and step 398 checks to see if all cars have been considered. If they have not, step 398 returns to step 388 to check the BYPS and INSC for this car. When all cars have been considered, a new 4-bit word INSV had been formed, and step 400 loads this word into the status character memory of RAM 0. Step 402 loads the $N_{SC}$ count into the status character memory of RAM 0, and the program exits at terminal 404.

FIGURE 12

FIG. 12 is a flow chart of a sub-program LCD9 which may be used to form the up and down call masks, specified in block 328 of FIG. 9. Sub-program LCD9 is entered at terminal 410 and step 412 clears the up and down call masks in RAMS 10 and 9, respectively, it initializes the floor count to scan slot 00, it initializes the car count to car 0, and it sets a test flag to zero for each car.

Step 414 reads the 4-bit binary floor enable word from slot 00 of the main memory of RAM 2, and writes this word in slot 00 of the main memory of RAMS 9, 10 and 11. RAM 11 will be the new location for the floor enable when all floors have been considered, leaving RAM 2 available for storing other signals, and RAMS 9 and 10, when all floors have been considered, will indicate the floor each car can serve down and up hall calls from, respectively.

The down call masks of RAM 9 will be similar to the RAM map of floor enable in RAM 11, except the floor enable bit for the lowest floor a car is enabled to serve will be deleted. The up call masks of RAM 10 will be similar to the RAM map of the floor enable in RAM 11, except the floor enable bit for the highest floor a car is enable to serve will be deleted. The program of FIG. 12 performs the function of deleting these bits to form the up and down call masks.

For purposes of example, it will be assumed that there are 16 floors in the building and all cars are enabled to serve all floors, and thus the bits of slot 00 of the main memory of RAM 9 should all be a logic zero, while the remaining bits of the main memory of RAM 9 will be a logic one, and the bits of slot 15 of the main memory of RAM 10 should all be a logic zero, while the remaining bits of the main memory of RAM 10 will be a logic one.

More specifically, after the floor enable word for slot 00 has been written into RAMS 9, 10 and 11, step 416 checks this word while it is in the accumulator of CPU 80. If this scan slot had not been assigned to a floor, such as when there are more scan slots than floor levels, the word will be all zeros, and step 416 would advance to step 436 which increments the floor count. In the example, the first word will all be ones, and since the word is not all zeros, the program advance to step 418 which shifts the accumulator right to place the bit associated with car 0 in the accumulator carry CY. Step 420 checks the carry, and if it is a zero, indicating this car is not enabled for this floor, the program advances to step 428 which increments the car count. In the example, all cars are enabled for all floors, so the carry will be a one and the program advances to step 422, which loads the address of this floor in the up delete register for this car, i.e., an index register in CPU 80. Each time this car is found to be enabled for a higher floor, the address of this higher floor will be written over the address of the lower floor. Therefore, when all floors have been considered, the address in the up delete register, is the address of the highest floor the car is enabled to serve, and the bit for this floor, for this car, will be deleted in RAM 10, the up call mask.

Step 424 then checks the test flag for this car. If it is a zero, it indicates the down mask bit for the lowest floor this car can serve has not yet been deleted, and step 426 clears the carry to delete this bit, and the test flag for this car is set to 1, to indicate the next time step 424 is encountered that step 426 should be skipped. Step 428 increments the car number, and step 420 checks to see if all cars have been considered. If not, the program loops back to step 418, to check the bit of the floor enable word for the next car.

When all cars have been considered relative to the floor enable word for this floor, step 432 shifts the accumulator right to return the floor enable word to its original location, and step 434 loads this word into the associated slot of RAM 9, the down call mask. Since the bits of the lowest floors the cars are enabled to serve are eliminated from the word in step 426, the correct down mask is created simply by writing the word held in the accumulator over the word of the same slot in the down mask, RAM 9.

Step 436 increments the floor count, and step 438 checks to see if all floors have been considered. If not, the program loops back to step 414, which reads the floor enable word from RAM 2 for this floor into RAMS 9, 10 and 11. The steps will then be performed as before, except now the test flag will be a one for all cars, skipping step 426, as no further bits are to be removed from the word before loading it into RAM 9.

When step 438 finds that all floors have been considered, the up delete register for each car will contain the address of the highest floor each car is enabled to serve, and step 440 initializes the car count and loads this up delete address for car 0 into the accumulator. Step 442, using this address, deletes the bit for this car and floor in RAM 10, the up call mask. Step 444 increments the car count, and step 446 checks to see if all cars have been considered. If not, the program loops back to step 440. When all cars have been considered, the up mask is completed, and since the down mask was completed when step 438 advanced to step 440, the program exits at terminal 448.

FIGURE 13

Figure 13:
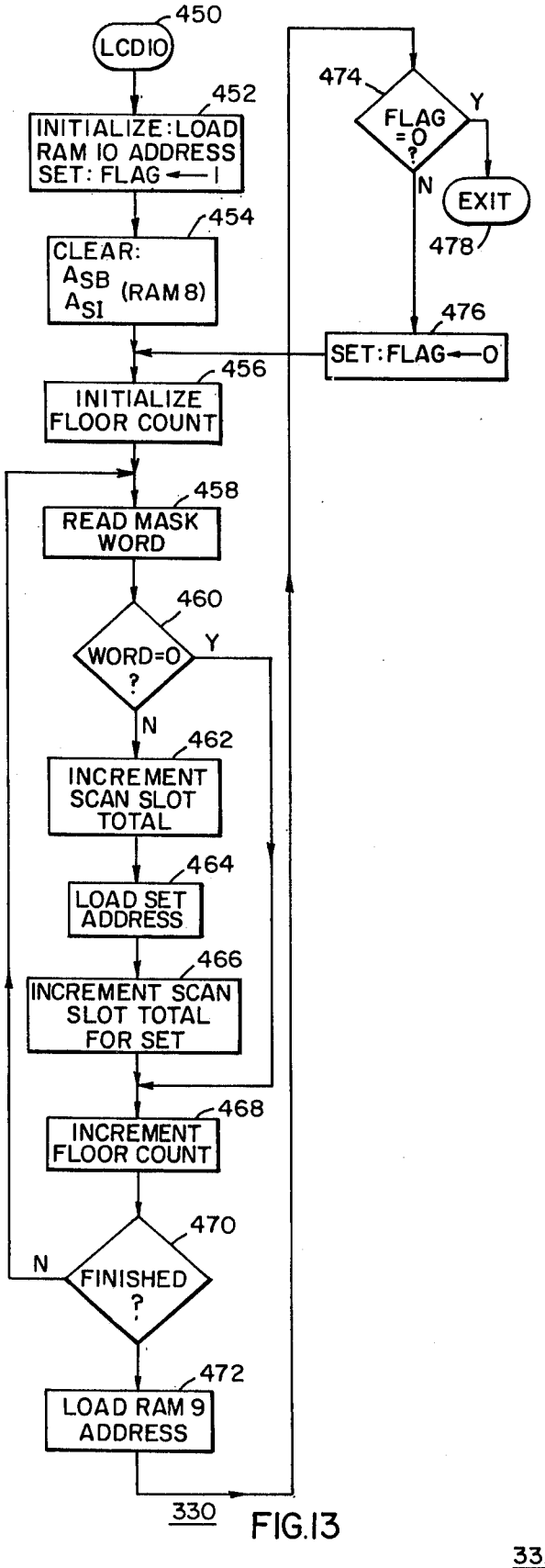

FIG. 13 is a flow chart of a sub-program LCD10 which may be used to count the total number of scan slots in the building, as well as the number of scan slots in each set, which corresponds to the block function 330 in FIG. 9. Sub-program LCD-10 is entered at terminal 450 and step 452 loads the address of RAM 10, the up call mask, into the accumulator, and sets a flag to 1. Step 454 clears word $A_{SB}$, the average number of scan slots per in-service car in the building, which word is located in the status character memory of RAM 8, and it also clears the main memory of RAM 8, which is where the $A_{SI}$ words for the sets are stored. Word $A_{SI}$ is the average number of scan slots for a set, per inservice car capable of serving the set.

In RAM 8, the rows refer to set numbers, and not scan slots or floor levels. The universality of the supervisory control is enhanced by giving each of the 16 possible sets, counting the invalid set where no cars serve a scan slot, a different binary number 0000 through 1111. Information relative to a set is stored in the main memory of a RAM according to the binary number of the set. Information relative to set 0001, for example, is stored in row 1, and information relative to set 1111 is stored in row 15. The mask word for a floor, from both the up and down masks, is used as the set number. Therefore, it is not necessary for CPU 80 to determine how many sets there are, or what they are. For example, if an up or down mask word for a floor is 1111, indicating all cars are enabled to serve the floor and direction therefrom associated with this scan slot, this scan slot belongs to set 1111 and information relative to this set is stored in row 15 of the main memory of a RAM. If the mask word is 1100, indicating that only cars 2 and 3 are enabled to serve the floor and direction therefrom associated with this scan slot, this scan slot would belong to set 1100, which would be stored in row 12. If these are the only valid sets, only rows 12 and 15 would be used to store information relative to the sets, and the remaining rows would all contain zeros.

More specifically, step 454 advances to step 456 which initializes the floor count, and step 458 reads the up mask word for scan slot 00. Step 460 checks to determine if the scan slot is associated with a floor. If the mask word is zero, it is not associated with a floor and the program advances to step 468, which increments the floor count. If the word is not zero, step 462 increments the scan slot total, stored in a scratch pad memory, such as the main memory of one of RAMS 12, 13, 14 or 15.

Step 464 loads the set address which this scan slot belongs to, which, as hereinbefore described is the same as the mask word being considered, and step 466 increments the scan slot total for this set. This, if the mask word was 1111, address 1111, which is row 15 of the main memory of a RAM, would be incremented by one.

Step 468 increments the floor count and step 470 determines if all of the scan slots have been considered. If not, the program loops back to step 458 to read the mask word for the next scan slot. When step 470 finds all scan slots have been completed, step 472 loads the address of RAM 9, the down call mask, into the accumulator, and step 474 checks the flag. If the flag is one, it indicates the down call masks have not yet been processed, step 476 sets the flag to zero, and the program returns to step 456 to process the down call masks. When step 474 finds the flag equal to zero, both the up and down call masks have been processed, and the program exists at terminal 478.

FIG. 14

Figure 14:
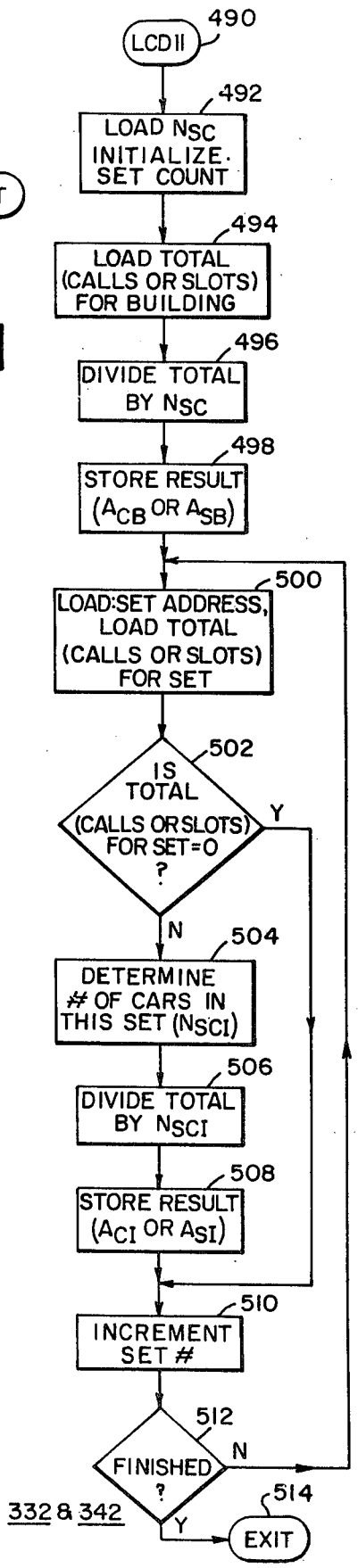

FIG. 14 is a flow chart of a sub-program LCD11 which may be used for both block functions 332 and 342 of FIG. 9. Function 332 determines the averages $A_{SB}$ and $A_{SI}$ and function 342 determines the averages $A_{CB}$ and $A_{CI}$. If all cars are not enabled for the same floors and service directions, there will be more than one set, and each set will have its own $A_{SI}$ and $A_{CI}$ averages. The building averages $A_{SB}$ and $A_{CB}$ bear no relationship to the set averages. If all cars are enabled for all floors, there is only one set. In this instance the average $A_{SI}$ for this one set will be the same as the building average $A_{SB}$, and the average $A_{CI}$ for this one set will be the same as the average $A_{CB}$. In described FIG. 14, it will assumed that it is function 332. To obtain the description of function of 342, it is only necessary to substitute "hall calls" for "scan slots", RAM 2 for RAM 8, $A_{CB}$ for $A_{SB}$, and $A_{CI}$ for $A_{SI}$.

More specifically, sub-program LCD11 is entered at terminal 490, and in step 492 word $N_{SC}$, the number of cars in-service according to the system control 22, stored in the status character memory of RAM 0, is loaded into the accumulator, and the set count is initialized so the sets can be examined in the order to the set numbers.

Step 494 loads the total number of scan slots in the building, which was stored in a temporary location by step 462 in FIG. 13. Step 494 divides the total number of scan slots in the building by $N_{SC}$ and stores the result, a binary word $A_{SB}$, in the status character memory of RAM 8.

Step 500 loads the address of the first set and the total slots in this set. The total slots for this set address were determined in step 466 of FIG. 13. Step 502 determines if there is an actual set by checking to see if the number of scan slots in the set is zero. If it is zero, the program advances to step 510, which increments the set number. If the total slots are not zero, step 504 determines the number of in-service cars enabled to serve the set, $N_{SCI}$, which is determined by counting the "ones" in the set number, and step 506 divides the total number of scan slots by $N_{SCI}$ for this set. The quotient is the $A_{SI}$ of this set, i.e., the average number of scan slots per in-service car, and step 508 stores this number, a binary number, in the main memory of RAM 8, in the row corresponding to the address of this set.

Step 510 increments the set number, and step 512 determines if all sets have been considered. If not, the program loops back to step 500. If all the sets have been considered, step 512 advances to the exit 514.

FIG. 15

Figure 15:
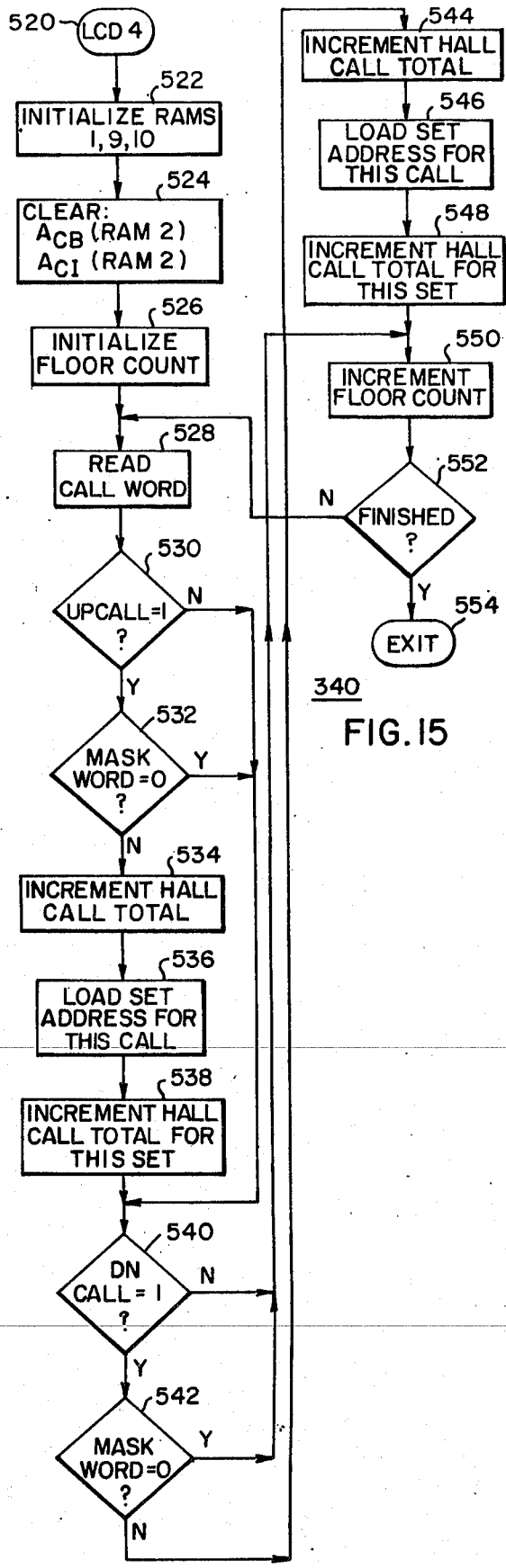

FIG. 15 is a flow chart of a sub-program LCD4 which may be used for the block function 340 shown in FIG. 9, to count the total number of hall calls, as well as the number of hall calls in each of the sets.

Sub-program LCD4 is entered at terminal 520, and step 522 loads the addresses of RAMS 1, 9 and 10 which contain the up and down hall calls, the down call mask words, and up call mask words, respectively. Step 524 clears $A_{CB}$, the average number of hall calls per in-service car in the building, stored in the status character memory of RAM 2, and it clears $A_{CI}$ for each set, the average number of hall calls in a set per in-service car enabled to serve the set, stored in the main memory of RAM 2. Step 526 initializes the floor count, and step 528 reads the call word from row 00 of RAM 1. Step 520 checks the first bit of this call word for an up call. If the first bit is zero, the program advances to step 540 to check for a down call. If the first bit is a one, step 532 checks the up call mask word of this scan slot, stored in RAM 10. If the mask word is zero, no cars are enabled for this scan slot and the "one" detected by step 530 was invalid. Therefore, the program advances to step 540. If step 532 finds the mask word is not all zeros, step 534 increments the hall call total for the building, stored in a temporary location, and step 537 loads the set address for this call. The set address is the up call mask word just checked in step 532, and steps 538 increments the hall call total for this set, which totals are stored in a temporary location.

Step 538 advances to step 540 which checks the second bit of the call word from RAM 1. If this bit is zero, the program advances to step 550, which increments the floor count. If the second bit is a one, the program checks the down call mask word from RAM 9 for this scan slot. If the mask word is zero, the detected call by step 540 is invalid, and the program advances to step 550. If the mask word is non-zero, step 544 increments the hall call total for the building. Step 546 loads the set address for the call, i.e., the down call mask word for this scan slot, and step 548 increments the hall call total of this set.

Step 550 increments the floor count, and step 552 checks to see if all floors (scan slots) have been considered. If they have not, the program loops back to step 528. If they have, the program exits at terminal 554.

The information necessary to run function 342 of FIG. 9 is now available, and subprogram LCD11 prepares the averages $A_{CI}$ for each set, and $A_{CB}$ for the building, in a manner similar to that hereinbefore described relative to the preparation of averages $A_{SI}$ and $A_{SB}$ (FIG. 14).

FIG. 16

Figure 16:
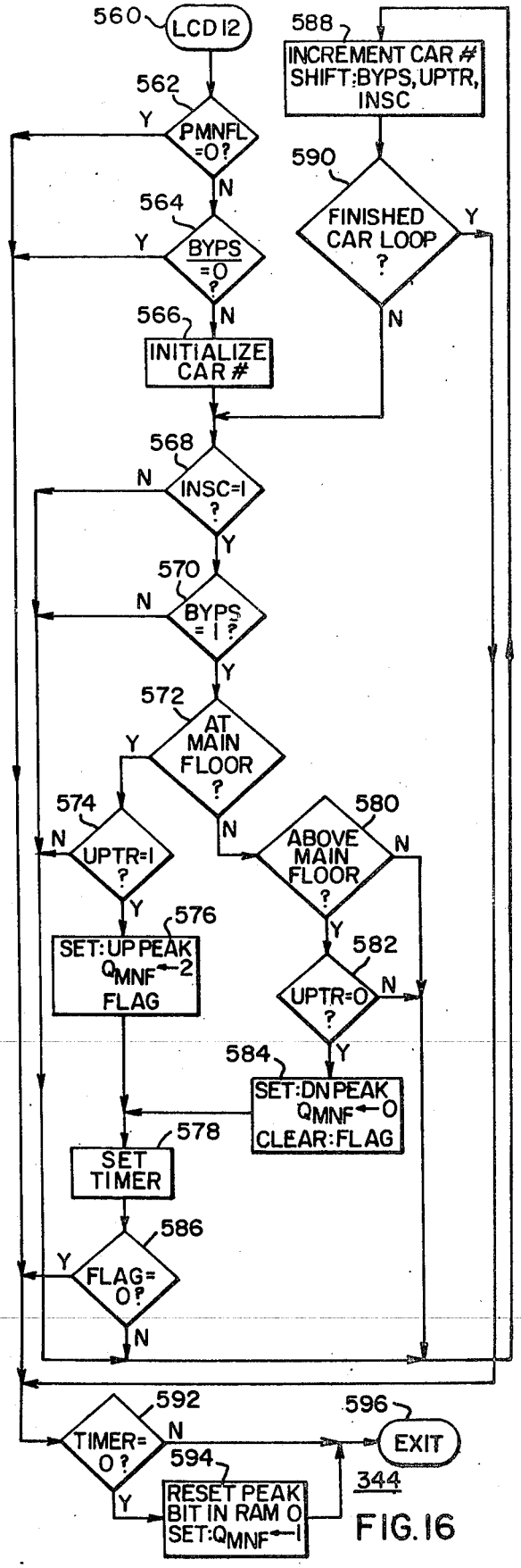

FIG. 16 is a flow chart of a sub-program LCD12 which may be used for the block function 344 of FIG. 9, related to special traffic features. The subprogram LCD12 detects predetermined traffic conditions, and in response thereto takes a predetermined course of action. For example, a peak traffic condition in the down direction may be detected by a car above the main floor, set for down travel, by-passing hall calls. This may be detected by checking the 4-bit word BYPS stored in row 07 of RAM 0. A peak traffic condition in the up direction may be detected by a loaded car leaving the main floor. It may also be detected by a car at the main floor, set for up travel, set to by-pass hall calls. Again, the 4-bit word BYPS may be checked.

If both the up peak and down peak events occur simultaneously, the down peak takes precedence.

The predetermined course of action taken by subprogram LCD12 in response to a peak condition determines the quota of cars to be maintained at the main floor, $Q_{MFL}$, and actuates a peak timer. The peal timer maintains the peak related strategy for a predetermined period of time after the occurrence of each event which is used to indicate the peak is occurring.

More specifically, subprogram LCD12 is entered at terminal 560 and step 562 checks input signal $\overline{IN5}$ of CPU 80 to determine if the main floor features is true, indicated by a true signal $\overline{PMNFL}$ (FIG. 6), which may be controlled by a manual switch. If the main floor feature is not active, the program advances to step 592. If the main floor feature is active, step 563 checks the 4-bit word BYPS stored in RAM 0 to see if any car is by-passing hall calls. As hereinbefore stated, this test may be used to detect peaks for both traffic directions. If the words BYPS is zero, the program advances to step 592. If the word BYPS is not all zeros, step 566 initializes the car count and step 568 checks the first bit of word INSC, stored in RAM 0, which bit is associated with car 0. If this bit is zero, indicating this car is not in-service with the system control 22, the program advances to step 588. If the car is in-service, step 570 checks the bit of word BYPS, stored in RAM 0, associated with car O. If this bit is zero, the car is not by-passing and the program advances to step 588. If the BYPS bit is a one, the car is by-passing and step 572 determines if the by-passing is associated with up or down traffic by checking to see if the car is at the main floor. If the car is at the main floor, step 574 checks the bit of word UPTR, stored in RAM 0, to see if the car is set for up travel. If it is not, the program advances to step 588. If it is, step 576 sets a peak bit in the status character memor of RAM 0, it sets a peak identifier bit in the same RAM to indicate up peak, it sets the quota of cars to be maintained at the main floor ($Q_{MNF}$), to some predetermined number, such as 2 for a 4 car bank, and it sets a flag to indicate the up peak bit has been set. Step 578 sets a peak timer, which will keep the system on up peak for a predetermined period of time.

If step 572 found that the by-passing car was not at the main floor, step 580 checks to see if the car is above the main floor. If it is not, the program advances to step 588. If the car is above the main floor, its travel direction is checked in step 582 by checking the bit of word UPTR stored in RAM 0 associated with this car. If the car is set for up travel the bit will be a "one", and the program advances to step 588. If the car is set for down travel, the UPTR bit will be a zero and step 584 sets the bits in the status character memory of RAM 0 to indicate a down peak, the main floor quota $Q_{MNF}$ is set to some predetermind number, such as zero for a 4 car bank, and it clears a flag to indicate the down peak bit has been set.

If either the up peak or down peak bit is set, the program reaches step 578 which sets the peak timer, and step 586 checks the flag to see if the system has been set for up or down peak. If the flag is zero, indicating a down peak, no further cars need be checked, since down peak takes precedence over up peak. If the flag is a one, indicating an up peak, the remaining cars must be checked to determined if any will trigger the down peak feature, since down peal takes precedence. If step 586 finds the flag is set, step 588 increments the car count and the words BYPS, INSC and UPTR are shifted to look at the bits of these words which are associated with the new car. Step 590 checks to see if all cars have been considered, and if not, the program loops back to step 568.

When step 590 finds that all of the cars have been considered, or as soon as the down peak is activated, or if PMNEL or the word BYPS was zero, step 592 is reached which checks the peak timer. If the peak timer is active, the program exits at terminal 596. If the peak timer has timed out, step 594 resets the peal bit in the status character memory of RAM 0, and set the main floor quota, $Q_{MNF}$ to some predetermined number, such as 1 for a 4 car bank, and then the program exits at terminal 596.

FIG. 17

FIG. 17 is a flow chart of a sub-program LCD13 which may be used to perform the block function 346 of FIG. 9 associated with special floor features. As hereinbefore described relative to FIG. 6, the present invention has provision for a main floor feature and a convention floor feature, but other special floor features, such as a restuarant floor, and the like may be added in the manner previously described relative to FIG. 6, and to be described relative to FIG. 17. It will be recalled that the main floor feature is activated by a switch which drives terminal $\overline{\text{PMNFL}}$ of FIG. 6 true. The main floor may be selected to be any floor in the building, and may be changed, if desired. The binary address of the floor selected as the main floor is applied to terminals $\overline{\text{PMFL0}}$ through $\overline{\text{PMNFL3}}$ of FIG. 6, such as by a plurality of switches, and thus to change the location of the main floor it is only necessary to apply the associated binary address of the new floor to these terminals.

In like manner terminal $\overline{\text{PCONFL}}$ of FIG. 6 activates the convention floor feature, and terminals $\overline{\text{PCFL0}}$ through $\overline{\text{PCFL3}}$ select the address of the floor, which again may be any floor of the building.

The main floor feature, when activated, attempts to maintain the quota of cars set by $Q_{MNF}$ in sub-program LCD12 (FIG. 16), by presenting dummy calls for the main floor, and it provides a NEXT car feature whereby a car is designated as the next car to leave the main floor, which car waits the main floor, preferably with its doors open and the up hall call lantern lit, until a car call is registered in the car. The NEXT car is treated differently when assigning scan slots to the car, as will be hereinafter explained relative to the sub-program which assigns can slots.

When the convention floor feature is activated, and there are no cars at the selected convention floor, dummy calls are used to bring a car to the floor. A car parked at the convention floor does so with its door closed until a hall call at the convention floor is registered.

More specifically, sub-program LCD13 is entered at terminal 600, and step 602 initializes by clearing all dummy calls ($\overline{\text{PKFL}}$), by setting a word FLOOR in an index register of CPU 80 to the floor indicated by the address $\overline{\text{PMNFL0}}$-$\overline{\text{PMNFL3}}$, by setting a main floor flag to 1, which indicates the main floor feature is being processed, and by setting the temporary word ASGN to the 4-bit word NEXT stored in the main memory of RAM 4.

Step 604 checks PMNFLR to see if the main floor feature has been activated. If it is not active PMNFLR will be zero, and the program advances to step 610. Step 610 clears the words NEXT, DOPN and SUT, which are stored in RAM 4, since these assignments by CPU 80 are made only when the main floor feature is active.

If PMNFLR is a one, step 606, as a program check, determines if a word $N_{SMF}$, which contains the number of cars enabled to serve the selected main floor is equal to zero. If the main floor address selects a scan slot for which no cars are enabled, the main floor feature is invalid and the program advances to step 610. If word $N_{SMF}$ is not 0, a valid scan slot has been selected and step 608 checks the main floor quota $Q_{MNF}$ set in LCD12 (FIG. 16). If $Q_{MNF}$ is zero the program advances to step 610 to clear the word NEXT, DOPN, and SUT. If the main floor quota is not zero, the program advances to step 612. On this loop through step 612, the word ASGN is the word NEXT, set in step 602, so step 612 checks the word ASGN to see if there is a car designated as the next car to leave the main floor. If the word ASGN is zero, there is no car designated as the NEXT car to leave the main floor and the program advances to step 630. If there is a NEXT car, step 614 identifies the NEXT car. Step 616 checks to see if the car is at the floor, which on this loop through the program is referring to the main floor since the main floor flag is a one.

If the car is not at the main floor, step 618 assigns a dummy call PKFL to this car for the main floor.

If the car is at the floor, step 620 checks the main floor flag. On this loop through 620 the main floor flag is a one, and the program advances to step 624. Step 624 checks for a call by testing the bit of the word $\overline{\text{CALL}}$ in RAM 0 associated with the car identified as NEXT. If this $\overline{\text{CALL}}$ bit is a 0, indicating the NEXT car has a call, step 626 clears the assignment words NEXT, DOPN and SUT, to allow the car to serve the call. If this bit of $\overline{\text{CALL}}$ is a one, indicating no call, step 628 sets the door open bit DOPN for the car, and also sets the up travel bit SUT for the car.

After the NEXT car at the main floor receives its door and travel direction assignments in step 628, the program advances to step 668 which checks the main floor flag. If it is a one, it indicates the convention floor feature has not been checked, and step 670 sets the word FLOOR to the address of the convention floor selected by $\overline{\text{PCFLO}}$–$\overline{\text{PCFL3}}$, it sets the main floor flag to zero, and it sets the word ASGN to the word CONV, which word is stored in RAM 4.

Step 672 checks PCONFL to see if the convention floor feature is active. If it is not active, step 676 clears the word CONV stored in RAM 4, and the program exits at terminal 678. If the convention floor feature is active, step 674 determines if the number of cars enabled to serve the convention floor $N_{SCF}$ is 0. If so, the convention floor address has selected an invalid scan slot and step 676 clears the convention floor word CONV. If $N_{SCF}$ is not zero, the program loops back to step 612.

Step 612 checks to see if the assignment word ASGN is greater than zero, which, on this loop, is checking the word CONV to see if some car has been given the convention floor assignment. If a car has been given a convention floor assignment, step 614 identifies the car and step 616 checks to see if the car is at the convention floor. If it is not at the convention floor, step 618 gives a dummy parking call $\overline{\text{PKFL}}$ to this car for the convention floor. If it is at the floor, step 620 checks the main floor flag, and on this loop it is zero, directing the program to step 621 which checks to see if this car at the convention floor has a call. If it does not, the bit $\overline{\text{CALL}}$ will be a one, and the program advances to step 668 which finds the main floor flag is a zero, and the program exits as terminal 678. If it does have a call the program advances to step 622 which clears the assignment word CONV.

If the word ASGN was found to be zero when checking either the loop for the main floor feature or the loop for the convention floor feature, it would mean that the feature presently being checked by the loop has been activated but no car presently has an assignment, ie., a NEXT assignment for the main floor loop, or a CONV assignment for the convention floor loop. In this event, the program advances to step 630 which beings the portion of the program which locates a suitable car for such an assignment. The program also advances to step 630 from step 626 during the main floor loop when the NEXT car at the main floor has a call and another car must thus be found for the NEXT assignment. In like manner, the program advances to step 630 from step 622 when in the convention floor loop the car at the convention floor with the present CONV assignment has a car cell, as this car will be leaving the convention floor and another car must be found for the CONV floor assignment.

Step 630 checks the 4-bit word AVAS to see if there are any cars idle or available, according to the floor selectors of the various cars. This word is stored in RAM 0. If there is an available car, the word AVAS will not be zero, and the program advances to step 632, which starts the process of finding the closest AVAS car to the floor in question. Step 632 initializes the car count and sets a variable DIST to a number which is larger than the longest travel distance in the building. For example, with sixteen floors, DIST may be set to 16.

Step 634 checks the AVAS bit of RAM 0 for the first car in the car loop. If this car is not AVAS, the program advances to step 646, which increments the car number, and if the car loop has not been completed, as tested by step 648, the program loops back to step 634.

If step 634 finds the car is AVAS, step 636 determines if the car is enabled to serve this floor by checking the floor enable to RAM 11. If the car is not enabled for this floor, the program advances to step 646. If the car is enabled, step 638 checks the bit of word NEXT associated with this car, to see if it has been given the NEXT assignment. If it has, the program advances to step 646. If it is not NEXT, step 640 determines the distance from the car to the floor in question by obtaining the absolute difference between the numbers of the floors. Step 642 checks to see if this distance is closer than DIST, and since this is the first AVAS car found it will be closer than DIST, since DIST was arbitrarily set to a number larger than the longest travel distance. Step 644 loads the car number into a temporary location and changes the word DIST to the distance from this car to the floor in question.

Step 646 increments the car number and 648 determines if all the cars have been processed. If not, the program loops back to step 634. When all cars have been processed, the car number stored in the temporary location is the closest AVAS car to the floor in question, and step 650 forms the assignment word NEXT, or CONV, depending upon which loop the program is in, as well as sending a dummy call $\overline{\text{PKFL}}$ to the car for the floor in question.

Step 652 checks the main floor flag, and if it is a one, the word NEXT is loaded into RAM 4, and if it is a zero, step 656 loads the word CONV into RAM 4. The program advances to step 668, which checks the main flag. If it is a one, the convention floor feature hasn't been checked, and the program advance to step 670, hereinbefore described. It is a zero, the program exits at terminal 678.

If step 630 did not find any cars available, the program advances to step 658. Step 658 checks the peak bit in the status character memory of RAM 0. If it is a one, there is an up or down peak condition, and if it is a zero, there is no peak. If step 658 finds no peak traffic condition step 658 advances to step 662, which gives all cars a dummy call for the main or convention floor, depending upon which feature is being processed. Step 662 advances to step 668.

If there is a peak, step 658 advances to step 664 which checks for the type of peak. If it is a down peak, no dummy calls for the main floor are assigned, as in a down peak the NEXT car is dispatched immediately, and it is therefore not necessary to give a NEXT assignment. Also, no busy cars are given a convention floor assignment during a down peak.

If the system is in an up peak, step 666 checks the main floor flag. If it is a zero, the program advances to step 668, as no convention floor assignments are made to busy cars during an up peak. If the main floor flag is one, step 662 gives a dummy call $\overline{PKFL}$ to all cars for the main floor.

FIG. 18

Figure 18:
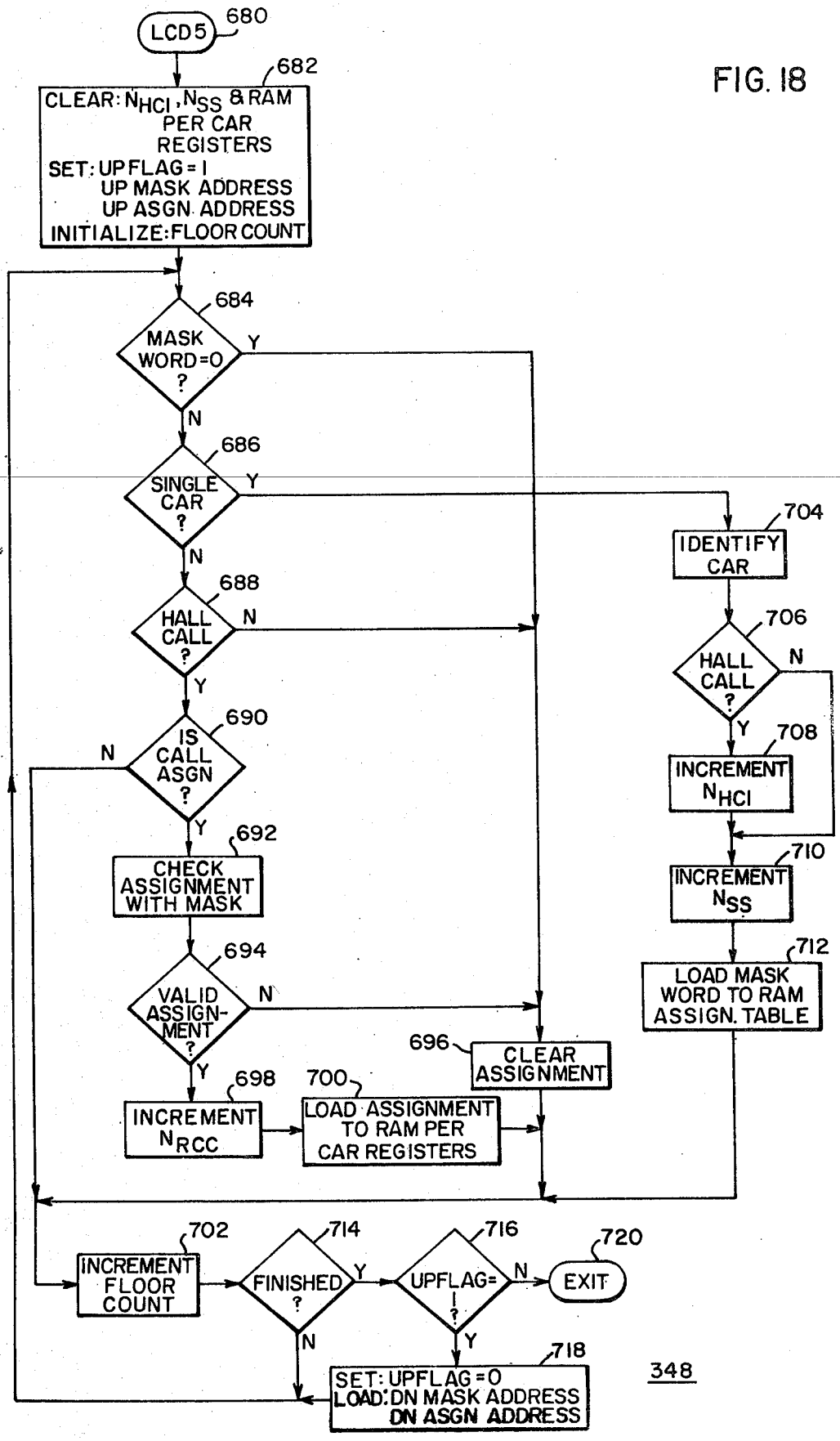

FIG. 18 is a flow chart of a sub-program LCD5 which may be used to perform the block function 348 of FIG. 9, which function clears the up and down assignment tables stored in the main memories of RAMS 6 and 7, respectively, of all scan slots, with predetermined exceptions. For example, scan slots for which only a single car is enabled to serve, are retained by LCD5. Also, scan slots which have a registered hall call are retained.

More specifically, sub-program LCD5 is entered at terminal 680, and step 682 initializes the floor count, it clears, $N_{HCl}$ a variable for counting the number of hall calls assigned to a car from a 1 car set, ie., a set for which only one car is enabled, it clears $N_{SS}$, a variable for counting the total number of scan slots assigned to a car so far, it clears the per car registers, RAMS 12, 13, 14 and 15, it sets an up flag to 1, and it loads the up call mask address (RAM 10), and the up assignment address (RAM 6).

Step 684 checks the up call mask word from slot 00 of RAM 10 to see if it is zero. If so, no cars are enabled for this scan slot, step 696 clears any assignment (RAM 6) for the scan slot, and the program advances to step 702 which increments the floor count.

If the up call mask word is not zero, it is a valid scan slot and step 686 determines, from the mask word, if only one car is enabled to serve the scan slot. If so, step 704 identifies the car, and step 706 checks RAM 1 to see if there is a hall call associated with this scan slot. If there is a hall call, step 708 increments the variable $N_{HCl}$ for this car to count the number of hall calls assigned to this car from a 1 car set, and step 710 increments the variable $N_{SS}$ for this car, to count the total number of scan slots assigned to this car so far. If there was no hall call, step 706 advances directly to step 710.

Since no other cars serve this scan slot, the car may be immediately given the scan slot assignment, and step 712 loads the up call mask word to RAM 6, since the up call mask word for a single car set is the same as the up assignment word. Step 712 then proceess to step 702.

If step 686 found that the scan slot is served by morw than 1 car, step 688 checks RAM 1 to see if there is an up hall call (1Z) associated with the scan slot. If not, step 696 clears the scan slot assignment in RAM 6 and advances to step 702. If there is a hall call, step 690 checks to see if the scan slot associated with the call has been previously assigned. If not, the program advances to step 702. If it was previously assigned, step 692 checks the assignment (RAM 6) with the up call mask (RAM 10) and step 694 determines if the assignment is valid, ie., the hall call is assigned to a car enabled for the scan slot of the call. If the assignment is not valid, step 696 clears the assignment. If the assignment is valid, step 698 increments the variable $N_{RCC}$ for the car, ie., the number of registered hall calls assigned to the car from a set enabled for more than one car. The variables $N_{RCC}$, for cas 0, 1, 2 and 3, during LCD5, are stored in the status character memories of RAMS 12, 13, 14 and 15, respectively.

Step 700 loads the assignment to the main memory of one of the RAMS 12, 13, 14 or 15 depending upon which car is assigned the scan slot. The only assignments which will appear in the per car registers (RAMS 12, 13, 14 and 159 when LCD5 is complete will be for those sets enabled for more than one car. The scan slots for one car sets are directly assigned in step 712.

Step 702 increments the floor count, step 714 checks to see if the floor loop has been completed, looping back to step 684 if it hasn't and advancing to step 716 if it has.

Step 716 checks the up flag. If it is still a one, step 718 sets the up flag to a zero and loads the down call mask address (RAM 9) and the down assignment address (RAM 7), and returns to step 684 to process the down scan slot assignments.

After the down scan slot assignments have been processed, step 716 will find the up flag is zero, and the program exits at terminal 720.

FIG. 19

Figure 19:
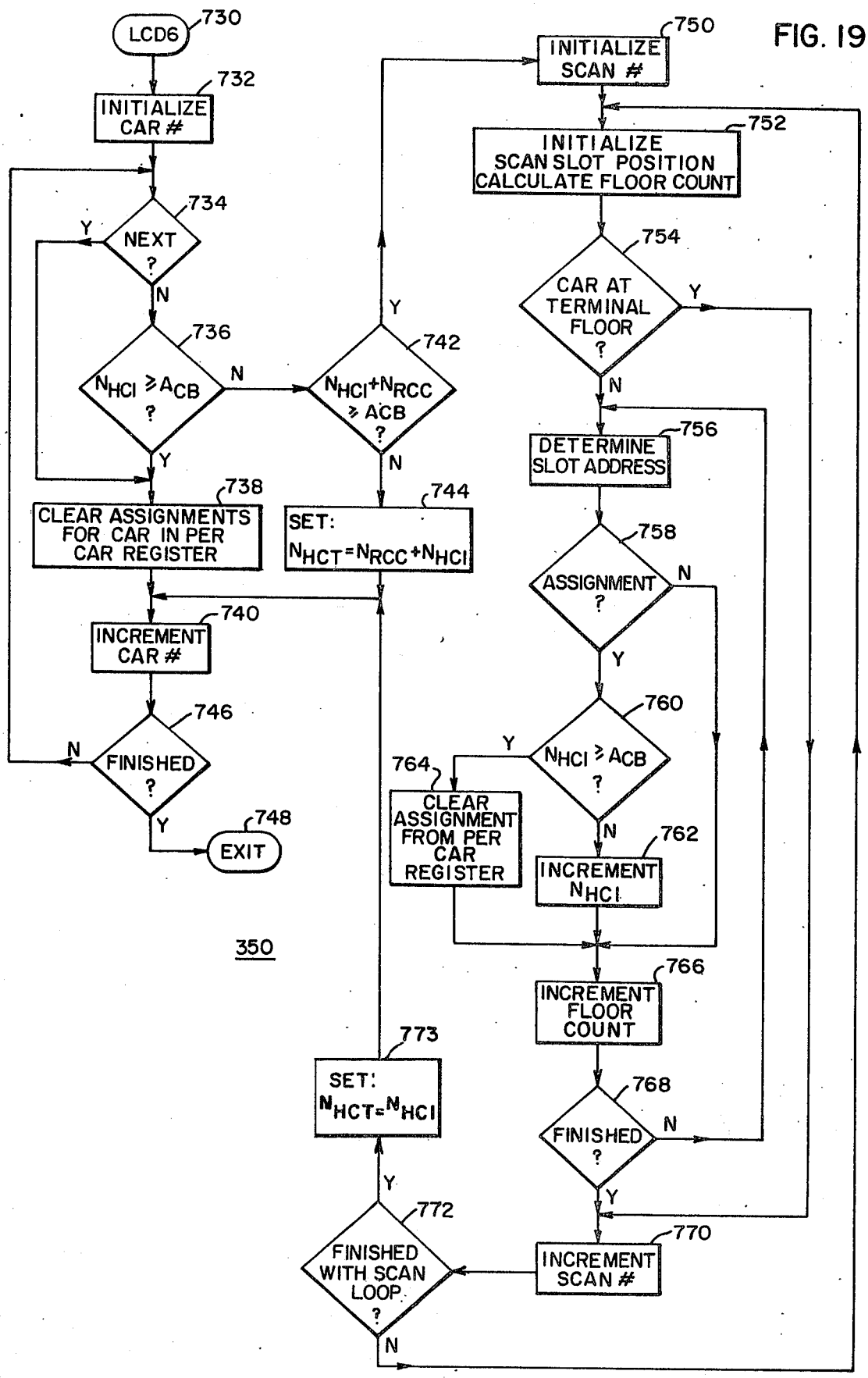

FIG. 19 is a flow chart of a sub-program LCD6 which may be used to perform the block function 350 in FIG. 9, which function removes excess scan slot assignments from the cars, if any, using the average number of calls per car in the building, $A_{CB}$, as the guide.

Sub-program LCD6 is entered at terminal 730 and step 732 initializes the car count. Step 734 checks the bit of the word NEXT associated with this car, stored in RAM 4, and if this car has the NEXT assignment, step 738 clears the assignments for this car which were placed in the per car register associated with this car, ie., one of the RAMS 12–15. It will be recalled that LCD5 (FIG. 18) only placed assignments in the per car registers for sets served by more than one car. Thus, the floors assigned in the per car register are served by other cars and will be reassigned in LCD14 if the assignment is removed in LCD6. The assignments for the one car sets were placed directly in RAMS 6 and 7 and are thus not disturbed by step 738. Step 740 increments the car count.

If step 734 finds the car is not NEXT, step 736 determines if the hall calls assigned to this car from a one car set, totaled in $N_{HCl}$ for the car in LCD5, is equal to, or greater than $A_{CB}$. If so, this car has all it can handle from floors only served by this car, and step 738 removes any scan slot assignments to this car which are in the per car registers.

If step 736 finds the number of hall calls assigned to the car from a one car set, $N_{HCl}$, does not equal or exceed the average $A_{CB}$, step 742 totals the hall calls assigned to the car by adding $N_{HCl}$ to $N_{RCC}$. The count $N_{RCC}$, developed in step 698 of FIG. 18, is the number of hall calls assigned to the car from sets served by more than on car. If this total does not equal or exceed the building call average per car $A_{CB}$, step 744 sets the variable $N_{HCT}$ for the car to the sum of $N_{RCC}$ and $N_{HCl}$, and the program advances to step 740.

If the sum of $N_{HCl}$ and $N_{RCC}$ equal or exceeds $A_{CB}$, the program starts at the scan slot of the car and, proceeding from the car in the selecterd scan direction, as checked by a bit in the word UPSCAN, it counts the scan slots assigned to the car. All scan slots assigned to the cars in the per car registers have a hall call associated therewith. Thus, once a count equal to $A_{CB}$ is reached, any further scan slots which are encountered assigned to this car are removed from the per car registers.

The different portions of the scan cycle which examine the scan slots, starting at the car, are given scan numbers according to the following code:

Scan 1: The scan which starts at the location of the car and proceeds to one end of the scan cycle.

Scan 2: The scan which reverses direction at the end of scan 1 and proceeds to the other end of the scan cycle.

Scan 3: The scan which reverses direction at the end of Scan 2 and proceeds back to the scan slot of the car.

Returning now to FIG. 19, when the sum of $N_{HCl}$ plus $N_{RCC}$ is equal to or greater than $A_{CB}$, the program advances to step 750 which initializes the scan number of scan 1. Step 752 initializes the scan slot position and calculates the floor count to determine the floor position of the car. Step 754 checks to see if the car is at a terminal floor. If so, there will only be 2 scans, instead of 3, and the program advances to step 770 to increment the scan count number. If the car is not at a terminal floor, step 756 determines the scan slot address (floor level of the car minus one) of the first scan slot to be considered and step 758 determines if it is assigned to the car being considered. If it is not, step 766 increments the floor count. If it is, step 760 determines if $N_{HCl}$, the number of calls assigned to this car from a 1 car set, is equal to or greater than $A_{CB}$. If it is not, step 762 increments $N_{HCL}$ and step 766 increments the floor count. If $N_{HCl}$ is equal to or greater than $A_{CB}$, step 764 clears the assignment of this scan slot to this car from the per car register, and step 766 increments the floor count.

Step 768 checks to see if all of the scan slots in the present scan direction have been examined. If not, the program loops back to step 756. If the present scan is completed, step 770 increments the scan number and changes the scan direction. Step 772 checks to see if the scan loop has been completed. If not, the program loops back to step 752. If all the scans have been processed, step 772 advances to step 773 which sets $N_{HCl}$ equal to the present value of $N_{HCl}$ for this car, and step 773 advances to step 740 which increments the car number. Step 746 checks to see if all the cars have been considered. If not, the program loops back to step 734. If all of the cars have been considered, the program exits at terminal 748.

FIG. 20

Figure 20:
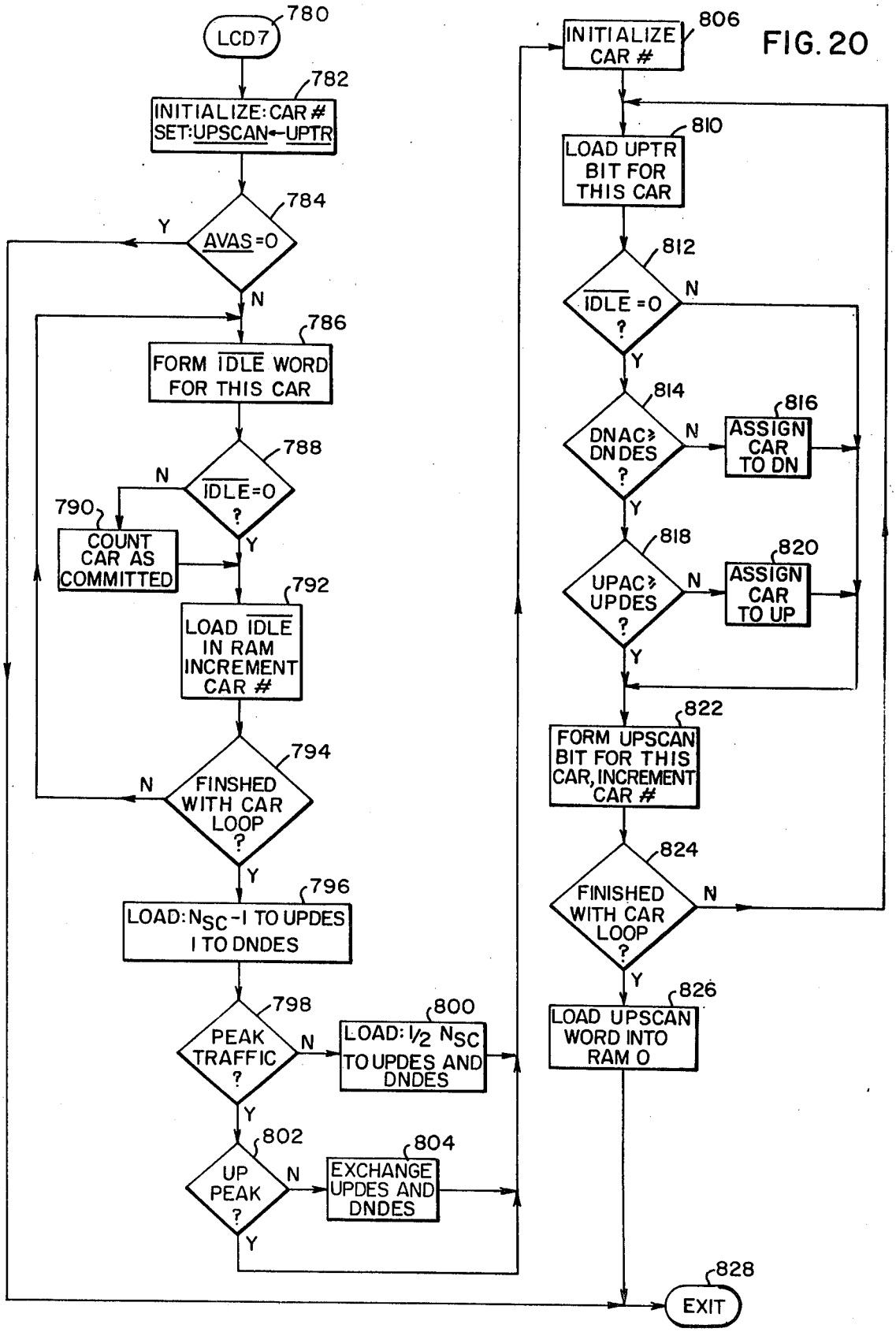
Figure 22:
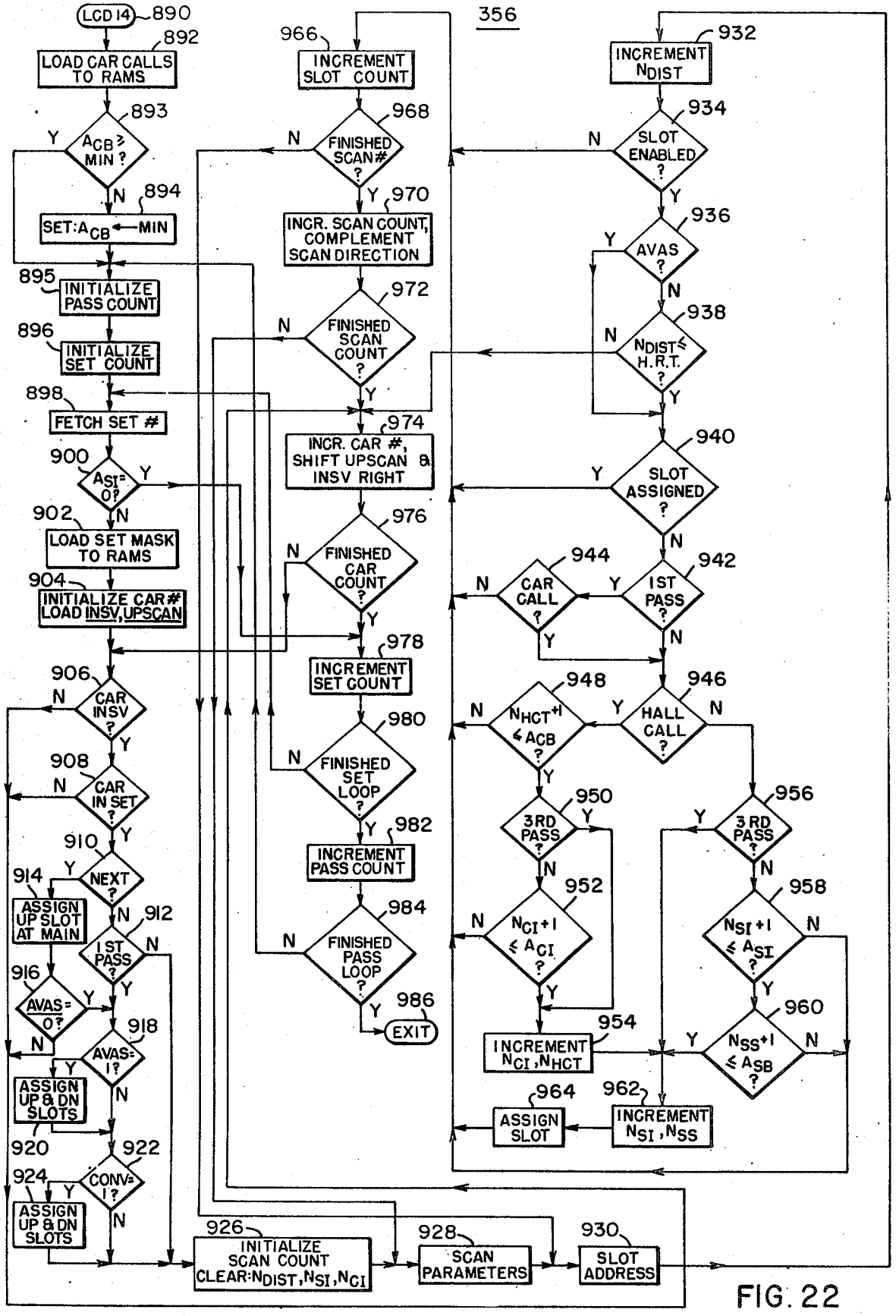

FIG. 20 is a flow chart of a sub-program LCD7 which may be used to perform the block function 352 of FIG. 9, which function assigns scan directions for in-service, idle cars, to be used when assigning scan slots to the cars in function 356 of FIG. 9, detailed in LCD14 of FIG. 22.

When a travel distance limitation from the car to the assigned landing service direction is applied to all in-service cars whether busy or idle, it is important to select an initial assignment direction from an in-service idle car which takes into account the travel directions of the busy cars, as well as the currently existing traffic conditions. If the travel distance limitation is only applied to busy cars, the importance of selecting the assignment direction dynamically is lessened. In the latter case the last travel direction of an in-service idle car may be used. For purposes of example, it will be assumed that LCD7 is used.

Scan slots will be assigned to the cars in LCD14 using the same scan loop hereinbefore described relative to FIG. 19. Busy cars, i.e., cars which have a car call ahead, a dummy call ahead, or an assigned hall call ahead, are assigned the same scan direction as their travel direction. An in-service car with no car calls, dummy calls, or assigned calls ahead, is assigned a scan direction which will best satisfy the following distribution, assuming a 4 car bank:

1. Up peak condition: One car only to serve down traffic
2. Down peak condition: One car only to serve up traffic
3. Normal (no peak): One half of the cars for each service direction.

Sub-program LCD7 is entered at terminal 780 and step 782 initalizes the car count and sets the 4-bit word UPSCAN, stored in the status character memory of RAM 0, to the word UPTR. The word UPTR is stored in the main memory of RAM 0. Step 784 checks to see if there are any in-service, idle cars by checking the word AVAS stored in the main memory of RAM 0. If the word AVAS is zero, there are no AVAS cars and the program exits at terminal 828. It should be noted that the word "available", as normally used to mean "available for assignment", is not applicable at the processor level, as all in-service cars are given floor assignments. If the floor assignments do not have a hall call, and the car has no car calls, and no parking call, the car is idle or inactive, but it is not "available".

If word AVAS is non-zero, there is at least one available car according to the floor selector, and step 786 makes its own determination of whether the car is in-service and truly inactive or idle by forming a word $\overline{\text{IDLE}}$ from the $\overline{\text{INSC}}$, NEXT, and $\overline{\text{AVAS}}$ bits associated with this car. Step 788 checks to see if this word $\overline{\text{IDLE}}$ is zero. If so, it indicates that car is in-service, it does not have the NEXT assignment, and it is available according to the floor selector of this car. If it is non-zero, step 790 counts the car as being committed, i.e., a busy car, and proceeds to step 792.

If word $\overline{\text{IDLE}}$ is zero, the program proceeds directly to step 792 from step 788. Step 792 loads the word $\overline{\text{IDLE}}$ into the main memory of the per car register associated with the car, i.e., RAM 12 for car 0, and the car count is incremented. Step 794 determines if all cars have been considered, and if not, the program loops back to step 786. If all cars have been considered, step 796 provides an arbitrary distribution of scan directions by setting a variable UPDES to the number of in-service cars $N_{SC}$ minus 1, and a variable DNDES is set to 1. When the sub-program is further advanced, variables UPDES and DNDES will contain the desired number of cars which should be set for up and down scan directions, respectively.

Step 798 checks the peak traffic bit in the status character memory of RAM 0, and if it is not set step 800 loads $\frac{1}{2}$ $N_{SC}$ to UPDES and $\frac{1}{2}$ $N_{SC}$ to DNDES. If the peak traffic bit is set, step 802 checks the bit in the status character memory of RAM 0 which identifies whether the system is on up peak or down peak. If the system is on up peak, nothing further is done to UPDES and DNDES, as the arbitrary setting of these variables in step 796 set them for up peak. If the system is on down peak, step 804 exchanges UPDES and DNDES, setting UPDES to 1 and DNDES to $N_{SC}-1$.

The program then advances to step 806 which initializes the car count and step 810 loads the UPTR bit for this car into the accumulator. Step 812 checks the word $\overline{\text{IDLE}}$ stored in the per car register for this car, to see if it is available according to the system control's definition. If it is not available, the program advances to step 822. If it is available, step 814 determines if the actual number of cars set for down travel DNAC is equal to or greater than the desired number of cars set for down travel DNDES. If the answer is no, step 816 assigns the car to down, step 822 sets the bit in the word UPSCAN associated with this car to a zero to indicate the car assignment scan will be in the down direction, and the car count is incremented.

If the actual number of cars set for down scan is equal to or greater than the desired number, step 818 determines if the actual number of cars set for up travel, UPAC, is equal to or greater than the desired number UPDES. If the answer is no, step 820 assigns the car to the up scan direction, and step 822 sets the bit of UPSCAN related to this car to a one, to indicate that it has been assigned the up scan direction, and increments the car count.

If step 818 finds UPAC equal to or greater than UPDES, the program advances to step 822, the UPSCAN bit is undisturbed, and the car count is incremented.

Step 824 checks to see if all cars have been considered. If not, the program loops back to step 810. If all cars have been considered, step 826 loads the word UPSCAN into the status character memory of RAM 0, and the program exits at terminal 828.

FIG. 21

Figure 21:
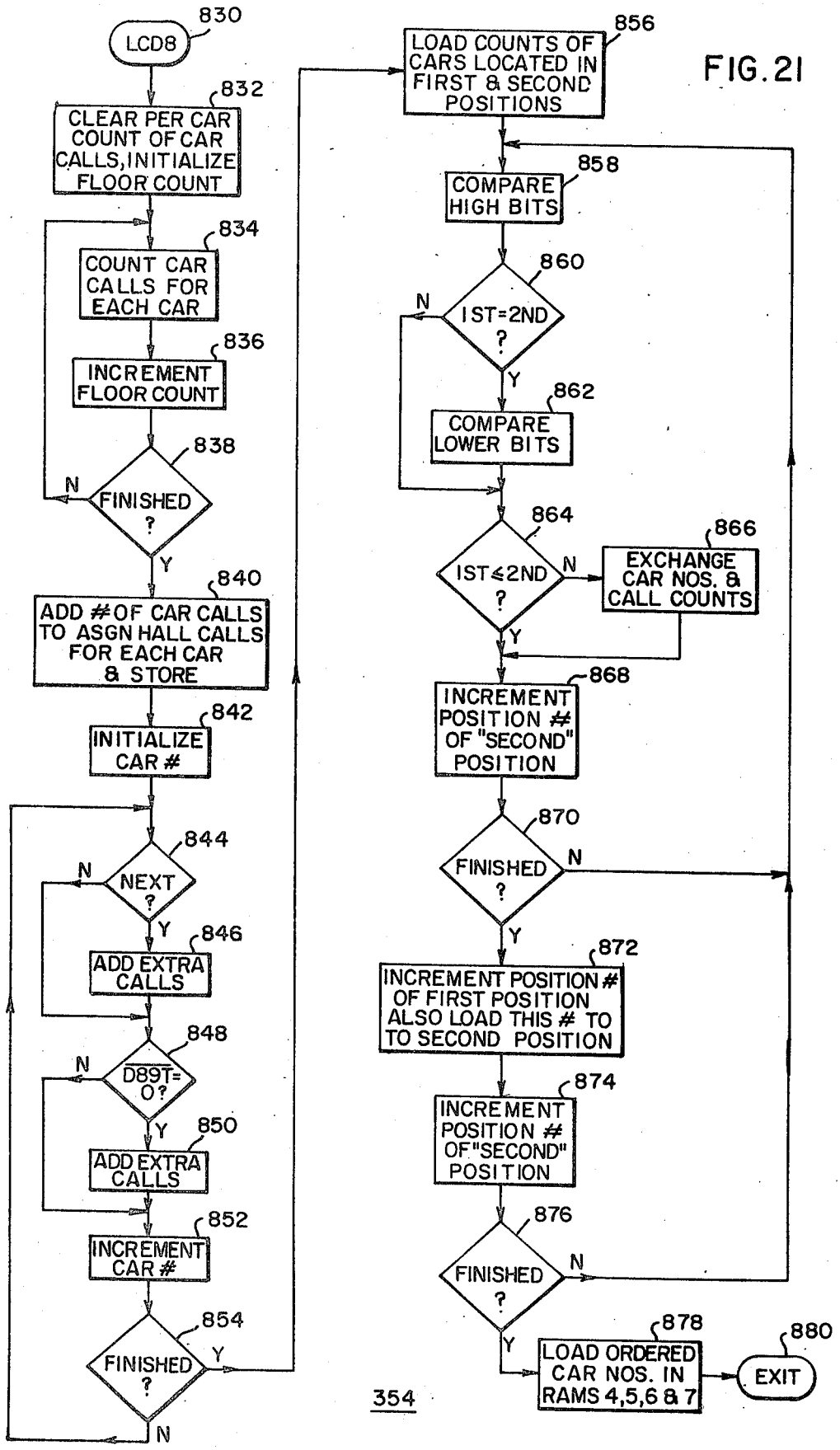

FIG. 21 is a flow chart of a sub-program LCD8 which may be used for function 354 in FIG. 9, which function assigns the order in which the cars are considered when scan slots are assigned thereto in step 356 of FIG. 9.

Sub-program LCD8 is entered at terminal 830 and step 832 clears the status character memories of RAMS 4, 5, 6 and 7 of the car call counts stored therein. Step 832 also initializes the floor count. Step 834 checks for car calls for the cars in the first scan slot, using the first 4-bit word from the main memory of RAM 3, in which the car calls 3Z are stored. If a car call is detected for a car, it is added to the car call count for the car. Step 836 increments the floor count and step 838 checks to see if all floors have been considered. If not, the program loops back to step 834. If they have all been considered, step 840 adds the number of car calls each car has to the number of hall calls assigned to the car, and the sums are stored in a temporary location.

Step 842 then initializes the car count, and step 844 determines if the car has the NEXT assignment by examining the bit of word NEXT in the main memory of RAM 4 which is associated with this car. If the car is NEXT, step 846 adds to the car and hall call total associated with this car an arbitrary number of calls, with the arbitrary number being of sufficient magnitude to assure that the NEXT car has a larger number than any other car could possibly have.

Step 848 checks to see if the motor-generator set associated with the drive motor of the elevator car has been shut down. This is accomplished by checking the bit of word $\overline{\text{D89T}}$ stored in the main memory of RAM 0. If the $\overline{\text{D89T}}$ bit is zero, indicating the motor-generator set is shut down, step 850 adds extra calls to the car and hall call sum for that car, with the magnitude of the extra calls being selected such that the car will have the largest number if there is no car with the NEXT assignment, and the second largest number in the event there is a car with the NEXT assignment.

Step 852 increments the car count and step 854 checks to see if all cars have been considered. If not, the program loops back to step 844. If all the cars have been considered, the program advances to step 856.

Steps 856 through 876 order the cars according to the magnitudes of the numbers just prepared for the cars in the earlier part of LCD8, with the first car in the order having the least number of calls, etc. Any sorting or ordering technique may be used. The technique illustrated in FIG. 21 starts with the cars in a predetermined order, such as the order 0, 1, 2 and 3, using car numbers, and compares the cars a pair at a time, exchanging the positions of the cars whenever the number of calls associated with a car to the right of the other car is smaller.

There are four positions for the cars, for a four car bank, and these four positions will be given the numbers 1, 2, 3 and 4 starting from the left hand position, and it should be noted that the position number is not related to the number of the car. Using the position numbers, the comparison sequence for a four car bank would be as shown in Table I:

TABLE I

| STEPS | COMPARISON POSITION | COMPARISON POSITION |
|---|---|---|
| 1 | 1 | 2 |
| 2 | 1 | 3 |
| 3 | 1 | 4 |
| 4 | 2 | 3 |
| 5 | 2 | 4 |
| 6 | 3 | 4 |

The technique of Table I is implemented, starting with step 856. Step 856 loads the call counts of the cars located in the first and second positions, to begin step 1 of the table. Step 858 compares the most significant bits of the call counts and step 860 checks to see if they are equal. If not, no further comparison is necessary and the program proceeds to step 864 which asks if the first call count is equal to or less than the second call count. If step 860 finds the most significants bits are equal, step 862 compares the lower bits and then proceeds to step 864.

If step 864 finds that the first count is not less than or equal to the second count, step 866 exchanges the car numbers and their call counts, moving the number of the car in the second position to the first position, and the number of the car in the first position to the second position. If the first call count is equal to or less than the second, the car numbers are in the correct order, as far as this pair is concerned, and step 864 proceeds to step 868, which is where step 866 proceeds after exchanging car numbers.

Step 868 increments the position number of the second position, which is step 2 of Table I, to compare the call count of the car in position 1 with the call count of the car in position 3. Step 870 checks to see if the car in the first position has been compared with all of the other cars, and if not the program loops back to step 858. Thus, the program loops back to perform steps 2 and 3 of Table I, and then step 870 would find that the loop is complete and the program advances to step 872.

Step 872 increments the position number of the first position, i.e., changes the 1 to a 2, and also loads this number (2) to the second position. Step 874 then increments the number of the second position, to provide the number 3. Thus, after step 874, the call counts of cars in positions 2 and 3 are compared, which is step 4 of the table.

Step 876 checks to see if this second phase of the comparison has been completed, and since it has not, the program loops back to step 858 to make the comparison of step 4 of Table I. Upon reaching step 868, the second position would be incremented to compare the cars in positions 2 and 4, which is step 5 of Table I, and the program would loop back from step 870 to step 858 to make this comparison.

Step 870 would then find that the second phase of the comparison has been completed, step 872 would increment the position number of the first position, to advance it to a 3, and the number 3 would be loaded to the second position. Step 874 increments the number of the second position to make it a 4, and thus the cars in positions 3 and 4 are ready to be compared, which is step 6 of Table I. The program loops back to step 858 to make this comparison, and would proceed through the "yes" branches of steps 870 and 876 since there is only one comparison in the third phase.

Step 878 loads the ordered car numbers into the status character memories of RAMS 4, 5, 6 and 7.

Table II contains an example of the hereinbefore described sorting technique, with car 0 having a call count of 4, car 1 a count of 9, car 2 a count of 7 and car 3 a count of 3.

TABLE II

| POSITIONS | 1 | 2 | 3 | 4 |
|---|---|---|---|---|
| Starting order of cars (car number) | 0 | 1 | 2 | 3 |
| Step 1 (1–2) | 0 | 1 | 2 | 3 |
| Step 2 (1–3) | 0 | 1 | 2 | 3 |
| Step 3 (1–4) | 3 | 1 | 2 | 0 |
| Step 4 (2–3) | 3 | 2 | 1 | 0 |
| Step 5 (2–4) | 3 | 0 | 1 | 2 |
| Step 6 (3–4) | 3 | 0 | 2 | 1 |

FIG. 22

FIG. 22 is a flow chart of a sub-program LCD14 which may be used for function 356 shown in FIG. 9, which function assigns scan slots to the cars. The scan slots are assigned in three passes for each set, with each pass processing all of the sets before starting the next pass. The sets are handled in the order of increasing number of cars per set, and the selection of cars to be scanned in each set is that order determined in LCD8 (FIG. 21).

Sub-program LCD14 is entered at terminal 890 and step 892 loads the car calls from RAM 3 to the main memories of the per car registers (RAMS 12–15). Step 893 checks to see if $A_{CB}$, the average number of hall calls per in-service car in the building, is equal to or greater than a predetermined minimum number. The size of this number determines when idle (IDLE) cars will be placed in service as traffic starts to build up in the building. If it is desired that two hall calls should start two cars, the minimum number may be set to 0. Setting the minimum number to 2 will require 3 hall calls to be seen by the same car before a second car will be started, etc.

If $A_{CB}$ is not equal to or greater than the minimum number, step 894 sets it equal to this minimum number and the program advances to step 895. If $A_{CB}$ is equal to or larger than the minimum, step 893 advances to step 895.

Step 895 initializes the assignment pass count, to start with assignment pass 1. Step 896 initializes the set count so the sets are taken in the order of increasing number of cars per set. As hereinbefore stated, the set numbers are binary numbers produced in the up and down masks, RAMS 10 and 9, respectively, by logic ones in each row associated with a floor level for each car enabled to serve the floor level. If the car is not enabled, its bit location for the floor has a logic zero. Step 898 calls the first set to be considered with a fetch instruction which accesses a look-up table in control memory 82 of FIG. 4. A binary counter set to count from 4 through 15 will call up to 12 sets, with this counter being incremented to call the next set. Sub-program LCD5 (FIG. 18) already made the assignments to the 1 car sets in step 712 thereof, which reduces the maximum number of sets to be considered in LCD14 from 16 to 12.

Step 900 checks to see if the set called is a valid set, since all possible multiple car set numbers will be examined. This is accomplished by checking to see if $A_{SI}$, the average number of scan slots in the set per in-service car enabled for the set, is zero. If so, it is an invalid set and the program advances to step 978 to advance the set count. If it is a valid set, $A_{SI}$ will be non-zero and step 902 loads the mask for this set to the main memory of the per car registers (RAMS 12–15). The mask for the set exposes the floors of the set, i.e., a logic one is located at each floor of the set corresponding to each car which can serve the set, and all other bit locations will be a logic zero.

Step 904 initializes the car count and loads the 4-bit words INSV and UPSCAN, stored in RAM 0, to a temporary location. Step 906 checks the INSV bit for the first car considered, and if the car is not in-service, the program advances to step 974, which increments the car count. If the car is in-service, step 908 checks to see if the car is enabled for this set. If it is not, the mask in the per car register will have a zero for this car, and the program advances to step 974.

If the car is in the set, the program starts the first assignment pass with step 910. Step 910 checks to see if this car has been given the NEXT assignment. If it has, step 914 gives this car the main floor up scan slot assignment, and if there are any available cars according to the floor selectors, checked in step 916, not counting cars with NEXT or CONV assignments, the NEXT car is not given any additional assignments, and the program advances to step 974. If the word AVAS is zero, indicating no available cars according to the floor selectors, the NEXT car may be given additional assignments, and the program advances to step 918.

If the car was not NEXT, step 912 determines if this is the first assignment pass. If it is, the AVAS bit for the car is checked, in step 918 to see if the car is available according to its floor selector. If it is available, step 920 assigns this car the up and down scan slots associated with the floor at which the car is located, and the program advances to step 922. If the car is not available the program advances directly to step 922.

Step 922 determines if the car has been given a convention floor assignment by checking the appropriate bit of the word CONV. If this bit is a one, step 924 assigns the up and down scan slots associated with the convention floor to this car. If the CONV bit is not a one, the program advances to step 926 which initializes the scan count and clears the variables $N_{DIST}$, $N_{SI}$ and $N_{CI}$. The scan counts, relative to the three scans, scan 1, scan 2 and scan 3, were hereinbefore described relative to LCD6 (FIG. 19). The variable $N_{DIST}$ is used to count the valid scan slots the counting and assignment sequence has progressed from the car, so far in the assignment routine. The variable $N_{SI}$ is used to count the number of scan slots assigned to the car so far in the set being considered. The variable $N_{CI}$ is used to count the number of hall calls assigned to a car so far in the set being considered.

Step 928 determines the parameters for the scan, ie., the number to be subtracted from the floor level of the car for an up or down traveling car so the slot address may be determined, and step 930 subtracts the parameter from the scan to determine the slot address. The three slot addresses for an up traveling car, which start the scans for scanning ahead of the car, scanning in the direction opposite to the car travel direction, and scanning behind the car, are $N_{CP-1}$, $\overline{N_{CP-1}}$ and $N_{CP} - \overline{N_{POS+1}}$, respectively, where $N_{CP}$ is a counter initialized such that the count will be 15 when the counter is incremented by one for each floor from the car position to the terminal in the direction of the scan, and $N_{POS}$ is the scan slot number which corresponds to the position of the car. The three scan slot addresses for a down traveling car, which start the scans for scanning ahead of the car, scanning in the direction opposite to the car travel direction, and scanning behind the car, are $\overline{N_{CP-1}}$, $N_{CP-1}$ and $\overline{N_{CP-}(N_{POS+1})}$.

The program assigns scan slots to AVAS cars without limitation as to the travel distance from the car to the floor associated with the assigned scan slot. The program does, however, restrict the assignment of scan slots to the busy cars, based on the travel distance from the car to the floor and service direction of the scan slot, using the present travel distance direction of the car rather than the physical separation of the car from the floor associated with the scan slot. For example, in a 16 floor building an up traveling car at the 3rd floor is the equivalent of 27 floors from a down call at the second floor while the physical separation is 1 floor. For purposes of example the distance limitation applied to the assigning of scan slots is one-half of a round trip for a car. This is conveniently figured by subtracting the level of the lowest floor the car is enabled to serve from the highest.

More specifically, step 932 increments $N_{DIST}$ and step 934 determines if the scan slot is enabled by checking the set mask. Step 936 checks the AVAS bit for the car in RAM 0. If the car is available the AVAS bit will be a one, and the car is not subject to the ½ round trip limitation. If the car is not available, step 938 determines if $N_{DIST}$ is less than or equal to a half round trip for the car. As hereinbefore stated, a half round trip for a car is determined by subtracting the lowest floor level which the car is enabled to serve from the highest floor level the car is enabled to serve. If the building has 16 levels and the car is enabled for all floors, a half round trip would be 15 floors. If step 938 finds that $N_{DIST}$ is greater than a half round trip, the program advances to step 974. If $N_{DIST}$ is equal to or less than a half round trip, step 940 checks to see if the scan slot has already been assigned. If it has, the program advances to step 966, which increments the slot count. If the scan slot has not been assigned, step 942 determines if this is the first pass. If it is, step 944 checks to see if the car has a registered car call. If it does not, the program advances to step 966, to increment the slot count. If the assignment routine is in the first pass and the car has a car call, or if the assignment routine is not in the first pass, the program advances to step 946, which checks to see if there is a registered hall call for the scan slot. If there is, step 948 determines if $N_{HCT}$, the total number of hall calls assigned to this car so far, plus one, is less than or equal to $A_{CB}$, the hall call average per car in the building. If $N_{HCT}$ plus one is greater than $A_{CB}$, the program advances to step 966. If $N_{HCT}$ plus one is equal to or less than $A_{CB}$, step 950 checks to see if the scan is in the third pass. If it is not, step 952 checks to see if $N_{CI}$ plus one is less than or equal to $A_{CI}$, where $N_{CI}$ is the number of hall calls assigned to the car so far in the set being considered, and $A_{CI}$ is the average number of calls per in-service car for the set being considered. If $N_{CI}$ plus 1 is greater than $A_{CI}$, the program advances to step 966. If $N_{CI}$ plus one is equal to or less than $A_{CI}$, the program advances to step 954. If step 950 determines the assignment is in the third pass, the limitation of step 952 is skipped, and the program goes directly to step 954. Step 954 increments $N_{CI}$ and $N_{HCT}$ and advances to step 962. Step 962 increments the variables $N_{SI}$ and $N_{SS}$, and step 964 assigns the scan slot to the car.

If step 946 determines there is no hall call in the slot, the program advances to step 956. Step 956 checks to see of the assignment is in the third pass. If it is not, the program advances to step 958 which determines if $N_{SI}$ plus one is equal to or less than $A_{SI}$. The variable $N_{SI}$ is the number of scan slots assigned to the car so far from the set being considered, and $A_{SI}$ is the average number of scan slots per in-service car for the set being considered. If $N_{SI}$ plus one is greater than $A_{SI}$, the program advances to step 966. If the $N_{SI}$ plus 1 is equal to or less than $A_{SI}$, step 960 checks to see if $N_{SS}$ plus 1 is less than or equal to $A_{SB}$. The variable $N_{SS}$ is equal to the total number of scan slots assigned to the car so far, and $A_{SB}$ is the average number of scan slots per in-service car for the building. If $N_{SS}$ plus 1 is greater than $A_{SB}$ the program advances to step 966. If it is equal to, or less than $A_{SB}$, the program advances to step 962, which increments $N_{SI}$ and $N_{SS}$, and step 964 assigns the scan slot to the car. If step 956 finds that the assignment is in the third pass, the limitations of steps 958 and 960 are skipped, and the program advances directly to step 962.

The program advances to step 966, which increments the scan slot count. Step 968 checks to see if the scan number has been completed. If it has not, the program loops back to step 930. If all the scan slots associated with the scan number have been completed, step 970 increments the scan count and the scan direction is reversed. Step 972 checks to see if all 3 phases (scan 1, scan 2 and scan 3) of the scan count have been completed. If the scan count hasn't been completed, the program loops back to step 928. If the scan count has been completed, the program advances to step 974 which increments the car count and shifts the UPSCAN and INSV words to expose the bits associated with the next car to be considered. Step 976 determines if the car count has been completed. If it has not, the program loops back to step 906. If it has been completed, the program advances to step 978 which increments the set count, to call the next set. Step 980 checks to see if all of the sets have been considered. If not, the program loops back to step 898. If all sets have been considered, the program advances to step 982 which increments the assignment pass count. Step 984 checks to see if the pass loop has been completed. If not, the program loops back to step 895. If the pass loop has been completed, the program exits at terminal 986.

The three assignment passes may be summarized as follows:

FIRST PASS

The NEXT car is given the main floor up assignment (step 914). AVAS and CONV cars are assigned the up and down scan slots associated with the floor at which the AVAS car is located, and the convention floor, respectively (steps 920 and 924). If the car has a car call for the floor associated with the scan slot being considered, the scan slot is assigned to the car, subject to predetermined limitations. Step 938 introduces the ½ round trip limitation for busy cars, and step 946 selects the remaining limitations to be applied, depending upon whether or not the scan slot being considered has a hall call associated therewith. If it does not have a hall call, the averages $A_{SI}$ (step 958) and $A_{SB}$ (step 960) are applied as limitations. If it does have a hall call the averages $A_{CB}$ (step 948) and $A_{CI}$ (step 952) are applied as limitations. If the car does not have a car call for the scan slot being considered, the scan slot is not assigned on this pass.

SECOND PASS

The NEXT car is given the main floor up assignment (step 914). This step is repeated even though it was included in the first pass to enable step 916 to be checked on all three passes, as it is desirable to remove the NEXT car from the assignment routine as soon as there is an available car in the system.

Steps 918, 920, 922 and 924, which relate to AVAS and CONV cars, are omitted on the second pass, since they were carried out on the first pass.

The second pass also skips step 944, which was active on the first pass, as the second pass considers unassigned scan slots without regard as to whether or not the car has a car call for the floor of the scan slot. The ½ round trip limitation for busy cars, and the averages $A_{SI}$, $A_{SB}$, $A_{CB}$ and $A_{CI}$ are applied as described relative to the first pass.

THIRD PASS

The NEXT car is again given the main floor up assignment, for the reasons pointed out relative to the second pass. Also similar to the second pass, steps 918, 920, 922, 924 and 944 are skipped.

On the third pass, unassigned (free) and empty (no hall call) scan slots are assigned to cars subject only to the ½ round trip limitation for busy cars, as the $A_{SI}$ and $A_{SB}$ limitations, active in steps 958 and 960, respectively, are skipped.

If the scan slot is unassigned but it has a hall call, the third pass is subject only to the ½ round trip limitation for busy cars and the $A_{CB}$ limitation, as the $A_{CI}$ limitation, active in step 952, is skipped.

Thus, if there are any in-service idle cars, all scan slots associated with floors will be assigned. If there are no in-service idle cars, it is possible that on a given run through the program that one or more scan slots associated with floors may not be assigned, due to the travel distance limitation in the assignment of scan slots. These scan slots will be assigned, as soon as some car moves to a position which satisfies the requirements of the program for assigning scan slots. Since no car is suitably located for promptly answering a call associated with an unassigned scan slot, it would do no good to assign the scan slot, or scan slots, until it is determined which car should be assigned scan slots according to the strategy of the program.

FIGURE 23

Figure 23:
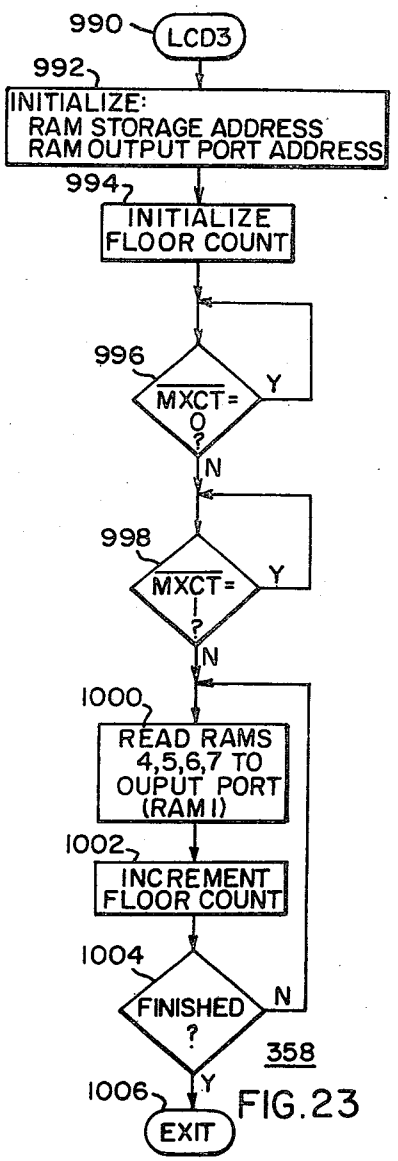

FIG. 23 is a flow chart of a subprogram LCD3 which may be used for function 358 shown in FIG. 9, which function loads the information stored in RAMS 4, 5, 6 and 7 (FIG. 5) to the output port of RAM 1 (FIG. 4), to send scan slot assignments and commands to the cars. Subprogram LCD3 is entered at terminal 990, step 992 initializes the RAM storage address and RAM output port address, and step 994 initializes the floor count. Steps 996 and 998 synchronize with the start of a scan cycle, using signal MXCT, as hereinbefore described relative to steps 364 and 366 in FIG. 10. Step 1000 reads RAMs 4, 5, 6 and 7 to the output port of RAM 1, one floor at a time, with steps 1002 and 1004 returning the program to step 1000 to read the information relative to the next floor. When all floors have been completed, step 1004 advances to the exit terminal 1006.

Figure 25:
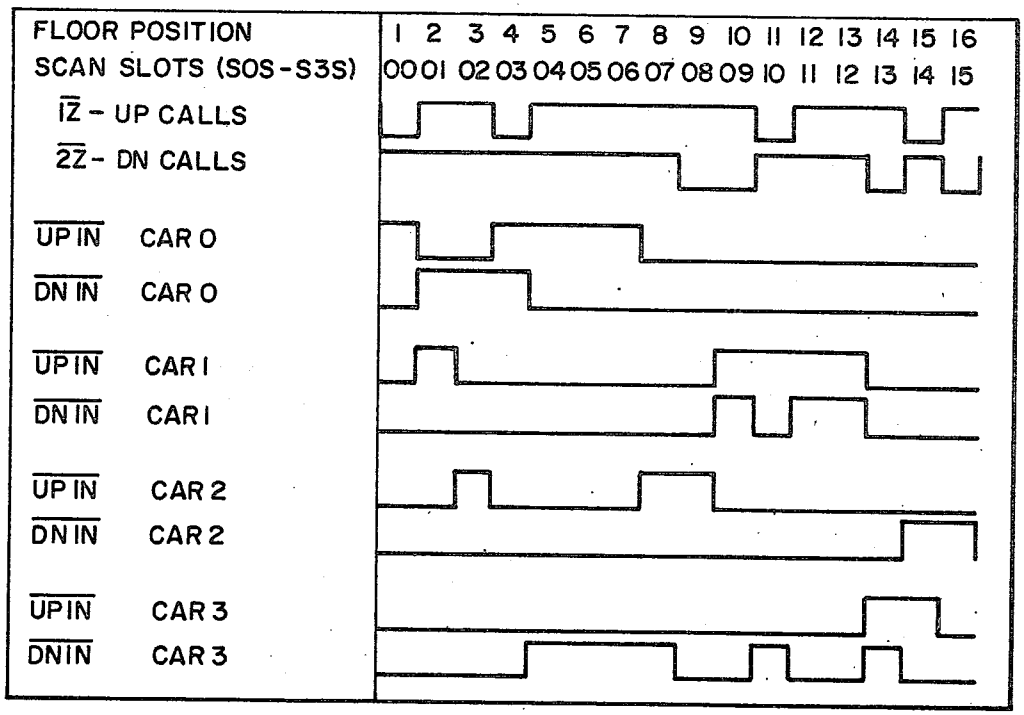
FIG. 25 is a timing diagram which illustrates the inhibit signals developed by the supervisory system control relative to the specific example shown in the chart of FIG. 24.

FIGURES 24 and 25

FIGS. 24 and 25 are charts used to illustrate the strategy of the invention relative to a specific example. As illustrated in FIG. 24, the building has 16 floors, served by four cars 0, 1, 2 and 3. The building has a main floor 1, two basements B1 and B2, and two top extension TE1 and TE2. Car 0 is enabled for both basements B1 and B2 and floors 1 through 12. Car 1 is enabled for basement B1 and floors 1 through 12. Cars 2 and 3 are enabled for floors 1 through 12 and both top extension TE1 and TE2. The valid sets are determined from the down and up call masks, RAMS 9 and 10. There are two scan slots in the one car set 0001. There are two scan slots in the two car set 0011. There are four scan slots in the two car set 1100, and there are 22 scan slots in the 4 car set 1111. There are 2 scan slots in the invalid set 0000. All other sets are empty. Table III tabulates the sets and the number of scan slots associated with each set, and also tabulates the $A_{SI}$ and $A_{CI}$ for each set. The average $A_{CI}$ is calculated using the number of hall calls listed in the Table.

TABLE III

| SETS | HALL CALLS | SCAN SLOTS | $A_{SI}$ | $A_{CI}$ |
|---|---|---|---|---|
| 0001 | 1 | 2 | 2 | 1 |
| 0011 | 0 | 2 | 1 | 0 |
| 1100 | 3 | 4 | 2 | 2 |
| 1111 | 4 | 22 | 6 | 1 |
| 0000 | X | 2 (invalid) | X | X |
| | | 32 TOTAL | | |

The cars are in the positions shown by the circles, with car 2 having the NEXT assignment at the main floor. The car calls are indicated with "CC". The hall calls are indicated with a "diamond" under the heating "Hall Calls". Function 332 of FIG. 9, detailed in LCD11, of FIG. 14, determines the average $A_{SB}$ for the building, and the averages $A_{SI}$ for the sets. The average $A_{SB}$ is 8, ie., 30 valid slots divided by 4 in-service cars. The averages $A_{SI}$ are determined by dividing the number of scan slots in a set by the number of in-service cars enabled for the set. They are listed in Table III and are stored in the proper set location in RAM 8 of FIG. 24. It will be noted that when the quotient is a fraction the next higher whole number is used.

Function 342 of FIG. 9 detailed in LCD11, FIG. 14, determines the average $A_{CB}$ for the building and the averages $A_{CI}$ of the sets. The average $A_{CB}$ is 2, 8 hall calls divided by 4 in-service cars. The averages $A_{CI}$ are determined by dividing the hall calls in a set by the number of in-service cars enabled to serve the set. They are also listed in Table III and are stored in the proper set location in RAM 2 of FIG. 24.

Table IV will aid in remembering the averages and limitations which apply to the three assignment passes.

TABLE IV

| ASSIGNMENT PASS | $A_{SB}$ | $A_{SI}$ | $A_{CB}$ | $A_{CI}$ | HALF ROUND TRIP LIMITATION |
|---|---|---|---|---|---|
| 1 | Yes | Yes | Yes | Yes | Yes |
| 2 | Yes | Yes | Yes | Yes | Yes |
| 3 | No | No | Yes | No | Yes |

On the first assignment pass, car 2, which has the NEXT assignment is given the main floor up assignment, indicated by an "X" in the up assignment table of FIG. 24. It will be assumed that there are no AVAS cars, so the NEXT car will be considered for further assignments, but it will be last in the priority order. It will also be assumed the convention floor feature is not active. It will be assumed that the car priority order, determined by LCD8 in FIG. 21 is 1, 3, 0, 2. Step 944 of LCD14 (FIG. 22) singles out the scan slots for which the cars have registered car calls. Car 1 has a car call for the 9th floor, and since it is set for up travel, it will be assigned scan slot 10-UP, associated with the 9th floor. The 9th floor has an up hall call registered, so this assignment automatically takes car of this coincident call.

Car 3 has a car call for the 12th floor, and since it is set for up travel, car 3 will be assigned scan slot 13-UP, associated with the 12th floor.

Car 0 has a car call for the main floor, and since it is set for down travel and is enabled to travel below the main floor, it will be assigned scan slot 02-DN, associated with the main floor. The main floor-down is part of set 0011 which has an $A_{SI}$ of 1. Therefore, this assignment to car 0 meets the $A_{SI}$ for set 0011 for car 0.

Car 2 has no car calls and receives no further assignments during the first pass. Thus, the first pass is completed, assigning the main floor up scan slot to the NEXT car, and the scan slots associated with registered car calls and the travel directions of the cars having the car calls. It will be remembered that LCD14 only assigns scan slots for those sets which are enabled for more than one car, as LCD5, FIG. 18 has already assigned the one car sets to their associated cars, ie., slot 00-UP and 01-DN were previously assigned to car 0.

On the second pass, the car priority order will still be 1, 3, 0, 2. Since there are no AVAS cars, the scan direction for assigning scan slots from the cars is the same as the car travel direction.

Pass 3 first takes set 0011. Scan slot 02-DN has already been assigned to car 0, so scan slot 01-UP is assigned to car 1. This completes the assignment of the two scan slots in set 0011.

Set 1100 is now taken, and car 3, which was assigned scan slot 13-UP on the first pass, is now assigned scan slot 14-UP, which meets the set average $A_{SI}$ of 2 and car 2, the other car enabled for this two car set, is assigned scan slots 15-DN and 14-DN. The assignment of scan slot 14-UP to car 3 takes care of the up hall call at TE1, and the assignment of scan slot 15-DN to car 2 takes care of the down hall call at TE2.

Set 1111 is now taken and car 1 is assigned scan slots 09-UP, 11-UP, 12-UP, 12-DN and 11-DN. The previous 10-UP assignment to car 1 has a hall call, which meets the set call average $A_{CI}$ of 1 for set 1111. Thus, slot 13-DN is not assigned to car 1, as it has a hall call registered. The assignment stops at scan slot 11-DN, as this meets the set average $A_{SI}$ of 6.

Car 3 is now assigned, starting from the car in an upwardly direction. Scan slot 12-UP was previously assigned to car 1. Thus, the first scan slot assigned to car 3, in this set, is 13-DN. Since this slot has a hall call, this meets the average, $A_{CI}$ of 1, and the average $A_{CB}$ of 2 and only scan slots without calls will be assigned to this car during the remainder of the second pass. Slots 12-DN and 11-DN were previously assigned to car 1, so the next slot assigned to car 3 is 10-DN. Scan slots 09-DN and 08-DN are skipped, since they have hall calls, and scan slots 07-DN, 06-DN, 05-DN and 04-DN are assigned to car 3. This meets the average $A_{SI}$ of six for this set, and the average $A_{SB}$ of 8. All of these scan slots are located within the ½ round trip limitation.

Car 0 is now assigned, starting at the car in a downward direction. Scan slot 04-DN has already been assigned to car 3 so scan slot 03-DN is the first to be assigned. The next scan slot assigned to car 0 is 03-UP. Since slot 03-UP has a hall call associated therewith, this meets the set call average $A_{CI}$ of 1 for car 0, and the average $A_{CB}$ of 2, and only scan slots without hall calls will now be assigned car 0 from this set on this pass. Thus, scan slots 04-UP, 05-UP, and 06-UP are assigned to car 0, meeting the building slot average $A_{SB}$ of 8, and the set slot average $A_{SI}$ of. In 6, and the assignments are within the ½ round trip limitation.

Car 2 is now assigned scan slots from set 1111, starting from the car and proceeding upwardly. The first free (unassigned) scan slot up in this set is 07-UP, and thus scan slots 07-UP and 08-UP are assigned to car 2. The next free scan slot is 09-DN, but this is beyond the ½ round trip limitation and will not be assigned to car 2. This completes the second pass, and all scan slots have been assigned except 09-DN and 08-DN, and both have a hall call registered.

The third pass assigns free scan slots, removing all restrictions imposed in the second pass except the building call average $A_{CB}$ and the ½ round trip limitation. The cars are taken in the same order, starting with car 1. Car 1 has only one call assigned thereto, so it will be assigned scan slot 09-DN. This scan slot is within the ½ round trip limitation, and it meets the building call average $A_{CB}$ of 2 for this car. Therefore, this car cannot be assigned scan slot 08-DN. Car 3 is then considered. Car 3 already has two hall calls assigned thereto, meeting the $A_{CB}$ of 2, and thus is not assigned slot 08-DN.

Car 0 also has two hall calls assigned thereto, meeting the $A_{CB}$ of 2, and thus this car will not be assigned to scan slot 08-DN.

Car 2 is the last to be considered, and since scan slot 08-DN is beyond its ½ round trip limitation, it will not be assigned to car 2. Thus, scan slot 08-DN will not be assigned on this running of the program.

FIG. 25 is a chart which illustrates the inhibit signals which would be provided by the system control 22 for the specific example of FIG. 24.

While the foregoing description sets forth the preferred embodiment of the invention, it is to be understood that certain alternative arrangements may be used, and that they fall within the scope of the invention. For example, the preferred embodiment uses "loop" scanning in assigning the scan slots to the cars, which includes the three assignment passes. This loop scanning, which starts at the car in the direction of travel and returns to the car position is preferred because it enables like numbered sets to be grouped regardless of which service direction the binary word for a floor is associated with. However, it would also be suitable to maintain the service direction distinction, and have "up" sets and "down" sets. Loop scanning would not be used in this instance, as the "up" sets would be assigned by scanning upwardly, and the "down" sets would be assigned by scanning downwardly.

Further, in the preferred embodiment, the general assignment assigns scan slots to a selected car until meeting one of the dynamic limiting averages $A_{SI}$ or $A_{SB}$, or the travel distance limitation for a busy car. It would also be suitable to assign one scan slot to one car at a time, proceeding from car to car, until each car reaches a dynamic limiting average, or the travel distance limitation.

```
000000000000 01010111  LCD0,  JMS                2007   /LCD0
             11010111
000000000010 01010011         JMS                768    /LCD1
             00000000
000000000100 00100000         FIM     P0         2
             00000010
000000000110 00100001         SRC     P0
000000000111 11101101         RDI
000000001000 11110001         CLC
000000001001 10010001         SUB     R1
000000001010 00011010         JCN     CZ         LCD0   /2 CARS IN S
ERVICE?
             00000000
000000001100 01010011         JMS                840    /LCD9
             01001000
000000001110 01010001         JMS                440    /LCD10
             10111000
000000010000 01010010         JMS                685    /LCD11
             10101101
000000010010 01010111  LA2,   JMS                2007   /LCD0
             11010111
000000010100 01010011         JMS                768    /LCD1
             00000000
000000010110 00100000         FIM     P0         32     /FLOOR ENABL
E
             00100000
000000011000 00100010         FIM     P1         176    /STORED FLOO
R ENABLE
             10110000
000000011010 00100001  LA4,   SRC     P0
000000011011 11101001         RDM
000000011100 10111111         XCH     R15
000000011101 00100011         SRC     P1
000000011110 11101001         RDM
000000011111 11110001         CLC
000000100000 10011111         SUB     R15
000000100001 00011100         JCN     AN         LCD0   /TEST BLDG.
CHANGE
             00000000
000000100011 01100001         INC     R1
000000100100 01110011         ISZ     R3         LA4
             00011010
000000100110 01010000         JMS                65     /LCD4
             01000001
000000101000 01010010         JMS                685    /LCD11
             10101101
000000101010 01010000         JMS                130    /LCD12
             10000010
000000101100 01010111         JMS                1792   /LCD13
             00000000
000000101110 01010010         JMS                512    /LCD5
             00000000
000000110000 01010001         JMS                256    /LCD6
             00000000
000000110010 01010100         JMS                1024   /LCD8
             00000000
000000110100 01010100         JMS                1201   /LCD14
             11000110
```

```
000000110110 01011000          JMS          2248     /LCD3
             11001000
000000111000 01000000          JUN          LA2
             00010010


SYMBOL TABLE:

 LA2    000000010010   LA4    000000011010   LCD0   000000100000
        *768
001100000000 00100000  LCD1,  FIM     P0     6
             00000110
001100000010 00100001         SRC     P0
001100000011 11101001          RDM                    /READ INSC
001100000100 10110010         XCH     R2
001100000101 01100001         INC     R1
001100000110 00100001         SRC     P0
001100000111 11101001         RDM                    /READ BYPS
001100001000 10110011         XCH     R3
001100001001 00100100  LB2,   FIM     P2     0
             00000000
001100001011 00100110         FIM     P3     192
             11000000
001100001101 11110000  LB4,  CLB
001100001110 10100010         LD      R2
001100001111 11110101         RAL
001100010000 10110010         XCH     R2
001100010001 11110111         TCC
001100010010 10111000         XCH     R8
001100010011 10100011         LD      R3
001100010100 11110101         RAL
001100010101 10110011         XCH     R3
001100010110 00010010         JCN     CN     *+8     /TEST BYPS
             00011110
001100011000 10101000         LD      R8
001100011001 11110110         RAR
001100011010 00011010         JCN     CZ     *+4     /TEST INSC
             00011110
001100011100 01100111         INC     R7
001100011101 01100101         INC     R5
001100011110 11110001         CLC
001100011111 10100101         LD      R5
001100100000 11110101         RAL
001100100001 10110101         XCH     R5
001100100010 01110110         ISZ     R6     LB4
             00001101
001100100100 10100101         LD      R5
001100100101 11110110         RAR
001100100110 10110101         XCH     R5
001100100111 11011001         LDM     9
001100101000 11110001         CLC
001100101001 10000001         ADD     R1
001100101010 00011100         JCN     AN     LB6
             00111000
001100101100 10100101         LD      R5
001100101101 11100100         WRO                    /LOAD INSV
001100101110 10110010         XCH     R2
001100101111 10100111         LD      R7
001100110000 11100101         WR1                    /LOAD N(SC)
001100110001 00100000         FIM     P0     9
             00001001
001100110011 00100001         SRC     P0
001100110100 11101001         RDM                    /READ AVAS*
001100110101 10110011         XCH     R3
001100110110 01000011         JUN     LB2
             00001001
```

```
001100111000 10100101  LB6,   LD      R5
001100111001 11110100          CMA
001100111010 11100000          WRM                    /LOAD AVAS*
001100111011 11000000          BBL     0


SYMBOL TABLE:

 LB2    0001100001001   LB6   0001100111000   LCD1  000110000000
 LB4    0001100001101
        *2007
011111010111 00100000  LCD2,  FIM     P0      0      /READ INPUTS
             00000000
011111011001 00100010         FIM     P1      0
             00000000
011111011011 00010001         JCN     TZ      *      /TEST MXCI
=0
             11011011
011111011101 00011001         JCN     TN      *      /TEST MXCI
=1
             11011101
011111011111 00100011  LD2,   SRC     P1
011111100000 11101010         RDR                    /READ CAR ST
ATUS
011111100001 00100001         SRC     P0
011111100010 11100000         WRM
011111100011 11010001         LDM     1
011111100100 10110000         XCH     R0
011111100101 00000000         NOP
011111100110 00000000         NOP
011111100111 00100011         SRC     P1
011111101000 11101010         RDR                    /READ CORR.
CALLS
011111101001 00100001         SRC     P0
011111101010 11100000         WRM
011111101011 11010010         LDM     2
011111101100 10110000         XCH     R0
011111101101 00000000         NOP
011111101110 00000000         NOP
011111101111 00100011         SRC     P1
011111110000 11101010         RDR                    /READ FL. EN
ABLES
011111110001 00100001         SRC     P0
011111110010 11100000         WRM
011111110011 11010011         LDM     3
011111110100 10110000         XCH     R0
011111110101 00000000         NOP
011111110110 00000000         NOP
011111110111 00100011         SRC     P1
011111111000 11101010         RDR                    /READ CAR CA
LLS
011111111001 00100001         SRC     P0
011111111010 11100000         WRM
011111111011 11010000         LDM     0
011111111100 10110000         XCH     R0
011111111101 01110001         ISZ     R1      LDR    /END FL. CONN
T
             11011111
011111111111 11000000         BBL     0
        *2248
100011001000 00100000  LCD3,  FIM     P0      64
             01000000
100011001010 00100010         FIM     P1      0
             00000000
100011001100 00100100         FIM     P2      6
             00000110
```

```
100011001110 00011001          JCN     TN      *       /TEST MXCT*
=1
             11001110
100011010000 00010001          JCN     TZ      *       /TEST MXCT*
=0
             11010000
100011010010 01110101          ISZ     R5      *
             11010010
100011010100 00100011          SRC     P1
100011010101 11011111          LDM     15
100011010110 11100001          WMP
100011010111 11110000          CLB
100011011000 11100001          WMP
100011011001 00100001  LE2,    SRC     P0
100011011010 11010101          LDM     5
100011011011 10110000          XCH     R0
100011011100 11101001          RDM
100011011101 00100011          SRC     P1
100011011110 11100001          WMP                     /LOAD COMMAN
DS
100011011111 00000000          NOP
100011100000 00000000          NOP
100011100001 00100001          SRC     P0
100011100010 11010110          LDM     6
100011100011 10110000          XCH     R0
100011100100 11101001          RDM
100011100101 00100011          SRC     P1
100011100110 11100001          WMP                     /LOAD DUMMY
CALLS
100011100111 00000000          NOP
100011101000 00000000          NOP
100011101001 00100001          SRC     P0
100011101010 11010111          LDM     7
100011101011 10110000          XCH     R0
100011101100 11101001          RDM
100011101101 00100011          SRC     P1
100011101110 11100001          WMP                     /LOAD UP ASS
IGNMENTS
100011101111 00000000          NOP
100011110000 00000000          NOP
100011110001 00100001          SRC     P0
100011110010 11010100          LDM     4
100011110011 10110000          XCH     R0
100011110100 11101001          RDM
100011110101 00100011          SRC     P1
100011110110 11100001          WMP                     /LOAD DN ASS
IGNMENTS
100011110111 01110001          ISZ     R1      LE2     /TEST FL. COU
NT
             11011001
100011111001 00100011          SRC     P1
100011111010 11110000          CLB
100011111011 11100001          WMP                     /CLEAR OUTPU
T PORTS
100011111100 11000000          BBL     0


SYMBOL TABLE:

 LCD3   0100011001000   LE2   0100011011001
        *65
000001000001 00100000  LCD4,   FIM     P0      32
             00100000
000001000011 00100010          FIM     P1      240
             11110000
```

```
000001000101 00100100          FIM     P2      16
             00010000
000001000111 00100110          FIM     P3      160
             10100000
000001001001 00101000          FIM     P4      144
             10010000
000001001011 11110000          CLB
000001001100 00100001  LF2,    SRC     P0
000001001101 11100000          WRM                     /CLEAR RAM R
EGISTERS
000001001110 00100011          SRC     P1
000001001111 11100000          WRM                     /CLEAR RAM R
EG.
000001010000 01100011          INC     R3
000001010001 01110001          ISZ     R1      LF2
             01001100
000001010011 00100001          SRC     P0
000001010100 11100100          WRO
000001010101 00100011          SRC     P1
000001010110 11100100          WRO
000001010111 00100101  LF4,    SRC     P2
000001011000 11101001          RDM
000001011001 11110110          RAR
000001011010 00011010          JCN     CZ      LF6     /TEST UP CALL
 =1
             01101010
000001011100 10111111          XCH     R15
000001011101 00100111          SRC     P3
000001011110 11101001          RDM
000001011111 00010100          JCN     AZ      LF6     /TEST UP MASK
             01101010
000001100001 10110001          XCH     R1
000001100010 00100001          SRC     P0
000001100011 11101001          RDM
000001100100 11110010          IAC                     /INCR. SET T
OTAL
000001100101 11100000          WRM
000001100110 11101100          RDO
000001100111 11110010          IAC                     /INCR. BLDG.
 TOTAL
000001101000 11100100          WRO
000001101001 10111111          XCH     R15
000001101010 11110110  LF6,    RAR
000001101011 00011010          JCN     CZ      LF8     /TEST DN CALL
 =1
             01111001
000001101101 00101001          SRC     P4
000001101110 11101001          RDM
000001101111 00010100          JCN     AZ      LF8+4   /TEST DN MASK
             01111101
000001110001 10110011          XCH     R3
000001110010 00100011          SRC     P1
000001110011 11101001          RDM
000001110100 11110010          IAC                     /INCR. SET T
OTAL
000001110101 11100000          WRM
000001110110 11101100          RDO
000001110111 11110010          IAC                     /INCR. BLDG.
 TOTAL
000001111000 11100100          WRO
000001111001 01100101  LF8,    INC     R5
000001111010 01100111          INC     R7
000001111011 01111001          ISZ     R9      LF4
             01010111
000001111101 00100000          FIM     P0      33
             00100001
```

```
000001111111 00100010          FIM     P1      241
             11110001
000010000001 11000000          BBL     0


SYMBOL TABLE:

 LCD4  0000001000001   LF4   0000001010111   LF8   0000001111001
 LF2   0000001001100   LF6   0000001101010
        *512
001000000000 00100000  LCD5,  FIM     P0      12      /TRANSFER CA
R POS.
             00001100
001000000010 00100110         FIM     P3      0
             00000000
001000000100 11011100         LDM     12
001000000101 10110000         XCH     R0
001000000110 00100111         SRC     P3
001000000111 11101001         RDM
001000001000 11110110         RAR
001000001001 11100000         WRM
001000001010 11110111         TCC
001000001011 00100001         SRC     P0
001000001100 11100000         WRM
001000001101 01110000         ISZ     R0      *-7
             00000110
001000001111 01100111         INC     R7
001000010000 01110001         ISZ     R1      *-12
             00000100
001000010010 00100000         FIM     P0      192     /CLEAR PER C
AR REG.
             11000000
001000010100 11011100         LDM     12
001000010101 10110011         XCH     R3
001000010110 11011111         LDM     15
001000010111 10110001         XCH     R1
001000011000 11110000         CLB
001000011001 00100001         SRC     P0
001000011010 11110101         RAL
001000011011 11101011         ADM
001000011100 10110001         XCH     R1
001000011101 11111000         DAC
001000011110 10110001         XCH     R1
001000011111 11110001         CLC
001000100000 01110011         ISZ     R3      *-7
             00011001
001000100010 11100100         WRO
001000100011 01110000         ISZ     R0      *-15
             00010100
001000100101 00100000         FIM     P0      192
             11000000
001000100111 11110000         CLB
001000101000 00100001         SRC     P0
001000101001 11100000         WRM
001000101010 01110001         ISZ     R1      *-2
             00101000
001000101100 11100101         WR1
001000101101 11100110         WR2
001000101110 11100111         WR3
001000101111 01110000         ISZ     R0      *-8
             00100111
001000110001 00100000         FIM     P0      192
             11000000
001000110011 00100010         FIM     P1      160
             10100000
```

```
001000110101 00100100          FIM     P2      96
             01100000
001000110111 00100110          FIM     P3      16
             00010000
001000111001 00101110          FIM     P7      16
             00010000
001000111011 00100011  LG2,    SRC     P1
001000111100 11101001          RDM                     /READ UP MAS
K
001000111101 00010100          JCN     AZ      LG6     /MASK WORD =0
             10000110
001000111111 11111100          KBP
001001000000 10111100          XCH     R12
001001000001 10101100          LD      R12
001001000010 11110100          CMA
001001000011 00011100          JCN     AN      LG8     /TEST FOR SIN
GLE CAR
             10001011
001001000101 00100111          SRC     P3
001001000110 11101001          RDM
001001000111 11110110          RAR
001001001000 10101110          LD      R14
001001001001 00011100          JCN     AN      *+5     /TEST FOR CO
RR. CALL
             01001110
001001001011 11101001          RDM
001001001100 11110110          RAR
001001001101 11110110          RAR
001001001110 00011010          JCN     CZ      LG6
             10000110
001001010000 00100101          SRC     P2
001001010001 11101001          RDM
001001010010 00010100          JCN     AZ      LG4     /CAR ASSIGNED
?
             01110100
001001010100 11111100          KBP
001001010101 10111100          XCH     R12
001001010110 10101100          LD      R12
001001010111 11110100          CMA
001001011000 00010100          JCN     AZ      LG6     /TEST FOR VAL
ID ASS.
             10000110
001001011010 11110010          IAC
001001011011 10111111          XCH     R15
001001011100 00100011          SRC     P1
001001011101 11101001          RDM
001001011110 11110110          RAR
001001011111 01111111          ISZ     R15     *-1
             01011110
001001100001 00011010          JCN     CZ      LG6
             10000110
001001100011 11110001          CLC
001001100100 11011011          LDM     11
001001100101 10001100          ADD     R12
001001100110 10110000          XCH     R0
001001100111 00100001          SRC     P0
001001101000 11101111          RD3
001001101001 11110010          IAC                     /INCR. NCRCC
)
001001101010 11100111          WR3
001001101011 10101110          LD      R14
001001101100 11110110          RAR
001001101101 11010011          LDM     3
001001101110 00010010          JCN     CN      *+3
             01110001
```

```
001001110000 11011100          LDM     12
001001110001 11110001          CLC
001001110010 11101011          ADM
001001110011 11100000          WRM
001001110100 01100001  LG4,    INC     R1
001001110101 01100011          INC     R3
001001110110 01100101          INC     R5
001001110111 01110111          ISZ     R7      LG2     /END FL. LOOP
             00111011
001001111001 10101110          LD      R14
001001111010 00010100          JCN     AZ      LG10
             10101000
001001111100 00100000          FIM     P0      192
             11000000
001001111110 00100010          FIM     P1      144
             10010000
001010000000 00100100          FIM     P2      112
             01110000
001010000010 00101110          FIM     P7      0
             00000000
001010000100 01000010          JUN             LG2
             00111011
001010000110 00100101  LG6,    SRC     P2
001010000111 11010000          LDM     0
001010001000 11100000          WRM                     /CLEAR ASS.
001010001001 01000010          JUN             LG4
             01110100
001010001011 11011011  LG8,    LDM     11
001010001100 11110001          CLC
001010001101 10001100          ADD     R12
001010001110 10110000          XCH     R0
001010001111 00100111          SRC     P3
001010010000 11101001          RDM                     /READ CORR.
CALL
001010010001 11110110          RAR
001010010010 10101110          LD      R14
001010010011 00011100          JCN     AN      *+5     /TEST FOR CO
RR. CALL
             10011000
001010010101 11101001          RDM
001010010110 11110110          RAR
001010010111 11110110          RAR
001010011000 00011010          JCN     CZ      *+6
             10011110
001010011010 00100001          SRC     P0
001010011011 11101101          RD1
001010011100 11110010          IAC                     /INCR. N(CC)
001010011101 11100101          WR1
001010011110 00100001          SRC     P0
001010011111 11101110          RD2
001010100000 11110010          IAC                     /INCR. N(SS)
001010100001 11100110          WR2
001010100010 00100011          SRC     P1
001010100011 11101001          RDM
001010100100 00100101          SRC     P2
001010100101 11100000          WRM                     /LOAD MASK W
ORD
001010100110 01000010          JUN             LG4
             01110100
001010101000 11000000  LG10,   BBL     0
```

SYMBOL TABLE:

```
LCD5  0001000000000   LG2   0001000111011   LG6   0001010000110
```

```
LG10   0001010101000   LG4    0001001110100   LG8    0001010001011
       *256
000100000000 00100000  LCD6,  FIM     P0      32
             00100000
000100000010 00100001         SRC     P0
000100000011 11101100         RDO                     /READ A(CB)
000100000100 10111111         XCH     R15
000100000101 11110001         CLC
000100000110 11010010         LDM     2
000100000111 10011111         SUB     R15
000100001000 00011010         JCN     CZ      *+4     /TEST A(CB)<
2
             00001100
000100001010 11010010         LDM     2
000100001011 11100100         WRO                     /SET A(CB) =
2
000100001100 00100000         FIM     P0      192
             11000000
000100001110 00100010         FIM     P1      96
             01100000
000100010000 00100100         FIM     P2      112
             01110000
000100010010 00101000         FIM     P4      32
             00100000
000100010100 00101001         SRC     P4
000100010101 11101100         RDO                     /READ A(CB)
000100010110 10111010         XCH     R10
000100010111 00101000         FIM     P4      8
             00001000
000100011001 00101001         SRC     P4
000100011010 11101001         RDM                     /READ UPTR
000100011011 10111011         XCH     R11
000100011100 10101011  LR2,   LD      R11
000100011101 11110110         RAR
000100011110 10111011         XCH     R11
000100011111 11110111         TCC
000100100000 10111110         XCH     R14
000100100001 00100001         SRC     P0
000100100010 11101101         RDI                     /READ N(HCI)
000100100011 10111100         XCH     R12
000100100100 11110000         CLB
000100100101 10101100         LD      R12
000100100110 10011010         SUB     R10
000100100111 00011010         JCN     CZ      LH8     /N(HCI)<A(CB
)
             00111111
000100101001 00100001  LH4,   SRC     P0
000100101010 11101001         RDM
000100101011 11110110         RAR
000100101100 00011010         JCN     CZ      *+5
             00110001
000100101110 00100011         SRC     P1
000100101111 11010000         LDM     0
000100110000 11100000         WRM                     /CLEAR CAR A
SSIGNMENTS
000100110001 00100001         SRC     P0
000100110010 11101001         RDM
000100110011 11110101         RAL
000100110100 00011010         JCN     CZ      *+5
             00111001
000100110110 00100101         SRC     P2
000100110111 11010000         LDM     0
000100111000 11100000         WRM                     /CLEAR CAR A
SSIGNMENTS
000100111001 01100001         INC     R1
000100111010 01100011         INC     R3
```

```
000100111011 01110101          ISZ     R5      LH4
             00101001
000100111101 01000001          JUN             LH24
             10100100
000100111111 00100110  LH8,    FIM     P3      13
             00001101
000101000001 10100111  LH10,   LD      R7
000101000010 11110110          RAR
000101000011 00011010          JCN     CZ      LH12    /TEST SCAN R
EVERSE
             01010111
000101000101 11110110          RAR
000101000110 00011010          JCN     CZ      LH14    /TEST SCAN F
ORWARD
             01011101
000101001000 10101110          LD      R14
000101001001 11110110          RAR
000101001010 00100001          SRC     P0
000101001011 11101100          RDO
000101001100 00011010          JCN     CZ      *+3
             01001111
000101001110 11110100          CMA
000101001111 11110010          IAC
000101010000 00010100          JCN     AZ      LH22    /TEST TERM.
FL.
             10100010
000101010010 10111001          XCH     R9
000101010011 10101001          LD      R9
000101010100 10110110          XCH     R6
000101010101 01000001          JUN             LH16
             01101010
000101010111 11010001  LH12,   LDM     1               /SCAN REVERS
E
000101011000 10111001          XCH     R9
000101011001 11010001          LDM     1
000101011010 10110110          XCH     R6
000101011011 01000001          JUN             LH16
             01101010
000101011101 10101110  LH14,   LD      R14             /SCAN FORWAR
D
000101011110 11110110          RAR
000101011111 00100001          SRC     P0
000101100000 11101100          RDO
000101100001 00010010          JCN     CN      *+3
             01100100
000101100011 11110100          CMA
000101100100 11110010          IAC
000101100101 00010100          JCN     AZ      LH22    /TEST TERM.
FL.
             10100010
000101100111 10111001          XCH     R9
000101101000 11010001          LDM     1
000101101001 10110110          XCH     R6
000101101010 11110000  LH16,   CLB
000101101011 10101001          LD      R9              /CALC. SLOT
ADDR.
000101101100 10010110          SUB     R6
000101101101 10110001          XCH     R1
000101101110 10101110          LD      R14
000101101111 00011100          JCN     AN      *+14
             01111101
000101110001 10110001          XCH     R1
000101110010 11110100          CMA
000101110011 10110001          XCH     R1
000101110100 10100001          LD      R1
000101110101 10110011          XCH     R3
```

```
000101110110 10100001          LD      R1
000101110111 10110101          XCH     R5
000101111000 00100001          SRC     P0
000101111001 11101001          RDM
000101111010 11110101          RAL
000101111011 01000001          JUN             LH18
             10000100
000101111101 10100001          LD      R1
000101111110 10110011          XCH     R3
000101111111 10100001          LD      R1
000110000000 10110101          XCH     R5
000110000001 00100001          SRC     P0
000110000010 11101001          RDM
000110000011 11110110          RAR
000110000100 00011010  LH18,    JCN     CZ      LH20    /TEST ASS.
             10011011
000110000110 10100111          LD      R7
000110000111 11110010          IAC
000110001000 00010100          JCN     AZ      *+12    /TEST SCAN B
EHIND
             10010100
000110001010 11101101          RD1
000110001011 11110001          CLC
000110001100 10011010          SUB     R10
000110001101 00010010          JCN     CN      *+7     /A(CB)<N(HCI
)
             10010100
000110001111 11101101          RD1
000110010000 11110010          IAC                     /IN(HCI)
000110010001 11100101          WR1
000110010010 01000001          JUN             LH20
             10011011
000110010100 00100011          SRC     P1
000110010101 10101110          LD      R14
000110010110 00011100          JCN     AN      *+3
             10011001
000110011000 00100101          SRC     P2
000110011001 11010000          LDM     0
000110011010 11100000          WRM                     /CLEAR ASS.
000110011011 01111001  LH20,    ISZ     R9      LH16    /INCR. FL.
COUNT
             01101010
000110011101 10111110          XCH     R14
000110011110 11110110          RAR
000110011111 11110011          CMC
000110100000 11110101          RAL
000110100001 10111110          XCH     R14
000110100010 01110111  LH22,    ISZ     R7      LH10    /INCR. SCAN
COUNT
             01000001
000110100100 01110000  LH24,    ISZ     R0      LH2     /INCR. CAR C
OUNT
             00011100
000110100110 11000000          BBL     0
```

SYMBOL TABLE:

| | | | | | |
|---|---|---|---|---|---|
| LCD6 | 0000100000000 | LH16 | 0000101101010 | LH22 | 0000110100010 |
| LH10 | 0000101000001 | LH18 | 0000110000100 | LH24 | 0000110100100 |
| LH12 | 0000101010111 | LH2 | 0000100011100 | LH4 | 0000100101001 |
| LH14 | 0000101011101 | LH20 | 0000110011011 | LH8 | 0000100111111 |

```
010000110000 11100000          WRM                          /LOAD MSB
010000110001 11010100          LDM     4
010000110010 10110011          XCH     R3
010000110011 00100011          SRC     P1
010000110100 10100010          LD      R2                   /LOAD ORDERE
D CAR #
010000110101 11100000          WRM
010000110110 01100000          INC     R0
010000110111 01110010          ISZ     R2      LK4          /TEST FOR NE
XT CAR
             00100001
010000111001 00100000          FIM     P0      67
             01000011
010000111011 00100001          SRC     P0                   /MG SET RUNN
ING
010000111100 11101001          RDM
010000111101 10111111          XCH     R15
010000111110 00100000          FIM     P0      11
             00001011
010001000000 00100001          SRC     P0
010001000001 11101001          RDM
010001000010 11110100          CMA
010001000011 10111110          XCH     R14
010001000100 00100000          FIM     P0      194          /ADDRESS OF
MSB
             11000010
010001000110 10111111  LK6,    XCH     R15
010001000111 11110110          RAR
010001001000 10111111          XCH     R15
010001001001 00011010          JCN     CZ      *+8          /TEST NEXT
             01010001
010001001011 00100001          SRC     P0
010001001100 11010010          LDM     2
010001001101 10110101          XCH     R5                   /LAST PRIORI
TY
010001001110 11101001          RDM
010001001111 10000101          ADD     R5
010001010000 11100000          WRM
010001010001 10111110          XCH     R14
010001010010 11110110          RAR
010001010011 10111110          XCH     R14
010001010100 00011010          JCN     CZ      *+8          /TEST MG SHU
T DOWN
             01011100
010001010110 00100001          SRC     P0
010001010111 11010001          LDM     1                    /NEXT TO LAS
T PRIORITY
010001011000 10110101          XCH     R5
010001011001 11101001          RDM
010001011010 10000101          ADD     R5
010001011011 11100000          WRM
010001011100 01110000          ISZ     R0      LK6          /END CAR LOOP
             01000110
010001011110 00100110          FIM     P3      192
        *1024
010000000000 00101000  LCD8,   FIM     P4      48
             00110000
010000000010 00100000          FIM     P0      76
             01001100
010000000100 00100001          SRC     P0                   /CLEAR COUNT
S
010000000101 11110000          CLB
010000000110 11100111          WR3
010000000111 01100000          INC     R0
010000001000 01110001          ISZ     R1      *-4
             00000100
```

```
010000001010 00101001  LK2,   SRC    P4                 /READ CAR CAL
LS
010000001011 11101001         RDM
010000001100 10111010         XCH    R10
010000001101 00100000         FIM    P0     76
             01001100
010000001111 10111010         XCH    R10
010000010000 11110110         RAR
010000010001 10111010         XCH    R10
010000010010 00011010         JCN    CZ     *+6
             00011000
010000010100 00100001         SRC    P0
010000010101 11101111         RD3                       /INCREMENT C
ALL COUNT
010000010110 11110010         IAC
010000010111 11100111         WR3
010000011000 01100000         INC    R0
010000011001 01110001         ISZ    R1     LK2+5
             00001111
010000011011 01111001         ISZ    R9     LK2
             00001010
010000011101 00100000         FIM    P0     64
             01000000
010000011111 00100010         FIM    P1     192
             11000000
010000100001 00100001  LK4,   SRC    P0
010000100010 11010011         LDM    3
010000100011 10110011         XCH    R3
010000100100 11101111         RD3                       /READ # OF C
AR CALLS
010000100101 10110101         XCH    R5
010000100110 00100011         SRC    P1
010000100111 11101101         RD1                       /READ N(HCT)
010000101000 11110001         CLC
010000101001 10000101         ADD    R5                 /ADD CAR AND
 CORR. CALLS
010000101010 00100011         SRC    P1
010000101011 11100000         WRM                       /LOAD LSB
010000101100 11010010         LDM    2
010000101101 10110011         XCH    R3
010000101110 00100011         SRC    P1
010000101111 11110111         TCC
             11000000
010001100000 00101000         FIM    P4     208
             11010000
010001100010 11010010  LK8,   LDM    2
010001100011 10110111         XCH    R7
010001100100 11010010         LDM    2
010001100101 10111001         XCH    R9
010001100110 00100111         SRC    P3
010001100111 11101001         RDM                       /READ FIRST
CAR MSB
010001101000 10110101         XCH    R5
010001101001 00101001         SRC    P4
010001101010 11101001         RDM                       /READ SECOND
 CAR MSB
010001101011 11110001         CLC
010001101100 10010101         SUB    R5                 /SUB. MSB OF
 FIRST CAR
010001101101 01100111         INC    R7
010001101110 01101001         INC    R9
010001101111 00011100         JCN    AN     LK10        /TEST MSB EQ
UALITY
             01111000
010001110001 00100111         SRC    P3
010001110010 11101001         RDM
```

```
010001110011 10110101          XCH    R5
010001110100 00101001          SRC    P4
010001110101 11101001          RDM
010001110110 11110001          CLC
010001110111 10010101          SUB    R5                  /SUB. LSB
010001111000 00010010  LK10,   JCN    CN     LK14         /TEST LSB IN
EQUALITY
             10001110
010001111010 11010010          LDM    2
010001111011 10110111          XCH    R7
010001111100 11010010          LDM    2
010001111101 10111001          XCH    R9
010001111110 11011101          LDM    13
010001111111 10110100          XCH    R4
010010000000 00100111  LK12,   SRC    P3
010010000001 11101001          RDM
010010000010 10110101          XCH    R5
010010000011 00101001          SRC    P4
010010000100 11101001          RDM
010010000101 10110101          XCH    R5
010010000110 11100000          WRM
010010000111 00100111          SRC    P3
010010001000 10110101          XCH    R5
010010001001 11100000          WRM
010010001010 01100111          INC    R7
010010001011 01101001          INC    R9
010010001100 01110100          ISZ    R4     LK12
             10000000
010010001110 01111000  LK14,   ISZ    R8     LK8
             01100010
010010010000 01100110          INC    R6
010010010001 10100110          LD     R6
010010010010 10111000          XCH    R8
010010010011 01111000          ISZ    R8     LK8
             01100010
010010010101 00100000          FIM    P0     64
             01000000
010010010111 00100010          FIM    P1     196
             11000100
010010011001 00100011  LK16,   SRC    P1
010010011010 11101001          RDM
010010011011 00100001          SRC    P0
010010011100 11100110          WR2
010010011101 01100000          INC    R0
010010011110 01110010          ISZ    R2     LK16
             10011001
010010100000 11000000          BBL    0
```

SYMBOL TABLE:

```
LCD9   0010000000000   LK14   0010010001110   LK4   0010000100001
LK10   0010001111000   LK16   0010010011001   LK6   0010001000110
LK12   0010010000000   LK2    0010000001010   LK8   0010001100010
```

```
       *840
001101001000 00100100  LCD9,   FIM    P2     144    /DN MASK
             10010000
001101001010 00100010  LM2,    FIM    P1     32     /FL. ENABLE
             00100000
001101001100 00100110          FIM    P3     176    /STORED FL.
ENABLE
             10110000
001101001110 00100000          FIM    P0     192    /PER CAR REG
.
             11000000
```

```
001101010000 00101000          FIM     P4      64
             01000000
001101010010 11110000          CLB
001101010011 00100001          SRC     P0
001101010100 11100111          WR3                     /CLEAR DELET
E FLAGS
001101010101 00101001          SRC     P4
001101010110 11100101          WR1                     /CLEAR Q(HRT
)
001101010111 01101000          INC     R8
001101011000 01110000          ISZ     R0      *-5
             01010011
001101011010 00100000          FIM     P0      192
             11000000
001101011100 00100011  LM4,    SRC     P1
001101011101 11101001          RDM                     /READ ENABLE
 WORD
001101011110 00100111          SRC     P3
001101011111 11100000          WRM                     /STORE ENABL
E WORD
001101100000 11110110          RAR
001101100001 10111111  LM6,    XCH     R15
001101100010 11010000          LDM     0
001101100011 00011010          JCN     CZ      *+3
             01100110
001101100101 11011000          LDM     8
001101100110 00100001          SRC     P0
001101100111 11100000          WRM                     /LOAD INHIBI
T TO PER CAR REG.
001101101000 10111111          XCH     R15
001101101001 11110110          RAR
001101101010 01110000          ISZ     R0      LM6
             01100001
001101101100 11011100          LDM     12
001101101101 10110000          XCH     P0              /INIT. CAR C
OUNT
001101101110 01100111          INC     R7
001101101111 01100011          INC     R3
001101110000 01110001          ISZ     R1      LM4
             01011100
001101110010 00100000          FIM     P0      192     /INIT. CAR C
OUNT
             11000000
001101110100 00101000          FIM     P4      64      /INIT. FL. C
OUNT
             01000000
001101110110 10100100  LM8,    LD      R4
001101110111 11110110          RAR
001101111000 10101001          LD      R9
001101111001 00010010          JCN     CN      *+3     /TEST DN MAS
K
             01111100
001101111011 11110100          CMA
001101111100 10110001          XCH     R1
001101111101 00100001          SRC     P0
001101111110 11101001          RDM
001101111111 00010100          JCN     AZ      LM12    /TEST MASK B
IT
             10001110
001110000001 11101111          RD3
001110000010 00011100          JCN     AN      LM10    /TEST DELETE
 FLAG
             10001010
001110000100 11110000          CLB
001110000101 11100000          WRM                     /DELETE MASK
 BIT
```

```
001110000110 11011111          LDM     15
001110000111 11100111          WR3                     /SET DELETE
FLAG
001110001000 01000011          JUN             LM12
             10001110
001110001010 00101011  LM10,   SRC     P5
001110001011 11101101          RD1
001110001100 11110010          IAC                     /INCR. Q(HRT
)
001110001101 11100101          WR1
001110001110 01111001  LM12,   ISZ     R9      LM8     /TEST FL. CO
UNT
             01110110
001110010000 01101000          INC     R8
001110010001 01110000          ISZ     R0      LM8     /TEST CAR CO
UNT
             01110110
001110010011 00100000          FIM     P0      192
             11000000
001110010101 11010000          LDM     0
001110010110 10110011          XCH     R3
001110010111 11110000  LM14,   CLB
001110011000 00100001          SRC     P0
001110011001 11101011          ADM                     /FORM MASK W
ORD
001110011010 11110110          RAR
001110011011 01110000          ISZ     R0      LM14+1
             10011000
001110011101 11110101          RAL
001110011110 00100101          SRC     P2
001110011111 11100000          WRM
001110100000 11011100          LDM     12
001110100001 10110000          XCH     R0
001110100010 01100101          INC     R5
001110100011 01110001          ISZ     R1      LM14
             10010111
001110100101 10100100          LD      R4
001110100110 11110110          RAR
001110100111 00011010          JCN     CZ      LM16
             10101101
001110101001 00100100          FIM     P2      160     /UP MASK
             10100000
001110101011 01000011          JUN             LM2
             01001010
001110101101 11000000  LM16,   BBL     0
```

SYMBOL TABLE:

| | | | | | |
|---|---|---|---|---|---|
| LCD9 | 0001101001000 | LM14 | 0001110010111 | LM4 | 0001101011100 |
| LM10 | 0001110001010 | LM16 | 0001110101101 | LM6 | 0001101100001 |
| LM12 | 0001110001110 | LM2 | 0001101001010 | LM8 | 0001101110110 |

```
        *440
000110111000 00100000  LCD10,  FIM     P0      128
             10000000
000110111010 00100010          FIM     P1      160
             10100000
000110111100 00100100          FIM     P2      240
             11110000
000110111110 00101110          FIM     P7      15
             00001111
000111000000 10101111  LM2,    LD      R15
000111000001 00011100          JCN     AN      LM4
             11000111
000111000011 00100000          FIM     P0      240
             11110000
```

```
000111000101 00100010          FIM     P1      144
             10010000
000111000111 11110000  LN4,    CLB
000111001000 00100001          SRC     P0
000111001001 11100000          WRM
000111001010 00100101          SRC     P2
000111001011 11100000          WRM
000111001100 01100101          INC     R5
000111001101 01110001          ISZ     R1      LN4
             11000111
000111001111 00100011          SRC     P1
000111010000 11100100          WRO
000111010001 00100011  LN6,    SRC     P1
000111010010 11101001          RDM                     /READ MASK W
ORD
000111010011 00010100          JCN     AZ      *+5     /TEST WORD =
0
             11011000
000111010101 11101100          RDO
000111010110 11110010          IAC                     /INCR. SLOT
TOTAL
000111010111 11100100          WRO
000111011000 11101001          RDM
000111011001 10110001          XCH     R1
000111011010 00100001          SRC     P0
000111011011 10110001          XCH     R1
000111011100 11101001          RDM
000111011101 11110010          IAC                     /INCR. SLOT
TOTAL FOR SET
000111011110 11100000          WRM
000111011111 01100011          INC     R3
000111100000 01110001          ISZ     R1      LN6     /END FL. LOO
P
             11010001
000111100010 10101111          LD      R15
000111100011 00010100          JCN     AZ      *+6
             11101001
000111100101 11010000          LDM     0
000111100110 10111111          XCH     R15
000111100111 01000001          JUN             LN2
             11000000
000111101001 00100000          FIM     P0      160
             10100000
000111101011 00100001          SRC     P0
000111101100 11101100          RDO
000111101101 00100000          FIM     P0      129
             10000001
000111101111 00100001          SRC     P0
000111110000 11100100          WRO                     /LOAD Q(5)
000111110001 00100011          SRC     P1
000111110010 11101100          RDO
000111110011 00100010          FIM     P1      241
             11110001
000111110101 00100011          SRC     P1
000111110110 11100100          WRO
000111110111 11000000          BBL     0


SYMBOL TABLE:

 LCD10 0000110111000   LN4   0000111000111   LN6   0000111010001
 LN2   0000111000000
        *685
001010101101 00100110  LCD11,  FIM     P3      0
             00000000
```

```
001010101111 00100111          SRC     P3
001010110000 11101101          RD1                     /READ A(SC)
001010110001 10111110                XCH     R14
001010110010 00100011          SRC     P1
001010110011 11101100          RDO
001010110100 11110001  LP2,  CLC
001010110101 10011110          SUB     R14
001010110110 01100111          INC     R7
001010110111 00010010          JCN     CN      LP2
             10110100
001010111001 10111000          XCH     R8
001010111010 00100001          SRC     P0
001010111011 11101100          RDO
001010111100 10001000          ADD     R8
001010111101 00011010          JCN     CZ      LP6
             11000100
001010111111 11110001  LP4,  CLC
001011000000 10011110          SUB     R14
001011000001 01100111          INC     R7
001011000010 00010010          JCN     CN      LP4
             10111111
001011000100 00100001  LP6,  SRC     P0
001011000101 10110111          XCH     R7
001011000110 00011100          JCN     AN      *+3
             11001001
001011001000 11011111          LDM     15
001011001001 11100100          WRO                     /LOAD A(CB)
OR A(SB)
001011001010 00100110  LP8,  FIM     P3      192
             11000000
001011001100 00101110          FIM     P7      0
             00000000
001011001110 00100011          SRC     P1
001011001111 11101001          RDM
001011010000 00011100          JCN     AN      LP10
             11010110
001011010010 00100001          SRC     P0
001011010011 11101001          RDM
001011010100 00010100          JCN     AZ      LP16    /TEST A(CI) O
R A(SI) =0
             11110010
001011010110 10100001  LP10, LD      R1
001011010111 11110110  LP12, RAR
001011011000 00011010          JCN     CZ      *+3
             11011011
001011011010 01101110          INC     R14
001011011011 01110110          ISZ     R6      LP12
             11010111
001011011101 00100011          SRC     P1
001011011110 11101001          RDM
001011011111 11110001          CLC
001011100000 10011110          SUB     R14
001011100001 01100111          INC     R7
001011100010 00010010          JCN     CN      *-3
             11011111
001011100100 00100001          SRC     P0
001011100101 11101011          ADM
001011100110 00011010          JCN     CZ      LP14
             11101101
001011101000 11110001          CLC
001011101001 10011110          SUB     R14
001011101010 01100111          INC     R7
001011101011 00010010          JCN     CN      *-3
             11101000
001011101101 10100111  LP14, LD      R7
```

```
001011101110 00011100          JCN     AN      *+3
             11110001
001011110000 11011111          LDM     15
001011110001 11100000          WRM                     /LOAD A(SI)
001011110010 01100011  LP16,   INC     R3
001011110011 01110001          ISZ     R1      LP8     /END SET COUNT
             11001010
001011110101 11000000          BBL     0


SYMBOL TABLE:

 LCD11  0001010101101   LP14  0001011101101   LP4   0001010111111
 LP10   0001011010110   LP16  0001011110010   LP6   0001011000100
 LP12   0001011010111   LP2   0001010110100   LP8   0001011001010
        *130
000010000010 00100000  LCD12,  FIM     P0      16
             00010000
000010000100 00100001          SRC     P0
000010000101 11101010          RDR                     /READ TIMER
WORD
000010000110 10110101          XCH     R5
000010000111 00100000          FIM     P0      128
             10000000
000010001001 00100001          SRC     P0
000010001010 11010010          LDM     2
000010001011 11100001          WMP
000010001100 00100000          FIM     P0      48
             00110000
000010001110 00100001          SRC     P0
000010001111 11101010          RDR                     /READ MAIN P
L.
000010010000 10111001          XCH     R9
000010010001 10101001          LD      R9
000010010010 11110110          RAR
000010010011 00011010          JCN     CZ      LR10    /TEST PEAK
FL. ENABLE
             11101101
000010010101 00100000          FIM     P0      7
             00000111
000010010111 00100001          SRC     P0
000010011000 11101110          RDR
000010011001 10110111          XCH     R7
000010011010 10100111          LD      R7
000010011011 11110101          RAL
000010011100 00010010          JCN     CN      LR10    /TEST PEAK =
1
             11101101
000010011110 11101001          RDM                     /READ TYPE
000010011111 10110100          XCH     R4
000010100000 10100100          LD      R4
000010100001 00010100          JCN     AZ      LR10    /TEST TYPE
             11101101
000010100011 01100001          INC     R1
000010100100 00100001          SRC     P0
000010100101 11101001          RDM                     /READ UPTR
000010100110 10111000          XCH     R8
000010100111 00100000          FIM     P0      6
             00000110
000010101001 00100001          SRC     P0
000010101010 11101001          RDM                     /READ INSC
000010101011 10110110          XCH     R6
000010101100 00100000          FIM     P0      192     /SET INITIAL
 CAR CONT
             11000000
```

```
000010101110 10110110  LR2,   XCH   R6
000010101111 11110110         RAR
000011110000 10110110         XCH   R6
000011110001 00011010         JCN   CZ    LR8    /TEST INSC B
IT
             11100101
000010110011 10100100         LD    R4
000010110100 11110110         RAR
000010110101 00011010         JCN   CZ    LR8    /TEST RYPS B
IT
             11100101
000010110111 00100001         SRC   P0
000010111000 11101100         RDO                /READ CAR PO
S.
000010111001 10111111         XCH   R15
000010111010 00100010         FIM   P1    32
             00100000
000010111100 00100011         SRC   P1
000010111101 11101010         RDR                /READ MNFL
000010111110 10111110         XCH   R14
000010111111 10101111         LD    R15
000011000000 11110001         CLC
000011000001 10011110         SUB   R14
000011000010 00010100         JCN   AZ    LR4    /TEST CAR PO
S.
             11010010
000011000100 00011010         JCN   CZ    LR8
             11100101
000011000110 10101000         LD    R8
000011000111 11110110         RAR
000011001000 00010010         JCN   CN    LR8    /TEST OPTR B
IT
             11100101
000011001010 00100010         FIM   P1    0
             00000000
000011001100 00100011         SRC   P1
000011001101 11011000         LDM   8
000011001110 11100110         WR2                /SET DOWN PE
AK
000011001111 10110111         XCH   R7
000011010000 01000000         JUN         LR6
             11011100
000011010010 10101000  LR4,   LD    R8
000011010011 11110110         RAR
000011010100 00011010         JCN   CZ    LR8    /TEST OPTR
             11100101
000011010110 00100010         FIM   P1    0
             00000000
000011011000 00100011         SRC   P1
000011011001 11011001         LDM   9
000011011010 11100110         WR2                /SET UP PEAK
000011011011 10110111         XCH   R7
000011011100 00100010  LR6,   FIM   P1    64
             01000000
000011011110 00100011         SRC   P1
000011011111 11010001         LDM   1
000011100000 11100001         WMP                /LOAD PEAK 1
IMER
000011100001 11010000         LDM   0
000011100010 11100001         WMP
000011100011 00011010         JCN   CZ    LR10   /IN PEAK?
             11101101
000011100101 10110100  LR8,   XCH   R4
000011100110 11110110         RAR
000011100111 10110100         XCH   R4
000011101000 10111000         XCH   R8
```

```
000011101001 11110110          RAR
000011101010 10111000          XCH      R8
000011101011 01110000          ISZ      R0       LR2       /END CHR LOO
P
             10101110
000011101101 10100111  LR10,   LD       R7
000011101110 11110101          RAL
000011101111 00011010          JCN      CZ       LR12      /TEST PEAK
=1
             11111111
000011110001 10100111          LD       R7
000011110010 11110110          RAR
000011110011 10100101          LD       R5
000011110100 00010010          JCN      CN       **3       /TEST JR PEA
K =1
             11110111
000011110110 11110110          RAR
000011110111 11110110          RAR
000011111000 00010010          JCN      CN       LR12      /TEST PEAK
TIMER
             11111111
000011111010 00100000          FIM      P0       0
             00000000
000011111100 00100001          SRC      P0
000011111101 11010000          LDF      0
000011111110 11100110          WR2                         /RESET PEAK
000011111111 11000000  LR12,   BBL      0


SYMBOL TABLE:

 LCD12 000001000010   LR2   000001010111   LR6   000001111100
 LR10  000001101101   LR4   000001101010   LR8   000001110101
 LR12  000001111111
       *1792
011100000000 00100000  LCD13,  FIM      P0       80        /CLEAR DUMMY
 CALLS
             01010000
011100000010 11110000          CLB
011100000011 00100001          SRC      P0
011100000100 11100000          WRM
011100000101 01110001          ISZ      R1       *-2
             00000011
011100000111 00100000          FIM      P0       32
             00100000
011100001001 00100001          SRC      P0
011100001010 11101010          RDR                         /READ MAIN F
L. POS.
011100001011 10110011          XCH      R3
011100001100 00100000          FIM      P0       64
             01000000
011100001110 11110000          CLB
011100001111 00100001          SRC      P0
011100010000 11100000          WRM                         /CLEAR SUT
011100010001 01100001          INC      R1
011100010010 00100001          SRC      P0
011100010011 11100000          WRM                         /CLEAR SDI
011100010100 01100001          INC      R1
011100010101 00100001          SRC      P0
011100010110 11100000          WRM                         /CLEAR DOPN
011100010111 01100001          INC      R1
011100011000 00100001          SRC      P0
011100011001 11101001          RDM                         /READ NEXT
011100011010 10111100          XCH      R12
011100011011 00100000          FIM      P0       9
             00001001
```

```
011100011101 00100001          SRC     P0
011100011110 11101001          RDM                     /READ AVAS*
011100011111 11110100          CMA
011100100000 10110111          XCH     R7
011100100001 00100000          FIM     P0      128     /RAM OUT POR
T 2
             10000000
011100100011 00100001          SRC     P0
011100100100 11010010          LDM     2
011100100101 11100001          WMP
011100100110 00100000          FIM     P0      48
             00110000
011100101000 00100001          SRC     P0
011100101001 11101010          RDR                     /READ FL. FE
ATURES
011100101010 11110101          RAL
011100101011 11111010          STC                     /SET MAIN=1
011100101100 11110110          RAR
011100101101 10111110          XCH     R14
011100101110 10101110  LS2,    LD      R14
011100101111 11110110          RAR
011100110000 00011010          JCN     CZ      LS4     /TEST ENABLE
             01010011
011100110010 11011011          LDM     11
011100110011 10110010          XCH     R2
011100110100 00100011          SRC     P1
011100110101 11101001          RDM
011100110110 00010100          JCN     AZ      LS4     /FLOOR SERVE
D
             01010011
011100111000 00100000          FIM     P0      0
             00000000
011100111010 00100001          SRC     P0
011100111011 11101110          RD2                     /READ PEAK
011100111100 10111001          XCH     R9
011100111101 10101001          LD      R9
011100111110 11110101          RAL
011100111111 00011010          JCN     CZ      LS6     /TEST PEAK
             01011111
011101000001 10101001          LD      R9
011101000010 11110110          RAR
011101000011 00011010          JCN     CZ      LS4     /TEST UP PEA
K
             01010011
011101000101 10101110          LD      R14
011101000110 11110101          RAL
011101000111 00011010          JCN     CZ      LS4     /TEST MAIN =
1
             01010011
011101001001 11110101          RAL
011101001010 00011010          JCN     CZ      LS4     /TEST LANTER
N =1
             01010011
011101001100 11010101          LDM     5
011101001101 10110010          XCH     R2
011101001110 00100011          SRC     P1
011101001111 11011111          LDM     15
011101010000 11100000          WRM                     /LOAD DUM. C
ALLS
011101010001 01000111          JUN             LS6
             01011111
011101010011 00100000  LS4,    FIM     P0      67
             01000011
011101010101 10101110          LD      R14
011101010110 11110101          RAL
```

```
011101010111 00010010          JCN     CN      *+3     /TEST MAIN=1
             01011010
011101011001 01100001          INC     R1
011101011010 00100001          SRC     P0
011101011011 11110000          CLB
011101011100 11100000          WRM                     /CLEAR NEXT
OR CONV.
011101011101 01001000          JUN             LS30
             01111010
011101011111 10101100  LS6,    LD      R12
011101100000 00011100          JCN     AN      *+4     /TEST ASS.
             01100100
011101100010 01001000          JUN             LS24
             00101101
011101100100 11111100          KBP                     /IDENTIFY CA
R
011101100101 10111111          XCH     R15
011101100110 11011011          LDM     11
011101100111 11110001          CLC
011101101000 10001111          ADD     R15
011101101001 10110100          XCH     R4              /STORE CAR #
011101101010 10100100          LD      R4
011101101011 10111111          XCH     R15
011101101100 00100000          FIM     P0      0
             00000000
011101101110 00100001          SRC     P0
011101101111 11101100          RDO
011101110000 11110101          RAL
011101110001 01111111          ISZ     R15     *-1
             01110000
011101110011 00011010          JCN     CZ      LS4     /TEST INSV
             01010011
011101110101 00100101          SRC     P2
011101110110 11101100          RDO
011101110111 11110001          CLC
011101111000 10010011          SUB     R3
011101111001 00010100          JCN     AZ      LS8     /TEST CAR AT
 FLOOR
             10000010
011101111011 11010101          LDM     5
011101111100 10110010          XCH     R2
011101111101 00100011          SRC     P1
011101111110 10101100          LD      R12
011101111111 11100000          WRM                     /ASS. DUM. C
ALL TO CAR
011110000000 01001000          JUN             LS30
             01111010
011110000010 00100000  LS8,    FIM     P0      13
             00001101
011110000100 00100001          SRC     P0
011110000101 10100100          LD      R4
011110000110 10111111          XCH     R15
011110000111 11101001          RDM                     /READ CALL*
011110001000 11110101          RAL
011110001001 01111111          ISZ     R15     *-1
             10001000
011110001011 00010010          JCN     CN      LS10     /TEST CALL*
=1
             10011001
011110001101 00100000          FIM     P0      67
             01000011
011110001111 10101110          LD      R14
011110010000 11110101          RAL
011110010001 00010010          JCN     CN      *+3     /TEST MAIN=1
             10010100
```

```
011110010011 01100001          INC     R1
011110010100 00100001          SRC     P0
011110010101 11110000          CLB
011110010110 11100000          WRM                     /CLEAR NEXT
OR CONV.
011110010111 01001000          JUN             LS24
             00101101
011110011001 10101110  LS10,    LD      R14
011110011010 11110101          RAL
011110011011 11110101          RAL
011110011100 00100101          SRC     P2
011110011101 11101100          RDO                     /READ CAR PO
S.
011110011110 00011010          JCN     CZ      *+3     /TEST LANTER
N DIR.
             10100001
011110100000 11110100          CMA
011110100001 10111111          XCH     R15             /INITIALIZE
SLOT COUNT
011110100010 10101111  LS12,    LD      R15
011110100011 10111011          XCH     R11             /LOAD SLOT A
DDR.
011110100100 10101110          LD      R14
011110100101 11110101          RAL
011110100110 11110101          RAL
011110100111 00011010          JCN     CZ      *+5     /TEST LANTER
N DIR.
             10101100
011110101001 10111011          XCH     R11
011110101010 11110100          CMA                     /COMPLEMENT
SLOT ADDR.
011110101011 10111011          XCH     R11
011110101100 11010001          LDM     1
011110101101 10111010          XCH     R10
011110101110 00101011          SRC     P5
011110101111 11101001          RDM                     /READ CORR. Calls
CALLS
011110110000 10110000          XCH     R0
011110110001 11010110          LDM     6
011110110010 10111010          XCH     R10
011110110011 10100000  LS14,    LD      R0
011110110100 11110110          RAR
011110110101 10110000          XCH     R0
011110110110 00011010          JCN     CZ      LS16    /TEST CORR. Call
CALL
             11000001
011110111000 00101011          SRC     P5
011110111001 10100100          LD      R4
011110111010 10111000          XCH     R8
011110111011 11101001          RDM
011110111100 11110101          RAL
011110111101 01111000          ISZ     R8      *-1
             10111100
011110111111 00010010          JCN     CN      LS18    /TEST CALL ENable
NABLE
             11001110
011111000001 11011001  LS16,    LDM     9
011111000010 11110001          CLC
011111000011 10001010          ADD     R10
011111000100 00010100          JCN     AZ      *+6     /TEST CALL D
IR.
             11001010
011111000110 11010111          LDM     7
011111000111 10111010          XCH     R10
011111001000 01000111          JUN             LS14
             10110011
```

```
011111001010 01111111          ISZ     R15     LS12    /END SLOT CO
UNT
             10100010
011111001100 01001000          JUN             LS20
             00000000
011111001110 00100000  LS18,   FIM     P0      64
             01000000
011111010000 10101110          LD      R14
011111010001 11110101          RAL
011111010010 11110101          RAL
011111010011 11110111          TCC
011111010100 01001000          JUN             LS22
             00011011
        *2048
100000000000 10101110  LS20,   LD      R14
100000000001 11110110          RAR
100000000010 11110110          RAR
100000000011 00011010          JCN     CZ      LS30    /TEST DOOR O
PEN EN.
             01111010
100000000101 00100000          FIM     P0      66
             01000010
100000000111 00100001          SRC     P0
100000001000 10100100          LD      R4
100000001001 10111111          XCH     R15
100000001010 11011011          LDM     11
100000001011 10111000          XCH     R8
100000001100 11101001          RDM
100000001101 11110101          RAL
100000001110 01101000          INC     R8
100000001111 01111111          ISZ     R15     *-2
             00001101
100000010001 11111010          STC
100000010010 11110101          RAL
100000010011 01111000          ISZ     R8      *-1
             00010010
100000010101 11100000          WRM                     /SET DOPN
100000010110 10101110          LD      R14
100000010111 11110101          RAL
100000011000 11110101          RAL
100000011001 11110011          CMC
100000011010 11110111          TCC
100000011011 10110001  LS22,   XCH     R1
100000011100 00100001          SRC     P0
100000011101 10100100          LD      R4
100000011110 10111111          XCH     R15
100000011111 11011011          LDM     11
100000100000 10111000          XCH     R8
100000100001 11101001          RDM
100000100010 11110101          RAL
100000100011 01101000          INC     R8
100000100100 01111111          ISZ     R15     *-2
             00100010
100000100110 11111010          STC
100000100111 11110101          RAL
100000101000 01111000          ISZ     R8      *-1
             00100111
100000101010 11100000          WRM                     /SET SUT OR
SDT
100000101011 01001000          JUN             LS30
             01111010
100000101101 11010000  LS24,   LDM     0
100000101110 10111101          XCH     R13             /CLEAR ASS.
FLAG
100000101111 00100100          FIM     P2      207     /SET CAR #'S
 & DIST.
```

```
                11001111
100000110001    10110111   LS26,   XCH    R7
100000110010    11110110           RAR
100000110011    10110111           XCH    R7
100000110100    00011010           JCN    CZ     LS28     /TEST CAR A
VAS
                01011111
100000110110    10100100           LD     R4
100000110111    10111111           XCH    R15
100000111000    11011011           LDM    11
100000111001    10110010           XCH    R2
100000111010    00100011           SRC    P1
100000111011    11101001           RDM                    /READ CAR IN
SV AT FL.
100000111100    11110101           RAL
100000111101    01111111           ISZ    R15    *-1
                00111100
100000111111    00011010           JCN    CZ     LS28     /TEST IN SE
RV. AT FL.
                01011111
100001000001    10100100           LD     R4
100001000010    10111111           XCH    R15
100001000011    00100000           FIM    P0     67
                01000011
100001000101    00100001           SRC    P0
100001000110    11101001           RDM                    /READ NEXT
100001000111    11110101           RAL
100001001000    01111111           ISZ    R15    *-1
                01000111
100001001010    00010010           JCN    CN     LS28     /TEST CAR F
OR NEXT
                01011111
100001001100    01101101           INC    R13            /SET ASS. FL
AG
100001001101    00100101           SRC    P2
100001001110    11101100           RDO
100001001111    11110001           CLC
100001010000    10010011           SUB    R3             /CALC. DIST.
 TO FL.
100001010001    00010010           JCN    CN     *+4
                01010101
100001010011    11110100           CMA
100001010100    11110010           IAC
100001010101    10111111           XCH    R15
100001010110    10100101           LD     R5
100001010111    11110001           CLC
100001011000    10011111           SUB    R15
100001011001    00011010           JCN    CZ     LS28     /CLOSER TO
FLOOR
                01011111
100001011011    10101111           LD     R15
100001011100    10110101           XCH    R5             /SUBSTITUTE
CAR DIST.
100001011101    10100100           LD     R4
100001011110    10110110           XCH    R6
100001011111    01110100   LS28,   ISZ    R4     LS26     /END CAR L
OOP
                00110001
100001100001    00100000           FIM    P0     67
                01000011
100001100011    10101110           LD     R14
100001100100    11110101           RAL
100001100101    00010010           JCN    CN     *+3      /TEST MAIN
                01101000
100001100111    01100001           INC    R1
```

```
100001101000 10100110          LD      R6
100001101001 10111111          XCH     R15
100001101010 11110000          CLB                     /FORM ASS. W
ORD
100001101011 11111010          STC
100001101100 11110110          RAR
100001101101 01111111          ISZ     R15     *-1
             01101100
100001101111 00100001          SRC     P0
100001110000 11100000          WRM
100001110001 10111100          XCH     R12
100001110010 10101101          LD      R13
100001110011 00010100          JCN     AZ      *+4
             01110111
100001110101 01000111          JUN             LS6
             01011111
100001110111 11110000          CLB
100001111000 11100000          WRM
100001111001 10111100          XCH     R12
100001111010 10101110  LS30,   LD      R14
100001111011 11110101          RAL
100001111100 00011010          JCN     CZ      LS32    /TEST MAIN
             10011101
100001111110 11011011          LDM     11
100001111111 10110010          XCH     R2              /EN. ADDR.
100010000000 00100011          SRC     P1
100010000001 11010001          LDM     1
100010000010 11100001          WMP                     /SELECT CONV
. POS.
100010000011 00100000          FIM     P0      48
             00110000
100010000101 00100001          SRC     P0
100010000110 11101010          RDR                     /READ CONV.
POS.
100010000111 10110011          XCH     R3
100010001000 10111111          XCH     R15
100010001001 00100000          FIM     P0      68
             01000100
100010001011 00100001          SRC     P0
100010001100 11101001          RDM
100010001101 10111100          XCH     R12             /LOAD CONV.
INTO ASS.
100010001110 11011011          LDM     11
100010001111 10110010          XCH     R2
100010010000 00100011          SRC     P1
100010010001 11010100          LDM     4
100010010010 11100001          WMP                     /SELECT CONV
. FL. FEATURE
100010010011 00100000          FIM     P0      48
             00110000
100010010101 00100001          SRC     P0
100010010110 11101010          RDR                     /READ CONV.
FL. FEATURE
100010010111 11110101          RAL
100010011000 11110001          CLC                     /SET MAIN=0
100010011001 11110110          RAR
100010011010 10111110          XCH     R14
100010011011 01000111          JUN             LS2
             00101110
100010011101 00101010  LS32,   FIM     P5      9
             00001001
100010011111 00101011          SRC     P5
100010100000 11101001          RDM                     /READ AVAS*
100010100001 11110100          CMA
100010100010 10110111          XCH     R7
```

```
100010100011 00100000          FIM     P0      67
             01000011
100010100101 00100001  LS34,   SRC     P0
100010100110 11101001          RDM                     /READ NEXT O
R CONV.
100010100111 00010100          JCN     AZ      LS36
             10111011
100010101001 11111100          KBP
100010101010 10111111          XCH     R15
100010101011 11011011          LDM     11
100010101100 11110001          CLC
100010101101 10001111          ADD     R15
100010101110 10111111          XCH     R15
100010101111 11011011          LDM     11
100010110000 10111000          XCH     R8
100010110001 10100111          LD      R7              /LOAD AVAS
100010110010 11110101          RAL
100010110011 01101000          INC     R8
100010110100 01111111          ISZ     R15     *-2
             10110010
100010110110 11110001          CLC
100010110111 11110101          RAL
100010111000 01111000          ISZ     R8      *-1
             10110111
100010111010 10110111          XCH     R7
100010111011 01100001  LS36,   INC     R1
100010111100 11011011          LDM     11
100010111101 11110001          CLC
100010111110 10000001          ADD     R1
100010111111 00011100          JCN     AN      LS34    /TEST ADDR.
             10100101
100011000001 00101011          SRC     P5
100011000010 10100111          LD      R7
100011000011 11110100          CMA
100011000100 11100000          WRM                     /WRITE AVAS*
 TO RAM
100011000101 11000000          BBL     0
```

SYMBOL TABLE:

```
LCD13 0011100000000   LS20  0100000000000   LS32  0100010011101
LS10  0011110011001   LS22  0100000011011   LS34  0100010100101
LS12  0011110100010   LS24  0100000101101   LS36  0100010111011
LS14  0011110110011   LS26  0100000110001   LS4   0011101010011
LS16  0011111000001   LS28  0100001011111   LS6   0011101011111
LS18  0011111001110   LS30  0100001111010   LS8   0011110000010
LS2   0011100101110
```

```
        *1201
010010110001 00100000  LCD14,  FIM     P0      192
             11000000
010010110011 00100010          FIM     P1      48
             00110000
010010110101 11011100  LT2,    LDM     12              /INITIALIZE
CAR REG.
010010110110 10110000          XCH     R0
010010110111 00100011          SRC     P1
010010111000 11101001          RDM                     /READ CAR CA
LLS
010010111001 10111110          XCH     R14
010010111010 10111110          XCH     R14
010010111011 11110110          RAR
010010111100 10111110          XCH     R14
010010111101 11010000          LDM     0
010010111110 00011010          JCN     CZ      *+3
             11000001
```

```
010011000000 11010010          LDM     2
010011000001 00100001          SRC     P0
010011000010 11100000          WRM                     /LOAD CAR CA
LL
010011000011 01110000          ISZ     R0      *-9
             10111010
010011000101 01100001          INC     R1
010011000110 01110011          ISZ     R3      L12
             10110101
010011001000 00101100          FIM     P6      13      /INITIALIZE
PASS COUNT
             00001101
010011001010 11010101  LT4,    LDM     5               /INITIALIZE
SET COUNT
010011001011 10111100          XCH     R12
010011001100 00100000  LT6,    FIM     P0      LT6+7
             11010011
010011001110 10101100          LD      R12
010011001111 11110001          CLC
010011010000 10000001          ADD     R1
010011010001 10110001          XCH     R1
010011010010 00011010          JCN     CZ      *+3
             11010101
010011010100 01100000          INC     R0
010011010101 00110100          FIM     P2              /FETCH SET #
010011010110 01000100          JUN             L18
             11100011
010011011000 10000011          131
010011011001 10000101          133
010011011010 10000110          134
010011011011 10001001          137
010011011100 10001010          138
010011011101 10001100          140
010011011110 10000111          135
010011011111 10001011          139
010011100000 10001101          141
010011100001 10001110          142
010011100010 10001111          143
010011100011 00100101  LT8,    SRC     P2
010011100100 11101001          RDM
010011100101 00011100          JCN     AN      *+4     /TEST A(SI)
=0
             11101001
010011100111 01000110          JUN             LT46
             11110100
010011101001 00100000          FIM     P0      192
             11000000
010011101011 00100110          FIM     P3      160
             10100000
010011101101 00101000          FIM     P4      144
             10010000
010011101111 11011100  LT10,   LDM     12
010011110000 10110000          XCH     R0
010011110001 00100111          SRC     P3
010011110010 11101001          RDM                     /READ UP MAS
K
010011110011 10111110          XCH     R14
010011110100 10101110          LD      R14
010011110101 11110001          CLC
010011110110 10010101          SUB     R5
010011110111 00010100          JCN     AZ      *+4     /TEST FL. IN
SET
             11111011
010011111001 11010000          LDM     0
010011111010 10111110          XCH     R14
```

```
010011111011 00101001          SRC     P4
010011111100 11101001          RDM                     /READ DN MAS
K
010011111101 10111111          XCH     R15
010011111110 10101111          LD      R15
010011111111 11110001          CLC
010100000000 10010101          SUB     R5
010100000001 00010100          JCN     AZ      *+4     /TEST FL. IN
 SET
             00000101
010100000011 11010000          LDM     0
010100000100 10111111          XCH     R15
010100000101 00100001  LT12,    SRC     P0
010100000110 10111110          XCH     R14
010100000111 11110110          RAR
010100001000 10111110          XCH     R14
010100001001 00011010          JCN     CZ      *+7
             00010000
010100001011 11101001          RDM
010100001100 11110110          RAR
010100001101 11111010          STC
010100001110 11110101          RAL
010100001111 11100000          WRM                     /LOAD UP MAS
K BIT
010100010000 10111111          XCH     R15
010100010001 11110110          RAR
010100010010 10111111          XCH     R15
010100010011 00011010          JCN     CZ      *+7
             00011010
010100010101 11101001          RDM
010100010110 11110101          RAL
010100010111 11111010          STC
010100011000 11110110          RAR
010100011001 11100000          WRM                     /LOAD DN MAS
K BIT
010100011010 01110000          ISZ     R0      LT12
             00000101
010100011100 01100111          INC     R7
010100011101 01101001          INC     R9
010100011110 01110001          ISZ     R1      LT43
             11110001
010100100000 00100110          FIM     P3      64      /INITIALIZE
CAR COUNT
             01000000
010100100010 00100111          SRC     P3
010100100011 11101110          RDR                     /READ ORD. C
AR NB
010100100100 10110000          XCH     R0
010100100101 11010000  L114,    LDM     0               /RESET NSCV
,UPTR
010100100110 10111111          XCH     R15
010100100111 10100000          LD      R0
010100101000 10111110          XCH     R14
010100101001 00100010          FIM     P1      0
             00000000
010100101011 00100011          SRC     P1
010100101100 11101100          RDO                     /READ INSV
010100101101 11110101          RAL
010100101110 01111110          ISZ     R14     *-1
             00101101
010100110000 00010010          JCN     CN      *+4     /CAL. IN SERV
ICE
             00110100
010100110010 01000110          JUN             L144
             11101001
```

```
010100110100 10100000          LD      R0
010100110101 10111110          XCH     R14
010100110110 10100101          LD      R5
010100110111 11110101          RAL
010100111000 01111110          ISZ     R14     *-1
             00110111
010100111010 00010010          JCN     CN      *+4     /CAR IN CHR.
 SET
             00111110
010100111100 01000110          JUN             LT44
             11101001
010100111110 10100000          LD      R0
010100111111 10111110          XCH     R14
010101000000 00100010          FIM     P1      67
             01000011
010101000010 00100011          SRC     P1
010101000011 11101001          RDM
010101000100 11110101          RAL
010101000101 01111110          ISZ     R14     *-1
             01000100
010101000111 00010010          JCN     CN      LT16    /TEST NEXT
             01100001
010101001001 10100000          LD      R0
010101001010 10111110          XCH     R14
010101001011 00100010          FIM     P1      68
             01000100
010101001101 00100011          SRC     P1
010101001110 11101001          RDM
010101001111 11110101          RAL
010101010000 01111110          ISZ     R14     *-1
             01001111
010101010010 00010010          JCN     CN      LT18    /TEST CONV
             01110001
010101010100 10100000          LD      R0
010101010101 10111110          XCH     R14
010101010110 00100010          FIM     P1      9
             00001001
010101011000 00100011          SRC     P1
010101011001 11101001          RDM
010101011010 11110101          RAL
010101011011 01111110          ISZ     R14     *-1
             01011010
010101011101 00011010          JCN     CZ      LT22    /TEST AVAS
             10100001
010101011111 01000101          JUN             LT24
             11001100
010101100001 00100010  LT16,   FIM     P1      32
             00100000
010101100011 00100011          SRC     P1
010101100100 11101010          RDR                     /READ MAIN F
L. POS.
010101100101 10111011          XCH     R11
010101100110 00100010          FIM     P1      128
             10000000
010101101000 00100011          SRC     P1
010101101001 11010010          LDM     2
010101101010 11100001          WMP
010101101011 00100010          FIM     P1      48
             00110000
010101101101 00100011          SRC     P1
010101101110 11101010          RDR                     /READ MAIN F
L. FEATURE ENABLE
010101101111 01000101          JUN             LT20
             10000100
010101110001 00100010  LT18,   FIM     P1      128
             10000000
```

```
010101110011 00100011          SRC     P1
010101110100 11010001          LDM     1
010101110101 11100001          WMP
010101110110 00100010          FIM     P1      48
             00110000
010101111000 00100011          SRC     P1
010101111001 11101010          RDR                     /READ CONV.
FL. POS.
010101111010 10111011          XCH     R11
010101111011 00100010          FIM     P1      128
             10000000
010101111101 00100011          SRC     P1
010101111110 11010100          LDM     4
010101111111 11100001          WMP
010110000000 00100010          FIM     P1      48
             00110000
010110000010 00100011          SRC     P1
010110000011 11101010          RDR                     /READ CONV.
FEATURE ENABLE
010110000100 11110101  LT20,   RAL
010110000101 11110101          RAL                     /SELECT DIR.
BIT
010110000110 11110011          CMC
010110000111 11010011          LDM     3
010110001000 11110101          RAL                     /FORM MASK A
DDR.
010110001001 10111010          XCH     R10
010110001010 10100000          LD      R0
010110001011 10111110          XCH     R14
010110001100 11111010          STC
010110001101 11010000          LDM     0
010110001110 11110110          RAR
010110001111 01111110          ISZ     R14     *-1     /FORM ASS. W
ORD
             10001110
010110010001 00101011          SRC     P5
010110010010 11100000          WRM                     /LOAD SLOT A
SS.
010110010011 10111111          XCH     R15
010110010100 11110101          RAL
010110010101 11111010          STC                     /SET NXCV =1
010110010110 11110110          RAR
010110010111 10111111          XCH     R15
010110011000 00100010          FIM     P1      9
             00001001
010110011010 00100011          SRC     P1
010110011011 11101001          RDM
010110011100 11110100          CMA
010110011101 00010100          JCN     AZ      LT24    /TEST AVAS*
             11001100
010110011111 01000110          JUN             LT24
             11101001
010110100001 00100001  LT22,   SRC     P0
010110100010 11101101          RDO                     /READ CAS P0
.
010110100011 10110011          XCH     R3
010110100100 10100000          LD      R0
010110100101 10111110          XCH     R14
010110100110 11111010          STC
010110100111 11010000          LDM     0
010110101000 11110110          RAR
010110101001 01111110          ISZ     R14     *-1     /FORM ASS. W
ORD
             10101000
010110101011 10111110          XCH     R14
010110101100 10100000          LD      R0
```

```
010110101101 10111001          XCH    R9
010110101110 11011010          LDM    10
010110101111 10110010          XCH    R2
010110110000 00100011          SRC    P1
010110110001 11101001          RDM
010110110010 11110101          RAL
010110110011 01111001          ISZ    R9      *-1
             10110010
010110110101 00011010          JCN    CZ      **+7    /TEST MASK W
ORD
             10111100
010110110111 11010110          LDM    6
010110111000 10110010          XCH    R2
010110111001 00100011          SRC    P1
010110111010 10101110          LD     R14
010110111011 11100000          WRM                    /LOAD UP EN.
010110111100 10100000          LD     R0
010110111101 10111001          XCH    R9
010110111110 11011001          LDM    9
010110111111 10110010          XCH    R2
010111000000 00100011          SRC    P1
010111000001 11101001          RDM
010111000010 11110101          RAL
010111000011 01111001          ISZ    R9      *-1
             11000010
010111000101 00011010          JCN    CZ      **+7    /TEST DN MAS
K
             11001100
010111000111 11010111          LDM    7
010111001000 10110010          XCH    R2
010111001001 00100011          SRC    P1
010111001010 10101110          LD     R14
010111001011 11100000          WRM                    /LOAD DN EN.
010111001100 10100000  LT24,   LD     R0
010111001101 10111110          XCH    R14
010111001110 00100010          FIM    P1      8
             00001000
010111010000 00100011          SRC    P1
010111010001 11101001          RDM                    /READ UPTR
010111010010 11110101          RAL
010111010011 01111110          ISZ    R14     *-1
             11010010
010111010101 00011010          JCN    CZ      **+13   /TEST UPTR
             11100111
010111010111 10111111          XCH    R15
010111011000 11110110          RAR
010111011001 11111010          STC                    /SET SCAN DI
R. TO 1
010111011010 11110101          RAL
010111011011 10111111          XCH    R15
010111011100 11101110          RD2
010111011101 10111110          XCH    R14
010111011110 11011000          LDM    3
010111011111 11110001          CLC
010111100000 10001110          ADD    R14
010111100001 00011100          JCN    AN      **+6    /TEST DN PEA
K
             11100111
010111100011 11010010          LDM    2
010111100100 11110001          CLC
010111100101 10001111          ADD    R15
010111100110 10111111          XCH    R15             /SET PEAK FL
AG
010111100111 00100001          SRC    P0
010111101000 11010000          LDM    0
010111101001 11100111          WR3                    /CLEAR NODIS
```

```
D
010111101010 10110111          XCH     R7              /CLEAR N(CD)
010111101011 11010000          LDM     0
010111101100 10111001          XCH     R9              /CLEAR J(CD)
010111101101 11011101          LDM     13
010111101110 10111011          XCH     R11             /INIT. SCAN
COUNT
010111101111 01000110          JUN             LT26
             00000000
010111110001 01000100  LT48,   JUN             LT10
             11101111
010111110011 00011010  LT50,   JCN     CZ      *+11
             11111110
010111110101 10101111          LD      R15
010111110110 11110110          RAR
010111110111 11110110          RAR
010111111000 00010010          JCN     CN      *+4
             11111100
010111111010 01000110          JUN             LT36-4
             01100010
010111111100 01000110          JUN             LT36
             01100110
010111111110 01000110          JUN             LT44
             11101001
011000000000 10101011  LT26,   LD      R11
011000000001 11110110          RAR
011000000010 00011010          JCN     CZ      LT30
             00011110
011000000100 11110110          RAR
011000000101 00011010          JCN     CZ      LT30
             00011100
011000000111 10101111          LD      R15             /SCAN BEHIND
011000001000 11110110          RAR
011000001001 00100001          SRC     P0
011000001010 11101100          RDO
011000001011 00011010          JCN     CZ      *+3
             00001110
011000001101 11110100          CMA
011000001110 11110010          IAC
011000001111 00010100          JCN     AZ      LT44    /CAR AT TERM
. FLOOR
             11101001
011000010001 10111000          XCH     R8              /LOAD IN SLO
T COUNT
011000010010 10101000          LD      R8
011000010011 10111010          XCH     R10             /LOAD CONST.
011000010100 01000110          JUN             LT32
             00101001
011000010110 11010001  LT28,   LDM     1               /SCAN REVER
SE
011000010111 10111000          XCH     R8
011000011000 11010001          LDM     1
011000011001 10111010          XCH     R10
011000011010 01000110          JUN             LT32
             00101001
011000011100 10101111  LT30,   LD      R15             /SCAN FORWAR
D
011000011101 11110110          RAR
011000011110 00100001          SRC     P0
011000011111 11101100          RDO
011000100000 00010010          JCN     CN      *+3
             00100011
011000100010 11110100          CMA
011000100011 11110010          IAC
011000100100 00010100          JCN     AZ      LT42+2  /CAR AT TERM
. FL.
```

```
                11011101
011000100110 10111000          XCH     R8
011000100111 11010001          LDM     1
011000101000 10111010          XCH     R10
011000101001 11110000  LT32,   CLB                     /CALCULATE A
DDR.
011000101010 10101000          LD      R8
011000101011 10011010          SUB     R10
011000101100 10110001          XCH     R1
011000101101 10101111          LD      R15
011000101110 11110110          RAR
011000101111 00010010          JCN     CN      *+12
                00111011
011000110001 10110001          XCH     R1              /DN DIR. SCA
N
011000110010 11110100          CMA
011000110011 10110001          XCH     R1
011000110100 10100001          LD      R1
011000110101 10110011          XCH     R3
011000110110 00100001          SRC     P0
011000110111 11101001          RDM
011000111000 11110101          RAL
011000111001 01000110          JUN             LT34
                01000000
011000111011 10100001          LD      R1              /UP DIR. SCA
N
011000111100 10110011          XCH     R3
011000111101 00100001          SRC     P0
011000111110 11101001          RDM
011000111111 11110110          RAR
011001000000 00011010  LT34,   JCN     CZ      LT42    /SLOT ENABLE
D
                11011011
011001000010 00100010          FIM     P1      9
                00001001
011001000100 00100011          SRC     P1
011001000101 10100000          LD      R0
011001000110 10111110          XCH     R14
011001000111 11101001          RDM                     /REAL AVAS*
011001001000 11110101          RAL
011001001001 01111110          ISZ     R14     *-1
                01001000
011001001011 10100001          LD      R1
011001001100 10110011          XCH     R3
011001001101 00100001          SRC     P0
011001001110 11101111          RD3
011001001111 10111110          XCH     R14
011001010000 00011010          JCN     CZ      LT36    /TEST AVAS*
=0
                01100110
011001010010 10101111          LD      R15
011001010011 11110101          RAL
011001010100 00010010          JCN     CN      LT36    /TEST SYC = 
1
                01100110
011001010110 10100000          LD      R0
011001010111 11110101          RAL
011001011000 11110001          CLC
011001011001 11110110          RAR
011001011010 10110000          XCH     R0
011001011011 00100001          SRC     P0
011001011100 10110000          XCH     R0
011001011101 11101101          RD1                     /READ Q(HRT)
011001011110 11110001          CLC
011001011111 10011110          SUB     R14             /Q(HRT)-N(DI
ST)
```

```
011001100000 01000101          JUN              LT50
             11110011
011001100010 00100001          SRC      P0
011001100011 11101111          RD3
011001100100 11110010          IAC                       /INCR. NCBIS
T)
011001100101 11100111          WR3
011001100110 10101111  LT36,   LD       R15
011001100111 11110110          RAR
011001101000 11010110          LDM      6                /UP ASS. ADD
R.
011001101001 00010010          JCN      CN       *+3
             01101100
011001101011 11010111          LDM      7                /DN ASS. ADD
R.
011001101100 10110010          XCH      R2
011001101101 10100001          LD       R1
011001101110 10110011          XCH      R3
011001101111 00100011          SRC      P1
011001110000 11101001          RDM
011001110001 00011100          JCN      AN       LT42     /ALREADY ASS
IGNED
             11011011
011001110011 11010011          LDM      3
011001110100 11110001          CLC
011001110101 10001101          ADD      R13
011001110110 00011100          JCN      AN       *+8      /FIRST PASS
             01111110
011001111000 00100001          SRC      P0
011001111001 11101001          RDM
011001111010 11110110          RAR
011001111011 11110110          RAR
011001111100 00011010          JCN      CZ       LT42     /TEST FOR CA
R CALL
             11011011
011001111110 11010001          LDM      1
011001111111 10110010          XCH      R2
011010000000 00100011          SRC      P1
011010000001 10101111          LD       R15
011010000010 11110110          RAR
011010000011 11101001          RDM                       /READ COUNT.
CALLS
011010000100 00010010          JCN      CN       *+3
             10000111
011010000110 11110110          RAR
011010000111 11110110          RAR
011010001000 00011010          JCN      CZ       LT38     /TEST FOR CO
UR. CALL
             10101000
011010001010 00100001          SRC      P0
011010001011 11101101          RD1
011010001100 11110010          IAC                       /N(ACT)+1
011010001101 10111110          XCH      R14
011010001110 11010010          LDM      2
011010001111 10110100          XCH      R4
011010010000 00100101          SRC      P2
011010010001 11101100          RDO
011010010010 11110001          CLC
011010010011 10011110          SUB      R14              /A(CH)-(N(CH
T)+1)
011010010100 00011010          JCN      CZ       LT42
             11011011
011010010110 11010001          LDM      1
011010010111 11110001          CLC
011010011000 10001101          ADD      R13
011010011001 00010100          JCN      AZ       *+8      /TEST THIRD
```

```
PASS
                10100001
011010011011    11101001        RDM                             /READ N(CI)
011010011100    11111000        DAC                             /A(CI)-N(CI)
+1)
011010011101    11110001        CLC
011010011110    10010111        SUB     R7
011010011111    00011010        JCN     CZ      LT42
                11011011
011010100001    01100111        INC     R7                      /INCR. N(CI)
011010100010    00100001        SRC     P0
011010100011    11101101        RD1
011010100100    11110010        IAC                             /INCR. N(CI
)
011010100101    11100101        WR1
011010100110    01000110        JUN             LT40
                11000000
011010101000    11010001  LT38,  LDM     1
011010101001    11110001        CLC
011010101010    10001101        ADD     R13
011010101011    00010100        JCN     AZ      LT40    /IS IT TRIED
PASS
                11000000
011010101101    11011000        LDM     8
011010101110    10110100        XCH     R4
011010101111    00100101        SRC     P2
011010110000    11101001        RD2                             /READ N(SI)
011010110001    11111000        DAC                             /A(SI)-(N(SI
)+1)
011010110010    11110001        CLC
011010110011    10011001        SUB     R9
011010110100    00011010        JCN     CZ      LT42
                11011011
011010110110    00100001        SRC     P0
011010110111    11101110        RD2                             /READ N(SS)
011010111000    10111110        XCH     R14
011010111001    00100101        SRC     P2
011010111010    11101100        RD0                             /READ A(SI)
011010111011    11111000        DAC                             /A(SI)-(N(SS
)+1)
011010111100    11110001        CLC
011010111101    10011110        SUB     R14
011010111110    00011010        JCN     CZ      LT42
                11011011
011011000000    10101111  LT40,  LD      R15
011011000001    11110110        RAR
011011000010    11110110        RAR
011011000011    00010010        JCN     CN      *+7
                11001010
011011000101    01101001        INC     R9                      /INCR. N(SI)
011011000110    00100001        SRC     P0
011011000111    11101110        RD2
011011001000    11110010        IAC                             /INCR. N(SS)
011011001001    11100110        WR2
011011001010    10100000        LD      R0                      /ASSIGN SLOT
011011001011    10111110        XCH     R14
011011001100    11110000        CLB
011011001101    11111010        STC
011011001110    11110110        RAR                             /FLAG ASS. A
SLOT
011011001111    01111110        ISZ     R14     *-1
                11001110
011011010001    10110010        XCH     R2
011011010010    10101111        LD      R15
011011010011    11110110        RAR
011011010100    11010110        LDM     6                       /IF ASS. ADD
```

```
R.
011011010101 00010010          JCN    CN     *+3
             11011000
011011010111 11010111          LDM    7                  /DM ADD. ADD
R.
011011011000 10110010          XCH    R3
011011011001 00100011          SRC    P1
011011011010 11100000          WRM                       /WRITE ASSIG
MENT
011011011011 01111000  LT42,   ISZ    R8     LT52        /END SLOT LO
OP
             00101001
011011011101 11010011          LDM    3
011011011110 11110001          CLC
011011011111 10001101          ADD    R13
011011100000 00010100          JCN    AZ     LT44        /TEST FIRST
PASS
             11101001
011011100010 10111111          XCH    R15
011011100011 11110110          RAR
011011100100 11110011          CMC                       /COMPL. SCAN
DIR.
011011100101 11110101          RAL
011011100110 10111111          XCH    R15
011011100111 01111011          ISZ    R11    LT26        /END SCAN L
OOP
             00000000
011011101001 01100110  LT44,   INC    R6
011011101010 00100111          SRC    P3
011011101011 11101110          RDM
011011101100 10110000          XCH    R0                 /LOAD CHR. C
AR NR
011011101101 11011000          LDM    8
011011101110 11110001          CLC
011011101111 10000110          ADD    R6
011011110000 00010100          JCN    AZ     **4         /END CHR LOO
P
             11110100
011011110010 01000101          JUN            LT14
             00100101
011011110100 01111100  LT46,   ISZ    R12    **6         /END SET LOO
P
             11111010
011011110110 01111101          ISZ    R13    **6         /END PASS LO
OP
             11111100
011011111000 01000110          JUN            **6
             11111110
011011111010 01000100          JUN            LT6
             11001100
011011111100 01000100          JUN            LT4
             11001010
011011111110 11000000          BBL    0
```

SYMBOL TABLE:

| | | | | | |
|---|---|---|---|---|---|
| LCD14 | 0010010110001 | LT24 | 0010111001100 | LT40 | 0011011000000 |
| LT10 | 0010011101111 | LT26 | 0011000000000 | LT42 | 0011011111011 |
| LT12 | 0010100000101 | LT28 | 0011000010110 | LT44 | 0011011101001 |
| LT14 | 0010100100101 | LT30 | 0011000011100 | LT46 | 0011011110100 |
| LT16 | 0010101100001 | LT32 | 0011000101001 | LT48 | 0011011111001 |
| LT18 | 0010101110001 | LT34 | 0011001000000 | LT50 | 0011011111011 |
| LT2 | 0010010110101 | LT36 | 0011001100110 | LT6 | 0010011001100 |
| LT20 | 0010110000100 | LT38 | 0011010101000 | LT8 | 0010011100011 |
| LT22 | 0010110100001 | LT4 | 0010011001010 | | |

I claim as my invention:

1. An elevator system for a building having a plurality of landings, comprising:

a plurality of elevator cars, means mounting said plurality of elevator cars for movement relative to the landings, up and down hall call registering means for registering calls for elevator service in the up and down directions, respectively, from at least certain of the landings, car control means for each of said plurality of elevator cars, each of said car control means providing enable signals indicative of the landings, and service directions therefrom, the associated elevator car is capable of serving, and supervisory control means responsive to said up and down hall call registering means and to the enable signals provided by each of said car control means, said supervisory control means including storage means for storing said enable signals to obtain the building configuration existing at any instant, said supervisory conrol means effectively assigning calls for elevator service registered on said up and down hall call registering means to predetermined cars, using the building configuration stored in said storage means to determine which landings and service directions therefrom are currently in the building configuration, and which landings and service directions therefrom, each of the cars is capable of serving.

2. The elevator system of claim 1 wherein the supervisory control means includes means dividing the up and down hall call registering means among all in-service elevator cars, and effectively assigning hall calls registered thereon by enabling selected elevator cars to serve calls registered on selected hall call registering means, with only one car being enabled for any one hall call registering means.

3. The elevator system of claim 1 including timing means which repetitively divides successive like periods of time into a plurality of scan slots, with each up and down hall call registering means being assigned a different scan slot, and wherein the supervisory control means includes means dividing the scan slots associated with the hall call registering means among all of the in-service elevator cars, and assigns the scan slots to the elevator cars, effectively assigning hall calls registered on the hall call registering means to the elevator cars by enabling an elevator car to answer a hall call associated with an assigned scan slot.

4. The elevator system of claim 1 wherein the storage means responsive to the enable signals provided by the car control means stores a binary signal for each landing, and service direction therefrom, for each car, with the binary signals being stored in the same car associated sequence for each landing, providing a binary word for each landing in which the state of the binary signals indicate whether the elevator cars associated with these bit locations of the word are capable of serving the associated service direction from that landing.

5. The elevator system of claim 4 wherein the supervisory control means effectively assigns calls for elevator service registered on the hall call registering means to the elevator cars in a priority order based at least in part on the sets of landings and service directions therefrom served by the same combination of elevator cars, with like binary words in the storage means identifying those landings and service directions therefrom which belong to the same set.

6. The elevator system of claim 5 including addressable means for storing information relative to the sets, with each binary words stored in the storage means being the address for the set the word is associated with in said addressable means.

7. The elevator system of claim 1 wherein the storage means includes first and second sections responsive to the enable signals provided by the car control means, with said first section storing a binary signal for each landing, for each car, for one service direction, and said second section storing a binary signal for each landing, for each car, for the other service direction, with the stored signal sequences from the cars for each landing, in each storage means, being similar, providing a binary word for each landing in each storage means in which the state of the binary signals indicate whether the elevator cars associated with these bit locations of the word are capable of serving the associated service direction from that landing.

8. The elevator system of claim 7 wherein the supervisory control means effectively assigns calls for elevator service registered on the hall call registering means to the elevator cars in a priority order based at least in part on the sets of landings and service directions therefrom served by the same combination of elevator cars, with like binary words in the first and second section of the storage means identifying those landings and service directions therefrom which belong to the same set.

9. The elevator system of claim 8 including addressable means for storing information relative to the sets, with each binary word stored in the first and second section of the storage means being the address for the set the word is associated with in said addressable means.

10. An elevator system for a structure having a plurality of landings, comprising:

a plurality of elevator cars, means mounting said plurality of elevator cars for movement relative to the landings, up and down hall call registering means for registering calls for elevator service in the up and down directions, respectively, from at least certain of the landings, averaging means providing a first average responsive to the number of registered up and down hall calls in the structure and the number of in-service elevator cars, and a second average responsive to the number of up and down hall call registering means in the structure and the number of in-service elevator cars, and control means controlling the operation of said elevator cars in response to both said first and second averages.

11. The elevator system of claim 10 wherein the control means divides the hall call registering means among the in-service elevator cars, and assigns the associated landings and service directions therefrom to all of the in-service elevator cars, with the number of calls assigned to any one car not exceeding the first average.

12. The elevator system of claim 11 wherein the control means assigns predetermined landings and service directions therefrom to each in-service elevator car without regard to whether there is a registered landing call associated therewith until the first average is reached, at which time only those landings and service directions therefrom which do not have a registered landing call associated therewith are assigned to that car, until the second average is reached.

13. The elevator system of claim 11 wherein the control means periodically clears at least certain of the landing assignments given to the elevator cars, and attempts to reassign the cleared landing assignments based upon the latest first and second averages provided by the averaging means.

14. The elevator system of claim 11 wherein the control means periodically clears all landing assignments given to the elevator cars except those assigned landing which have a registered call associated therewith, and attempts to reassign the cleared landings based on the latest first and second averages provided by the averaging means.

15. The elevator system of claim 11 wherein the control means includes means for assigning landings and service directions therefrom to the elevator cars in a plurality of successive assignment passes, considering all of the in-service elevator cars in one assignment pass before going to the next assignment pass.

16. The elevator system of claim 15 wherein the means for assigning landings, in one of the assignment passes, makes a general assignment, assigning unassigned landings and directions therefrom to the cars, without regard to whether the assigned landing and direction has a registered hall call, unless the first average is met before the second average, in which event only unassigned landings and directions therefrom which do not have a registered hall call are assigned until the second average is met.

17. The elevator system of claim 16 including means associated with each elevator car for registering car calls, and wherein the means for making a predetermined assignment pass, which precedes the assignment pass in which the general assignment is made, assigns predetermined service directions from the landings associated with the car calls to the cars which will stop at those landings due to registered car calls.

18. The elevator system of claim 16 wherein the means for making a predetermined assignment pass, which precedes the assignment pass in which the general assignment is made, assigns both service directions of a floor to an in-service idle elevator car standing at the floor.

19. The elevator system of claim 16 wherein the means for making assignment passes makes an assignment pass following the assignment pass in which the general assignment was made with this subsequent assignment pass assigning unassigned service directions from landings to cars subject to the first average without regard to the second average.

20. The elevator system of claim 10 including timing means which repetitively divides successive like intervals of time into a plurality of scan slots, with each up and down hall call registering means being assigned a different scan slot, and wherein the control means divides the scan slots associated with a hall call registering means among all the in-service elevator cars and assigns the scan slots to the elevator cars, subject at least to the second average.

21. An elevator system for a building having a plurality of landings, comprising:

a plurality of elevator cars, means mounting said plurality of elevator cars for movement relative to the landings, up and down hall call registering means for registering calls for elevator service in the up and down directions, respectively, from at least certain of the landings, means enabling each of said elevator cars to serve calls for elevator service from predetermined landings such that all of the cars are not enabled for the same landings and service directions therefrom, means responsive to which landings each in-service elevator car is enabled to serve, said means dividing the landings of the structure into sets according to the landings served by the same combination of cars, averaging means providing a building call average responsive to the number of registered up and down hall calls in the building and the number of in-service elevator cars, a building landing average responsive to the number of up and down hall call registering means in the building and the number of in-service elevator cars, a set call average for each of the sets responsive to the number of registered up and down hall calls in each set and the number of in-service elevator cars enabled to serve each set, and a set landing average for each of the sets responsive to the number of up and down hall call registering means in each set and the number of in-service elevator cars enabled to serve each set, and control means controlling the operation of said elevator cars in response to the set call average, the set landing average, the building call average and the building landing average.

22. The elevator system of claim 21 wherein the control means divides the hall call registering means associated with each set among the in-service elevator cars assigned to the set, and assigns the associated landings and service directions therefrom to these cars, with the number of calls assigned to any one car not exceeding the building call average.

23. The elevator system of claim 22 wherein the control means considers the sets in the order of increasing number of elevator cars per set.

24. The elevator system of claim 22 wherein the control means assigns landings in each set to the associated elevator cars subject to the set call average, the set landing average, the building call average, and the building landing average, and if a landing service direction remains unassigned, the control means assigns an unassigned landing service direction to a car enabled for that floor and service direction subject only to the building call average.

25. The elevator system of claim 22 wherein the control means assigns predetermined landing service directions to the in-service elevator cars without regard to whether there is a registered landing call associated therewith, until the set call average or building call average is reached for a car, at which time only those landings and service directions therefrom which do not have a registered landing call associated therewith are assigned to that car, until the set landing average or building landing average is reached for that car.

26. The elevator system of claim 22 wherein the control means periodically clears predetermined landing assignments to the elevator cars and reassigns the landings based on the latest set call average, set landing average, building call average, and building landing average.

27. The elevator system of claim 22 wherein the control means periodically clears all landing assignments to the elevator cars except those assigned landings which have a registered call associated therewith, and reassigns the cleared landings based on the latest set call average, set landing average, building call average, and building landing average.

28. The elevator system of claim 22 wherein the control means includes means for assigning landings and service directions therefrom to the elevator cars in a plurality of successive assignment passes, considering all of the in-service elevator cars associated with the set being considered in one assignment pass, before going to the next assignment pass.

29. The elevator system of claim 28 wherein the means for assigning landings in one of the assignment passes makes a general assignment which starts at each car and proceeds in a selected direction therefrom, assigning unassigned landings and directions therefrom until the set landing average or building landing average is met, skipping landings having registered hall calls if the set call average or building call average is met before the set landing average or building landing average.

30. The elevator system of claim 29 including means associated with each elevator car for registering car calls, and wherein the means for making a predetermined assignment pass, which precedes the assignment pass in which the general assignment is made, assigns predetermined service directions from the landings associated with the car calls to the cars which will stop at those landings due to the car calls, without regard as to whether there is a registered hall call at the landing.

31. The elevator system of claim 29 wherein the means for making a predetermined assignment pass, which precedes the assignment pass in which the general assignment is made, assigns both service directions of a floor to an in-service, idle elevator car standing at the floor.

32. The elevator system of claim 29 wherein the means for making assignment passes makes an assignment pass following the assignment pass in which the general assignment was made, with this subsequent assignment pass assigning unassigned service directions from landings to cars subject to the building call average but without regard to the other averages.

33. The elevator system of claim 21 including timing means which repetitively divides successive like intervals of time into a plurality of scan slots, with each up and down hall call registering means being assigned a different scan slot, and wherein the control means divides the scan slots associated with a hall call registering means among all of the in-service elevator cars for each set and assigns the scan slots to the elevator cars, subject to at least to the set landing average.

34. The elevator system of claim 21 wherein the means which divides the landings into sets redefines the sets in response to a predetermined condition.

35. The elevator system of claim 34 including means for detecting a car going into or out of service, with a car going into or out of service being a predetermined condition which will cause the sets to be redefined.

36. The elevator system of claim 34 including means for detecting a car by-passing hall calls, with a car by-passing hall calls being a predetermined condition which will cause the sets to be redefined.

37. An elevator system comprising:

a building having a plurality of floors, a plurality of elevator cars mounted for movement relative to at least certain of said floors, call means for registering calls for elevator service from at least certain of said floors, car control means for each of said plurality of elevator cars, each of said car control means providing signals indicative of the floors, and service directions therefrom, the associated elevator car is capable of serving, and supervisory control means responsive to said call means and to each of said car control means, said supervisory control means including first means grouping the floors served by the same combination of elevator cars into a set, second means determining, for each such set, which elevator car associated with a set should serve a call from a floor of the set, and third means effectively assigning the calls for elevator service to said plurality of elevator cars by providing signals for the car control means of said plurality of elevator cars, in accordance with said second means.

38. The elevator system of claim 37 wherein the second means considers the sets in a predetermined order.

39. The elevator system of claim 37 wherein the second means considers the sets in the order of increasing number of cars per set.

40. The elevator system of claim 37 wherein the second means considers the elevator cars associated with each set in a predetermined order.

41. The elevator system of claim 37 wherein the second means determines, for each set, which floors, and service directions therefrom, included in each set, should be served by the cars capable of serving the set, whether or not the floor and service direction has a registered call for elevator service, and the third means effectively assigns the floors, and service directions therefrom, to the elevator cars in accordance with the second means.

42. The elevator system of claim 37 wherein the supervisory control means includes averaging for providing a building call per car average responsive to the number of registered calls in the building and the number of elevator cars, with the second means being responsive to said building call per car average such that the total number of calls assigned to any elevator car by the third means will not exceed this average.

43. The elevator system of claim 37 wherein the supervisory control means includes averaging means for providing a building call per car average responsive to the number of registered calls in the building and the number of in-service elevator cars, and a set call per car average for each set responsive to the number of registered calls in the set and the number of in-service cars capable of serving the set, with the second means being responsive to said building call per car average and to the associated set call per car average such that the total number of calls assigned to any one elevator car by the third means will not exceed the building call per car average, and the number of calls from any set assigned to any one elevator car will not exceed the set call per car average for this set.

44. The elevator system of claim 37 wherein the supervisory control means includes averaging means for providing a building call per car average responsive to the number of registered calls in the building and the number of elevator cars, and a set call per car average for each set responsive to the number of registered calls in the set and the number of cars capable of serving the set, with the second means first determining, for each set, which cars should serve the registered calls, subject to both the building call per car average and to the set call per car average, and then determining, for each set, which cars should serve any registered calls not effectively assigned to a car during the first determination, subject to the building call per car average but without regard to the set call per car average.

45. The elevator system of claim 37 wherein the call means includes up and down hall call registering means for registering calls for elevator service in the up and down directions, respectively, from at least certain of the floors, and averaging means for providing a first average responsive to the number of registered up and down hall calls in the building and the number of elevator cars, and a second average responsive to the number of up and down hall call registering means in the building and the number of elevator cars, wherein the second and third means cooperate to assign all floors, and directions therefrom, to the elevator cars, within predetermined limitations, whether or not they have a hall call associated therewith, with the second means being responsive to both of said first and second averages such that the total number of calls and floor directions assigned to any elevator car by the third means will not exceed the first and second averages, respectively.

46. The elevator system of claim 37 wherein the call means includes up and down hall call registering means for registering calls for elevator service in the up and down directions, respectively, from at least certain of the floors, and averaging means which provides a first average responsive to the number of registered up and down hall calls in the building and the number of in-service elevator cars, and a second average responsive to the number of hall call registering means in the building and the number of in-service elevator cars, wherein the second and third means cooperate to assign all floors, and service directions therefrom to the elevator cars, within predetermined limitations, whether or not they have a hall call associated therewith, with the second means first determining for each set, which cars should serve registered calls subject to both the first and second averages, and then determining, for each set, which car should serve a registered hall call not assigned by the cooperative second and third means during the first determination, subject to the first average but without regard to the second average.

47. The elevator system of claim 37 including timing means which repetitively divides successive like periods of time into a plurality of scan slots, and the call means includes up and down hall call registering means for registering hall calls for elevator service in the up and down directions, respectively, from at least certain of the floors, with each up and down hall call registering means being assigned to a different one of said scan slots, and wherein the second means determines, for each set, how the scan slots associated with the set should be divided among the elevator cars capable of serving the set, and the third means effectively assigns these scan slots to the elevator cars in accordance with the second means.

48. The elevator system of claim 37 wherein the supervisory control means includes first and second storage means responsive to the signals provided by the car control means of the plurality of elevator cars, said first storage means storing a binary signal for each floor, for each car, for the down service direction, and said second storage means storing a binary signal for each floor, for each car, for the up service direction, with the stored signal sequences from the cars for each floor, in each storage means being similar, such that a binary word is formed for each floor, in each storage means, with the state of the binary signal being indicative of whether the car associated with each bit location of the word is capable of serving the associated service direction from that floor, and including third storage means having a plurality of addressable storage locations for storing information relative to the sets, with the binary word associated with each floor in the first and second storage means being the third storage means address of the set this floor and service direction therefrom, belongs to.

49. An elevator system for a structure having a plurality of landings, comprising:

a plurality of elevator cars, means mounting said plurality of elevator cars for movement relative to the landings, up and down hall call registering means for registering calls for elevator service in the up and down directions, respectively, from at least certain of the landings, car control means for each of said plurality of elevator cars, each of said car control means providing signals indicative of the landings, and service directions therefrom, the associated elevator car is capable of serving, and supervisory control means responsive to said up and down hall call registering means and to each of said car control means, said supervisory control means including first means grouping the floors served by the same combination of elevator cars into a set, second means determining, for each such set, subject to at least one predetermined limitation, which elevator car associated with a set should serve a landing of the set, third means responsive to the second means, effectively assigning service directions from the landings to said plurality of elevator cars by providing signals for the car control means of said plurality of elevator cars, and averaging means providing a first average responsive to the number of registered up and down hall calls in the structure and the number of in-service elevator cars, with said first average being a limitation said second means is subject to when determining which elevator car should serve a landing.

50. The elevator system of claim 49 wherein the supervisory control means divides the hall call registering means among all of the in-service elevator cars, and assigns the associated landings and service direction therefrom to all of the in-service cars, with the number of calls assigned to any one car not exceeding the first average.

51. The elevator system of claim 49 wherein the averaging means provides a second average responsive to the number of up and down hall call registering means in the structure and the number of in-service elevator cars, and the second and third means cooperate to assign predetermined service directions from landings to each in-service elevator car without regard to whether there is a registered hall call associated therewith, until the first average is reached, at which time only those landings and service directions therefrom which do not have a registered hall call associated therewith are assigned to that car, until the second average is reached.

52. The elevator system of claim 49 wherein the supervisory control means periodically clears certain landing service direction assignments to the elevator cars and reassigns these landing service directions based upon the latest information provided by the averaging means.

53. the elevator system of claim 49 wherein the supervisory control means periodically clears all landing assignments to the elevator cars except those assigned landings which have a registered call associated therewith, and reassigns the cleared landings based upon the latest averages provided by the averaging means.

54. The elevator system of claim 49 wherein the second and third means cooperate to assign landings and service directions therefrom to the elevator cars in a plurality of successive assignment passes.

55. The elevator system of claim 49 wherein the averaging means provides a second average responsive to the number of up and down hall call registering means and the number of in-service elevator cars, and wherein one of the passes makes a general assignment which starts at the cars, and proceeds therefrom in their travel direction, reverses at the terminal floor in this direction and proceeds to the other terminal floor, and again reverses to proceed back to the car, and assigns unassigned landings and directions therefrom until the first average is met, skipping landings having registered landing calls if the first average is met before the second average is met.

56. The elevator system of claim 55 including means associated with each elevator car for registering car calls, and wherein a predetermined assignment pass which precedes the assignment pass in which the general assignment is made, assigns predetermined service directions from the landings associated with the car calls to the cars which will stop at those landings due to the car calls.

57. The elevator system of claim 55 wherein a predetermined assignment pass, which precedes the assignment pass in which the general assignment is made, assigns both service directions of the floor at which in-service idle car is standing to the idle car.

58. The elevator system of claim 55 wherein an assignment pass is made following the assignment pass in which the general assignment was made, with this subsequent assignment pass assigning unassigned landing service directions to cars, subject to the first average but without regard to the second average.

59. The elevator system of claim 49 including timing means which repetitively divides successive like intervals of time into a plurality of scan slots, with each up and down hall call registering means being assigned a different scan slot, and wherein the supervisory control means divides the scan slots associated with the hall call registering means among the in-service elevator cars and assigns the scan slots to the elevator cars, subject to the first average.

60. The elevator system of claim 49 wherein the averaging means provides a second average responsive to the number of up and down hall call registering means in the building and the number of in-service elevator cars, a third average for each of the sets responsive to the number of registered up and down hall calls in each set and the number of in-service elevator cars enabled to serve each set, and a fourth average for each of the sets responsive to the number of up and down hall registering means in each set and the number of in-service elevator cars enabled to serve each set, said supervisory control means controlling the operation of said elevator cars in response to said first, second, third and fourth averages.

61. The elevator system of claim 60 wherein the first means divides the hall call registering means associated with each set among the in-service elevator cars assigned to the set, and the second means assigns the associated landings and service directions therefrom to these cars, with the number of calls assigned to any one car not exceeding the first average.

62. The elevator system of claim 61 wherein the control means considers the sets in the order of increasing number of elevator cars per set.

63. The elevator system of claim 61 wherein the supervisory control means assigns calls and landings in each set to the associated elevator cars subject to the third and fourth averages, and if a landing service direction remains unassigned, the supervisory control means assigns unassigned landing service directions to cars enabled for the unassigned landing service direction subject only to the first of the averages.

64. An elevator system for a building having a plurality of floors, comprising:

a plurality of elevator cars, means mounting said plurality of elevator cars for movement relative to the floors, car control means for each of said plurality of elevator cars, each of said car control means providing floor enable signals indicative of floors of the building the associated elevator car is enabled to serve, and system control means, said system control means, in response to said floor enable signals, providing signals for the car control means of at least certain of the elevator cars which cause said plurality of elevator cars to provide elevator service for the floors of the building according to a predetermined strategy.

65. The elevator system of claim 64 including means for registering requests for elevator service from at least certain of the floors and service directions therefrom, and wherein the signals provided by the system control means inhibit selected elevator cars from serving requests for elevator service from predetermined floors and service directions therefrom which they are otherwise enabled to serve, effectively assigning each floor and service direction therefrom to only one of the elevator cars enabled therefor.

66. The elevator system of claim 64 including means for registering requests for elevator service from at least certain of the floors and service directions therefrom, and wherein the system control means, in response to the floor enable signals, determines the sets of floors and service directions therefrom served by the same combination of elevator cars, with said sets being utilized by the system control means when providing signals for the car control means of the elevator cars.

67. The elevator system of claim 64 including averaging means periodically providing a first average responsive to a predetermined first parameter of the elevator system, with the signals provided by the system control means effectively dividing the floors of the building and service directions therefrom among the elevator cars responsive to said first average.

68. The elevator system of claim 67 including means for registering requests for elevator service from at least certain of the floors and service directions therefrom, with the first average being responsive to the number of floors and service directions served by the elevator cars and the number of elevator cars.

69. The elevator system of claim 68 wherein the averaging means periodically provides a second average responsive to the number of registered requests for elevator service and the number of elevator cars, with the system control means being additionally responsive to said second average when dividing floors and service directions therefrom among the elevator cars.

70. The elevator system of claim 68 wherein the system control means, in response to the floor enable signals, determines the sets of floors and service directions therefrom served by the same combination of elevator cars, and the averaging means periodically provides a set floor average for each set served by more than one elevator car responsive to the number of floors and service directions therefrom in the set and the number of elevator cars enabled to serve the set, with the system control means being additionally responsive to the set floor average when dividing the floors and service directions therefrom of each set among the elevator cars enabled to serve the set.

71. The elevator system of claim 70 wherein the averaging means periodically provides a second average responsive to the number of requests for elevator service and the number of elevator cars, and a set call average for each set served by more than one elevator car responsive to the number of requests for elevator service in the set and the number of elevator cars enabled to serve the set, with the system control means being additionally responsive to the second average and to the set call average when dividing the floors and service directions therefrom of each set among the elevator cars enabled to serve the set.

72. An elevator system for a building having a plurality of floors, comprising:

a plurality of elevator cars, means mounting said plurality of elevator cars for movement relative to the floors, means for registering calls for elevator service from at least certain of the floors and service directions therefrom, averaging means periodically providing a first average responsive to a predetermined first parameter of the elevator system, and system control means periodically dividing the floors and service directions therefrom among the plurality of elevator cars subject to predetermined constraints which include said first average.

73. The elevator system of claim 72 wherein the system control means provides signals which inhibit selected elevator cars from serving calls for elevator service from predetermined service directions from the floors, effectively assigning each service direction from a floor to only one of the elevator cars.

74. The elevator system of claim 72 wherein the system control means determines the sets of floors and service directions therefrom served by the same combination of elevator cars, with said sets being utilized by the system control means when dividing the floors and service directions therefrom among the elevator cars.

75. The elevator system of claim 72 wherein the first average is responsive to the number of floors and service directions served by the elevator cars and the number of elevator cars.

76. The elevator system of claim 75 wherein the averaging means periodically provides a second average responsive to the number of calls for elevator service and the number of elevator cars, with the system control means being additionally responsive to said second average when dividing floors and service directions therefrom among the elevator cars.

77. The elevator system of claim 72 wherein the system control means determines the sets of floors and service directions therefrom served by the same combination of elevator cars, and the averaging means periodically provides a set floor average for each set served by more than one elevator car responsive to the number of floors and service directions therefrom in the set and the number of elevator cars enabled to serve the set, with the system control means being additionally responsive to the set floor average when dividing the floors and service directions therefrom of each set among the elevator cars enabled to serve the set.

78. The elevator system of claim 77 wherein the averaging means periodically provides a second average responsive to the number of calls for elevator service and the number of elevator cars, and a set call average for each set served by more than one elevator car responsive to the number of calls for elevator service in the set and the number of elevator cars enabled to serve the set, with the system control means being additionally responsive to the second average and to the set call average when dividing the floors and service directions therefrom of each set among the elevator cars enabled to serve the set.

* * * * *